US010073386B2

(12) United States Patent
Sugimoto et al.

(10) Patent No.: US 10,073,386 B2
(45) Date of Patent: Sep. 11, 2018

(54) IMAGE FORMING APPARATUS

(71) Applicants: Naomi Sugimoto, Kanagawa (JP); Hirokazu Ishii, Tokyo (JP); Kenji Sugiura, Kanagawa (JP); Atsushi Nagata, Kanagawa (JP); Takehide Mizutani, Tokyo (JP); Keigo Nakamura, Kanagawa (JP); Yuuji Wada, Kanagawa (JP); Naoto Kochi, Tokyo (JP); Shinya Tanaka, Kanagawa (JP)

(72) Inventors: Naomi Sugimoto, Kanagawa (JP); Hirokazu Ishii, Tokyo (JP); Kenji Sugiura, Kanagawa (JP); Atsushi Nagata, Kanagawa (JP); Takehide Mizutani, Tokyo (JP); Keigo Nakamura, Kanagawa (JP); Yuuji Wada, Kanagawa (JP); Naoto Kochi, Tokyo (JP); Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/482,837

(22) Filed: Apr. 10, 2017

(65) Prior Publication Data

US 2017/0299987 A1 Oct. 19, 2017

(30) Foreign Application Priority Data

Apr. 14, 2016 (JP) ..... 2016-081456
Apr. 14, 2016 (JP) ..... 2016-081550
(Continued)

(51) Int. Cl.
*G03G 15/16* (2006.01)

(52) U.S. Cl.
CPC ..... *G03G 15/1665* (2013.01)

(58) Field of Classification Search
CPC ..... G03G 15/1665
See application file for complete search history.

(56) References Cited

U.S. PATENT DOCUMENTS 9,835,987 B2 * 12/2017 Sugiura ..... G03G 15/162
2011/0229168 A1 9/2011 Shiraishi et al.
(Continued)

FOREIGN PATENT DOCUMENTS

JP 2013-127592 6/2013
JP 2013-137501 7/2013
(Continued)

OTHER PUBLICATIONS

U.S. Appl. No. 15/427,735, filed Feb. 8, 2017.
U.S. Appl. No. 15/432,392, filed Feb. 14, 2017.

*Primary Examiner* — G. M. Hyder
*Assistant Examiner* — Michael Harrison
(74) *Attorney, Agent, or Firm* — Oblon, McClelland, Maier & Neustadt, L.L.P.

(57) ABSTRACT

An image forming apparatus including an image bearer; a nip forming member, a nip width changing device, a power source; and a controller. The controller switches between a first mode and a second mode according to a predetermined condition. In the first mode, a duty of the transfer bias is a first duty and a width of a transfer nip is a first width. In the second mode, the duty of the transfer bias is a second duty lower than the first duty and the width of the transfer nip is a second width greater than the first width. The duty is (T−Tt)/T×100% where T denotes one cycle of the transfer bias, and Tt denotes a time period, in which the transfer bias is on a transfer-directional side relative to a time-averaged value of the transfer bias, in the one cycle.

20 Claims, 26 Drawing Sheets

(30) Foreign Application Priority Data

Feb. 14, 2017 (JP) ..... 2017-025074
Feb. 14, 2017 (JP) ..... 2017-025443

(56) References Cited

U.S. PATENT DOCUMENTS

2012/0045231 A1 2/2012 Ogino et al.
2012/0045259 A1 2/2012 Nakamura et al.
2012/0230715 A1 9/2012 Ogino et al.
2012/0243892 A1 9/2012 Nakamura et al.
2012/0328314 A1 12/2012 Sugimoto et al.
2013/0121714 A1 5/2013 Tanaka et al.
2013/0136468 A1 5/2013 Shimizu et al.
2013/0136477 A1 5/2013 Ogiyama et al.
2013/0142531 A1 6/2013 Sugimoto et al.
2013/0308968 A1 11/2013 Shinya Tanaka et al.
2014/0010562 A1 1/2014 Tanaka et al.
2014/0079418 A1 3/2014 Tanaka et al.
2014/0241744 A1 8/2014 Ichikawa et al.
2015/0212453 A1 7/2015 Tanaka
2015/0212454 A1 7/2015 Ichikawa et al.
2016/0109832 A1* 4/2016 Ohsugi ..... G03G 15/162 399/314
2016/0161887 A1 6/2016 Sugiura et al.
2016/0161888 A1* 6/2016 Wada ..... G03G 15/1665 399/66
2016/0246218 A1 8/2016 Tanaka
2016/0274504 A1 9/2016 Wada et al.
2016/0334739 A1 11/2016 Ohsugi et al.
2017/0299994 A1* 10/2017 Nagata ..... G03G 15/5037
2017/0300000 A1* 10/2017 Nakamura ..... G03G 15/80

FOREIGN PATENT DOCUMENTS

JP 2014-077981 5/2014
JP 2014-081608 5/2014
JP 2016-080826 5/2016

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application No. 2016-081550, filed on Apr. 14, 2016, Japanese Patent Application No. 2016-081456, filed on Apr. 14, 2016, Japanese Patent Application No. 2017-025443, filed on Feb. 14, 2017, and Japanese Patent Application No. 2017-025074, filed on Feb. 14, 2017 in the Japan Patent Office, the entire disclosures of which are hereby incorporated by reference herein.

BACKGROUND

Technical Field

Exemplary aspects of the present disclosure generally relate to an image forming apparatus, such as a copier, a facsimile machine, a printer, or a multi-functional system including a combination thereof.

Related Art

Typical image forming apparatuses output a transfer bias, in which an alternating current (AC) voltage as an AC component is superimposed on a direct current (DC) voltage as a DC component, to a transfer nip formed by an image bearer contacting a nip forming member, thereby transferring a toner image from the image bearer onto a recording sheet disposed in the transfer nip. Such a configuration might cause transfer failure depending on the unevenness of the recording sheet or a desired image density. To prevent such a transfer failure, a technique for controlling the transfer bias is known that controls a transfer current applied to toner of a toner image.

SUMMARY

In an aspect of this disclosure, there is provided an improved image forming apparatus including an image bearer, a nip forming member to form a transfer nip between the image bearer and the nip forming member, a nip width changing device to change a width of the transfer nip, a power source, and a controller. The power source outputs a transfer bias including an alternating-current (AC) component to transfer a toner image from the image bearer to a recording sheet in the transfer nip. The controller switches between a first mode and a second mode according to a predetermined condition. In the first mode, a duty of the transfer bias is a first duty and a width of the transfer nip is a first width. In the second mode, the duty of the transfer bias is a second duty lower than the first duty and the width of the transfer nip is a second width greater than the first width. The duty is (T−Tt)/T×100% where T denotes one cycle of the transfer bias, and Tt denotes a time period, in which the transfer bias is on a transfer-directional side to move the toner image from the image bearer to the recording sheet relative to a time-averaged value of the transfer bias, in the one cycle.

In another aspect of this disclosure, there is provided an improved transfer method including transferring a toner image from an image bearer to a recording sheet by a transfer bias having a duty of greater than 50% in the transfer nip, to which a first pressure is applied, when the recording sheet corresponds to a plain sheet, and transferring the toner image from the image bearer to the recording sheet by the transfer bias having the duty of less than 50% in the transfer nip, to which a second pressure greater than the first pressure is applied, when the recording sheet corresponds to an uneven sheet having greater unevenness than the plain sheet. The duty is (T−Tt)/T×100% where T denotes one cycle of the transfer bias, and Tt denotes a time period, in which the transfer bias is on a transfer-directional side to move the toner image from the image bearer to the recording sheet relative to a time-averaged value of the transfer bias, in the one cycle.

In even another aspect of this disclosure, there is provided improved image forming apparatus including an image bearer; a drive source to drive the image bearer; a nip forming member to form a transfer nip between the image bearer and the nip forming member; a power source; and a controller. The power source outputs a transfer bias including an alternating-current (AC) component to transfer a toner image from the image bearer to a recording sheet in the transfer nip. The controller to switch a mode between a first mode and a second mode according to a predetermined condition. In the first mode, a duty of the transfer bias is a first duty and a linear velocity of the image bearer is a first linear velocity. In the second mode, the duty of the transfer bias is a second duty lower than the first duty and the linear velocity of the image bearer is a second linear velocity lower than the first linear velocity. The duty is (T−Tt)/T×100% where T denotes one cycle of the transfer bias, and Tt denotes a time period, in which the transfer bias is on a transfer-directional side to move the toner image from the image bearer to the recording sheet relative to a time-averaged value of the transfer bias, in the one cycle.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
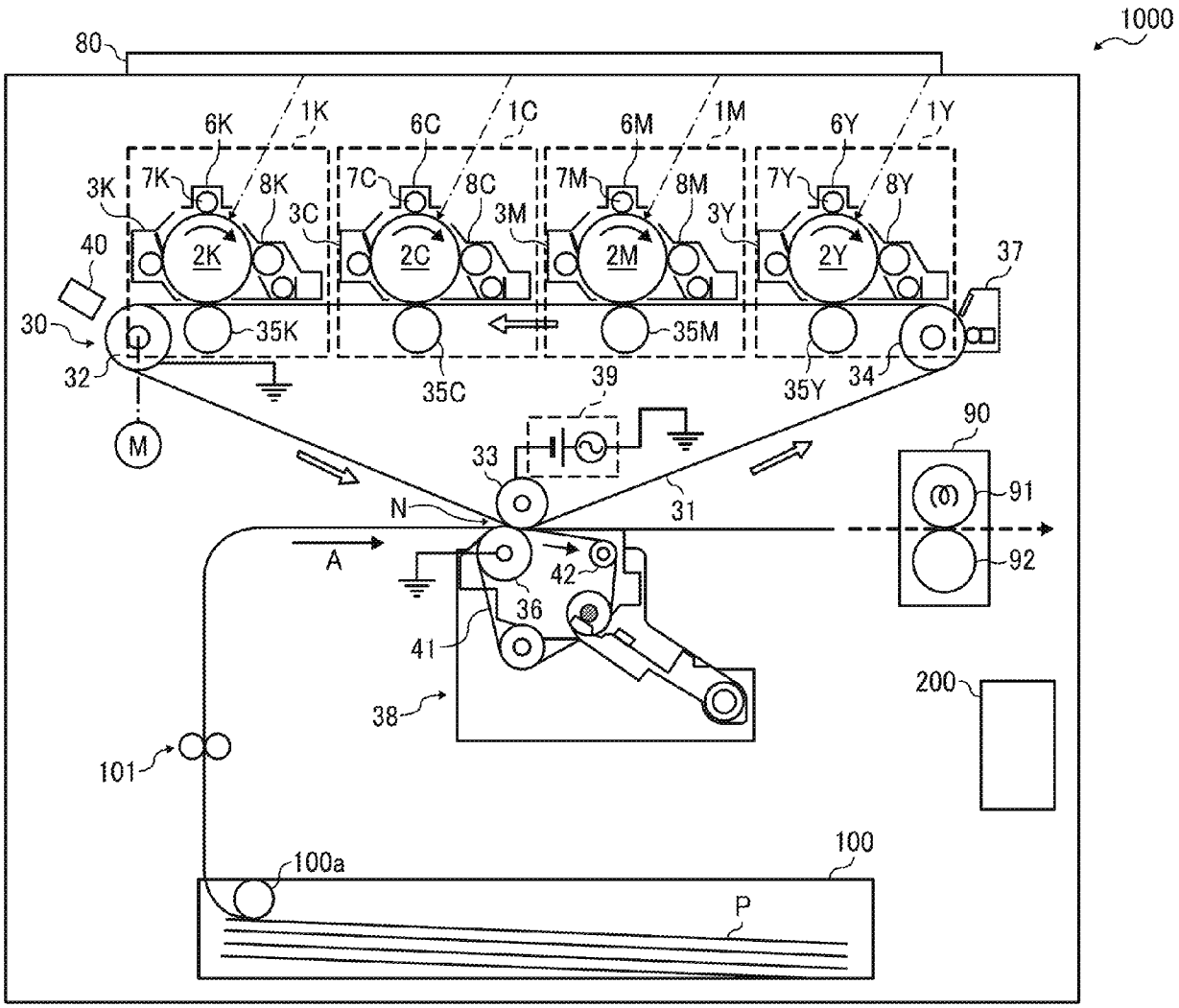
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given below of embodiments, variations, and examples of the present disclosure are described referring to drawings. In the embodiments, variations, and examples, the same reference numerals are given to components having the same functions and configuration, and the descriptions thereof are omitted as needed. In some Figures, portions of configurations are partially omitted to better understand the configurations. The common description between the embodiments is also omitted as appropriate, or the same description is sometimes given in common between the embodiments.

To change the amount of transfer current applied to a recording sheet in the transfer nip, the linear speed of the recording sheet may be changed, instead of changing the transfer nip width. For example, increasing the transfer nip width reduces the linear speed of the recording sheet, thereby increasing the time period in which the recording sheet passes through the transfer nip. By contrast, reducing the transfer nip width increases the linear speed of the recording sheet, thereby reducing the timer period in which the recording sheet passes through the transfer nip. This can also change the amount of transfer current applied to the recording sheet in the transfer nip. With the reduction in linear speed of the recording sheet, a favorable image quality can be achieved, but the number of printed sheets per unit time, i.e., productivity decreases. According to the present embodiment, the transfer pressure (the transfer nip width) is preferably changed to prevent the decrease in productivity. However, the linear speed of the recording sheet is not limited to a certain specified value, and the linear speed of the recording sheet may be changed according to a predetermined condition.

A description is first given of a schematic configuration of the image forming apparatus 1000, and a description of a typical transfer bias follows thereafter. Then, embodiments of the present disclosure are sequentially described.

—Schematic Configuration—

FIG. 1 is a schematic view of a configuration of a color printer as an of an electrophotographic image forming apparatus 1000 (hereinafter, referred to simply as "image forming apparatus") according to an embodiment of the present disclosure. The image forming apparatus 1000 according to the present disclosure is not limited to printers and may be, for example, copiers, facsimile machines, and multifunction peripherals having functions of the copiers and facsimile machines.

As illustrated in FIG. 1, the image forming apparatus 1000 includes four toner image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is described. The image forming apparatus 1000 also includes a transfer unit 30, an optical writing unit 80, a fixing device 90, a feed tray 100, a pair of registration rollers 101, and a controller 200. The toner image forming units 1Y, 1M, 1C, and 1K are held in a housing so that the toner image forming units 1Y, 1M, 1C, and 1K are detachably installable and replaceable in a maintenance process, thereby constituting a process cartridge.

The toner image forming units 1Y, 1M, 1C, and 1K have the same configuration, except for employing different color toners of yellow, magenta, cyan, and black. The toner image forming units 1Y, 1M, 1C, and 1K are replaced upon reaching their product life cycles. The toner image forming units 1Y, 1M, 1C, and 1K has the configuration to form a toner image through the electrophotographic process. That is, the toner image forming units 1Y, 1M, 1C, and 1K include drum-shaped photoconductors 2Y, 2M, 2C, and 2K as a latent-image bearer, photoconductor cleaners 3Y, 3M, 3C, and 3K, a static eliminator, charging devices 6Y, 6M, 6C, and 6K, and developing devices 8Y, 8M, 8C, and 8K.

The photoconductors 2Y, 2M, 2C, and 2K each includes a drum-shaped base on which an organic photosensitive layer is disposed. The photoconductors 2Y, 2M, 2C, and 2K each is rotated in a clockwise direction by a drive device. The charging devices 6Y, 6M, 6C, and 6K include charging rollers 7Y, 7M, 7C, and 7K to which a charging bias is applied. The charging rollers 7Y, 7M, 7C, and 7K contacts or approaches the photoconductors 2Y, 2M, 2C, and 2K to generate an electrical discharge therebetween, thereby charging uniformly the surface of the photoconductors 2Y, 2M, 2C, and 2K. According to the present embodiment, the photoconductors 2Y, 2M, 2C, and 2K each is uniformly charged negatively, which is the same polarity as that of normally-charged toner. As a charging bias, a voltage, in which an alternating current (AC) voltage is superimposed on a direct current (DC) voltage, is employed. According to the present embodiment, the photoconductors 2Y, 2M, 2C, and 2K are charged by the charging rollers 7Y, 7M, 7C, and 7K contacting the photoconductors 2Y, 2M, 2C, and 2K or disposed near the photoconductors 2Y, 2M, 2C, and 2K. Alternatively, a corona charger may be employed.

Based on image information provided by an external device, such as a personal computer (PC), the optical writing unit 80 illuminates the photoconductors 2Y, 2M, 2C, and 2K with the laser beams for the colors emitted from a laser diode as an example of a light source. On the uniformly charged surfaces of the photoconductors 2Y, 2M, 2C, and 2K, electrostatic latent images for the colors are formed, respectively. The optical writing unit 80 includes a polygon mirror, a plurality of optical lenses, and mirrors. The light beams L for the respective colors emitted from the laser diode serving as a light source is deflected in a main scanning direction by the polygon mirror rotated by a polygon motor. The deflected light, then, strikes the optical lenses and mirrors, thereby scanning the photoconductors 2Y, 2M, 2C, and 2K. Alternatively, the optical writing unit 80 may employ a light source using an LED array including a plurality of LEDs that projects light.

The electrostatic latent images for yellow, magenta, cyan, and black on the photoconductors 2Y, 2M, 2C, and 2K are developed with respective color toner powders as developer into color toner images by the developing devices 8Y, 8M, 8C, and 8K in the developing process.

After the developing process, the image forming apparatus 1000 primarily transfers the toner images from the photoconductors 2Y, 2M, 2C, and 2K onto an intermediate transfer belt 31 as an image bearer or an intermediate transferor in the primary transfer process.

The photoconductor cleaners 3Y, 3M, 3C, and 3K remove residual toner remaining on the surface of the photoconductors 2Y, 2M, 2C, and 2K after a primary transfer process, that is, after the photoconductors 2Y, 2M, 2C, and 2K pass through a primary transfer nip between the intermediate transfer belt 31 and the photoconductors 2Y, 2M, 2C, and 2K. The static eliminator removes residual charge remaining on the photoconductors 2Y, 2M, 2C, and 2K after the surface thereof is cleaned by the photoconductor cleaners 3Y, 3M, 3C, and 3K. Accordingly, the surfaces of the photoconductors 2Y, 2M, 2C, and 2K are initialized in preparation for the subsequent imaging cycle.

Referring back to FIG. 2, a description is provided of the transfer unit 30. The transfer unit 30 is disposed below the toner image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a plurality of rollers: a drive roller 32, a secondary-transfer first roller 33, a cleaning auxiliary roller 34, and four primary transfer rollers 35Y, 35M, 35C, and 35K (which may be referred to collectively as primary transfer rollers 35). The transfer unit 30 includes a belt cleaning device 37 and a density sensor 40.

The intermediate transfer belt 31 is entrained around and stretched taut between the plurality of rollers. i.e., the drive roller 32, the secondary-transfer first roller 33, the cleaning auxiliary roller 34, and the four primary transfer rollers 35Y, 35M, 35C, and 35K. The drive roller 32 is connected to a drive motor M as a drive source. The drive roller 32 is rotated in the counterclockwise direction by a motor or the like, and rotation of the driving roller 32 enables the intermediate transfer belt 31 to rotate in the same direction. The drive motor M is connected with the controller 200. The controller 200 controls the drive motor M to rotate at a predetermined speed, thereby driving the intermediate transfer belt 31 to rotate at a prescribed speed.

The intermediate transfer belt 31 is interposed between the photoconductors 2Y, 2M, 2C, and 2K, and the primary transfer rollers 35Y, 35M, 35C, and 35K. Accordingly, primary transfer nips are formed between the outer peripheral surface or the image bearing surface of the intermediate transfer belt 31 and the photoconductors 2Y, 2M, 2C, and 2K that contact the intermediate transfer belt 31. A primary-transfer bias power source applies a primary-transfer bias to the primary transfer rollers 35Y, 35M, 35C, and 35K at each primary-transfer timing. Accordingly, a transfer electric field is formed between the primary transfer rollers 35Y, 35M, 35C, and 35K, and the toner images of yellow, magenta, cyan, and black on the photoconductors 2Y, 2M, 2C, and 2K.

For example, the yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electrical field and the nip pressure. The intermediate transfer belt 31, on which the yellow toner image has been transferred, sequentially passes through the primary transfer nips of magenta, cyan, and black. Subsequently, the toner images on the photoconductors 2M, 2C, and 2K are superimposed on the yellow toner image that has been transferred on the intermediate transfer belt 31, one atop the other, thereby forming a composite toner image on the intermediate transfer belt 31 in the primary transfer process. After the primary-transfer process, the composite toner image, in which the toner images of yellow, magenta, cyan, and black are superimposed one atop the other, is formed on the surface of the intermediate transfer belt 31. According to the present embodiment described above, a roller-type transfer device (here, the primary transfer rollers 35) is used as a primary transfer device. Alternatively, a transfer charger or a brush-type transfer device may be employed as a primary transfer device.

A sheet conveyor unit 38, disposed substantially below the transfer unit 30, includes a secondary-transfer second roller 36 disposed opposite to the secondary-transfer first roller 33 via the intermediate transfer belt 31 and a sheet conveyance belt 41 (generally referred to as a secondary transfer belt or a secondary-transfer member). As illustrated in FIG. 1, the sheet conveyance belt 41 as a nip forming member is formed into an endless loop and looped around a plurality of rollers including the secondary-transfer second roller 36 and a separation roller 42. As the secondary-transfer second roller 36 is driven to rotate, the sheet conveyance belt 41 rotates in the clockwise direction in FIG. 1. The secondary-transfer second roller 36 contacts, via the sheet conveyance belt 41, a portion of the front surface or the image bearing surface of the intermediate transfer belt 31 looped around the secondary-transfer first roller 33, thereby forming a secondary transfer nip N therebetween.

That is, the intermediate transfer belt 31 and the sheet conveyance belt 41 are interposed between the secondary-transfer first roller 33 of the transfer unit 30 and the secondary-transfer second roller 36 of the sheet conveyor unit 38. Accordingly, the outer peripheral surface or the image bearing surface of the intermediate transfer belt 31 contacts the outer peripheral surface of the sheet conveyance belt 41 serving as the nip forming member, thereby forming the secondary transfer nip N.

The secondary-transfer second roller 36 disposed inside the loop of the sheet conveyance belt 41 is grounded; whereas, a secondary-transfer bias as a transfer bias is applied to the secondary-transfer first roller 33 disposed inside loop of the intermediate transfer belt 31 by a secondary-transfer power source 39 as a transfer power source. With this configuration, a transfer current flows between the secondary-transfer first roller 33 and the secondary-transfer second roller 36 to form a secondary-transfer electrical field in the secondary-transfer nip N. The formed secondary-transfer electrical field electrostatically transfers the toner having a negative polarity from the secondary-transfer first roller 33 to the secondary-transfer second roller 36. In the image forming apparatus 1000 according to the present embodiment, the transfer power source outputs a transfer bias to the transfer nip formed by the image bearer (the intermediate transfer belt 31) contacting the nip forming member (the sheet conveyance belt 41).

Alternatively, instead of the sheet conveyance belt 41, a secondary transfer roller may be employed as the nip forming device to contact directly the intermediate transfer belt 31.

Alternatively, a secondary-transfer power source 39 may apply a secondary transfer bias to the secondary-transfer first roller 33, and the secondary-transfer second roller 36 may be electrically grounded.

Figure 2:
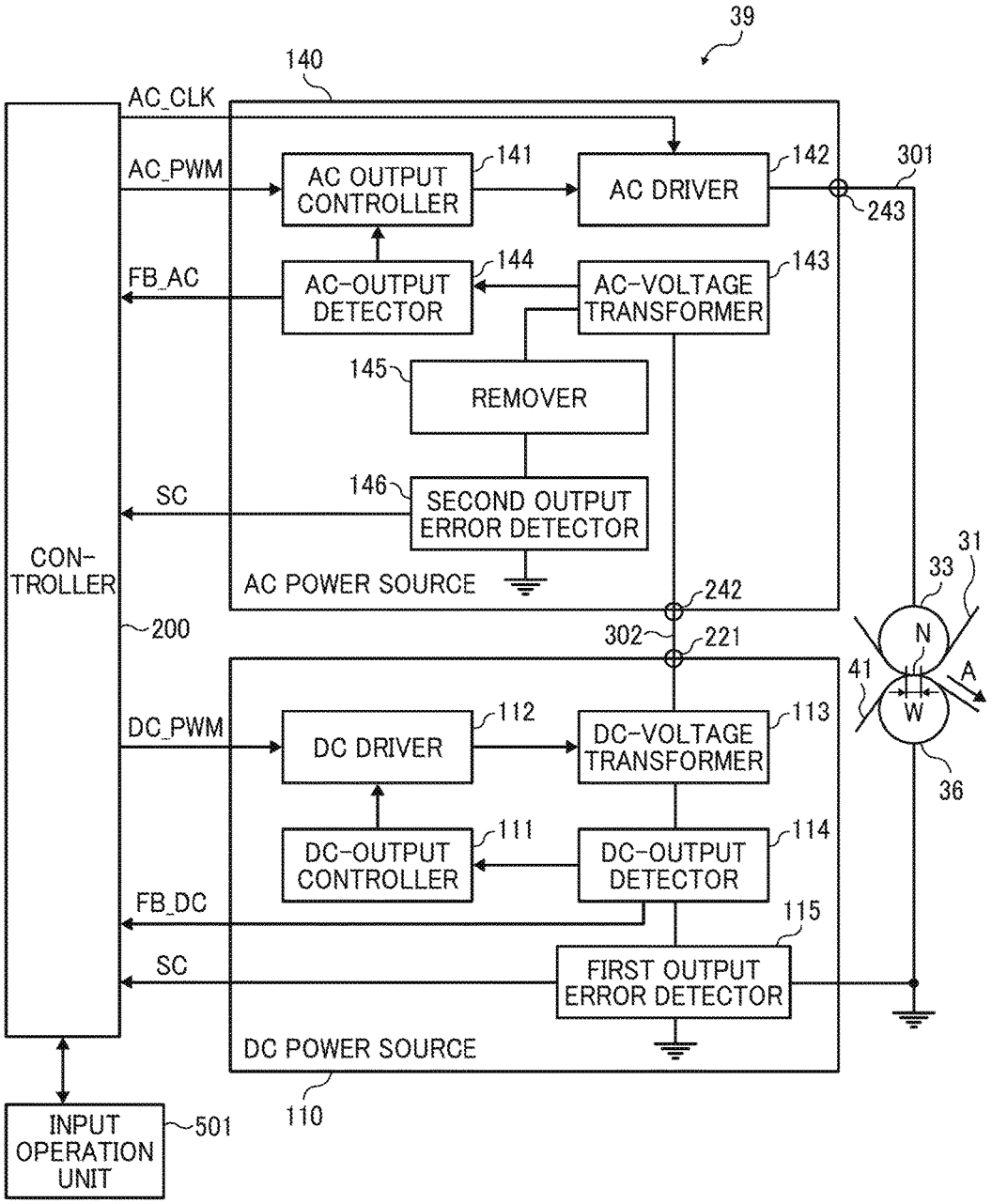
FIG. 2 is a block diagram of an electrical circuit of a secondary-transfer power source employed in the image forming apparatus of FIG. 1.

As illustrated in FIG. 2, the feed tray 100 storing a sheaf of recording sheets P is disposed below the transfer unit 30. The feed tray 100 is equipped with a feed roller 100*a* that contacts the top sheet of the sheaf of recording sheets P. As the feed roller 100*a* is rotated at a predetermined speed, the feed roller 100*a* picks up and sends the top sheet of the recording sheets P to a sheet delivery path. Substantially near the end of the sheet delivery path, the pair of registration rollers 101 is disposed. The pair of registration rollers 101 starts to rotate again to feed the recording sheet P, which has been fed from the feed tray 100, to the secondary transfer nip N in appropriate timing such that the recording sheet P is aligned with the composite toner image formed on the front surface of the intermediate transfer belt 31 in the secondary-transfer nip N.

In the secondary-transfer nip N, the recording sheet P tightly contacts the composite toner image on the intermediate transfer belt 31, and the composite toner image is secondarily transferred onto the recording sheet P by the secondary-transfer electric field formed by the secondary-transfer bias and the nip pressure applied thereto, thereby forming a full-color toner image on the recording sheet P. The recording sheet P, on which the full-color toner image is formed, passes through the secondary transfer nip N and separates from the intermediate transfer belt 31 due to self-stripping. Furthermore, the curvature of a separation roller 42, around which the sheet conveyance belt 41 is looped, enables the recording sheet P to separate from the sheet conveyance belt 41.

According to the present embodiment, the sheet conveyance belt 41 as the nip forming device contacts the intermediate transfer belt 31 to form the secondary transfer nip N. In addition, a nip forming roller may be used as the nip forming member. In this case, the surface of the nip forming roller contacts the intermediate transfer belt 31 to form the secondary-transfer nip.

After the intermediate transfer belt 31 passes through the secondary transfer nip N, the toner residue not having been transferred onto the recording sheet P remains on the intermediate transfer belt 31. The residual toner is removed from the front surface of the intermediate transfer belt 31 by the belt cleaning device 37 contacting the front surface of the intermediate transfer belt 31 in the cleaning process. In other words, the residual toner is removed from a portion opposed to the cleaning backup roller 34.

The image forming apparatus 1000 according to the present embodiment includes the density sensor 40 as a toner-density detector. The density sensor 40 is disposed outside the loop of the intermediate transfer belt 31, and faces a portion of the intermediate transfer belt 31 looped around the drive roller 32 with a predetermined gap between the density sensor 40 and the intermediate transfer belt 31. The density sensor 40 detects an amount of toner adhering to the toner image per unit area (image density) primarily transferred onto the intermediate transfer belt 31 when the toner image comes to the position opposite to the density sensor 40. The density sensor 40 sends the detection results to the controller 200 to determine whether the toner image is a solid image or a halftone image.

The fixing device 90 is disposed downstream from the secondary transfer nip N in the direction (indicated by arrow A in FIG. 1) of conveyance of the recording sheet P. The fixing device 90 includes a fixing roller 91 and a pressing roller 92. The fixing roller 91 includes a heat source inside the fixing roller 91. While rotating, the pressing roller 92 pressingly contacts the fixing roller 91, thereby forming a heated area called a fixing nip therebetween. In the fixing process, the recording sheet P having undergone the secondary-transfer process passes through the fixing nip. Then, toner in the toner image melts by the application of heat and pressure, so that a full-color image is fixed to the recording sheet P.

Subsequently, the recording sheet P having passed the fixing nip is output to the outside of the image forming apparatus 1000 from the fixing device 90 via a post-fixing delivery path after the fixing process.

According to the present embodiment, for forming a monochrome image, an orientation of a support plate supporting the primary transfer rollers 35Y, 35M, and 35C of the transfer unit 30 is changed by driving a solenoid or the like. With this configuration, the primary transfer rollers 35Y, 35M, and 35C are separated from the photoconductors 2Y, 2M, and 2C, thereby separating the outer peripheral surface or the image bearing surface of the intermediate transfer belt 31 from the photoconductors 2Y, 2M, and 2C. In a state in which the intermediate transfer belt 31 contacts only the photoconductor 2K, only the toner image forming unit 1K for black among four toner image forming units is driven to form a black toner image on the photoconductor 2K. It is to be noted that the present disclosure can be applied to both an image forming apparatus for forming a color image and a monochrome image forming apparatus for forming a single-color image.

[Configuration of Transfer Power Source]

Figure 5:
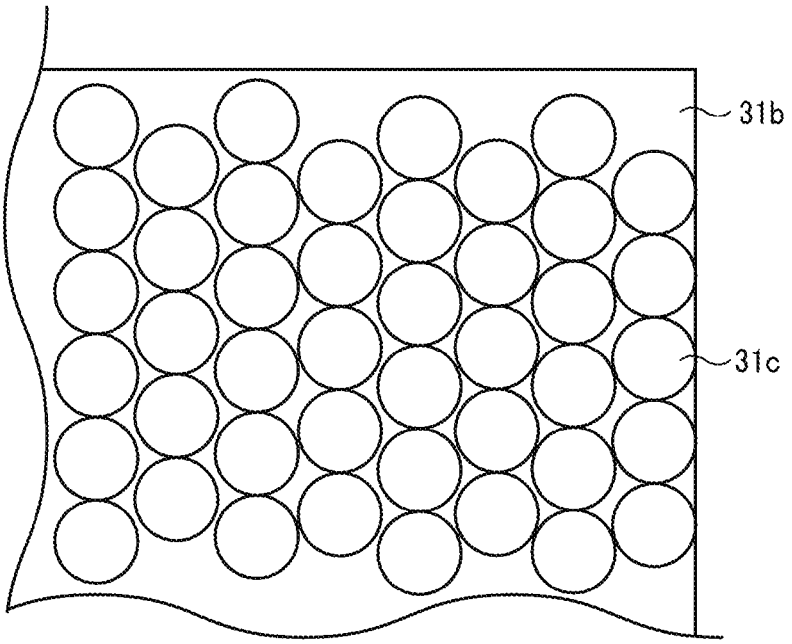
FIG. 5 is a plan view of a portion of the intermediate transfer belt according to an embodiment of the present disclosure.

FIG. 2 is a block diagram of a portion of an electrical circuit of a secondary-transfer power source, and the secondary-transfer first roller 33 and the secondary-transfer second roller 36 according to an embodiment of the present disclosure. As illustrated in FIG. 5, the secondary-transfer power source 39 a direct-current (DC) power source 110, and an alternating current (AC) power source 140. The AC power source 140 is detachably mountable relative to a maim body of the secondary-transfer power source 39. The controller 200 controls the secondary-transfer power source 39. The controller 200 also controls the operation of a nip width changing device 60.

The DC power source 110 outputs a DC voltage that is the DC component to apply an electrostatic force to toner on the intermediate transfer belt 31 so that the toner moves from the intermediate transfer belt 31 to the recording sheet P in the secondary-transfer nip N. The DC power source 110 includes a DC output controller 111, a DC driving device 112, a DC voltage transformer 113, a DC output detector 114, a first output error detector 115, and an electrical connector 221.

The AC power source 140 outputs the AC voltage that is an AC component to form an alternating electric field in the secondary transfer nip N. The AC power source 140 includes an AC output controller 141, an AC driving device 142, an AC voltage transformer 143, an AC output alternating current voltage 144, a remover 145, a second output error detector 146, and electrical connectors 242 and 243.

The controller 200 controls the DC power source 110 and the AC power source 140, and is equipped with a central processing unit (CPU), and a Read Only Memory (ROM). The controller 200 inputs a DC_PWM signal to the DC output controller 111. The DC_PWM signal controls an output level of the DC voltage. Furthermore, an output value of the DC voltage transformer 113 detected by the DC output detector 114 is provided to the DC output controller 111. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal. The DC_PWM signal controls an output level of the DC voltage.

The DC drive device 112 drives the DC voltage transformer 113 in accordance with the instruction from the DC output controller 111. The DC driving device 112 drives the DC voltage transformer 113 to output a DC high voltage having a negative polarity. In a case in which the AC power source 140 is not connected, the electrical connector 221 and the secondary-transfer first roller 33 are electrically connected by a harness 301 so that the DC voltage transformer 113 outputs (applies) a DC voltage to the secondary-transfer first roller 33 via the harness 301. In a case in which the AC power source 140 is connected, the electrical connector 221 and the electrical connector 242 are electrically connected by a harness 302 so that the DC voltage transformer 113 outputs a DC voltage to the AC power source 140 via the harness 302.

The DC output detector 114 detects and outputs an output value of the DC high voltage from the DC voltage transformer 113 to the DC output controller 111. The DC output detector 114 outputs the detected output value as a FB_DC signal (feedback signal) to the controller 200 so that the controller 200 controls the duty of the DC_PWM signal to prevent the reduction in transferability due to environment and load.

Thus, an impedance in the output path of the high voltage output is different between when the AC power source 140 is connected and when the AC power source 140 is not connected because the AC power source 140 is detachable relative to the body of secondary-transfer power source 39. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value.

According to the present embodiment, the DC power source 110 is under constant-current control. Alternatively, in some embodiments, the DC power source 110 can be under constant voltage control as long as the high voltage to be applied to the secondary-transfer bias roller 68 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage. With this configuration, the controller 200 stops the DC power source 110 to output the high voltage.

The controller 200 inputs an AC_PWM signal and an output value of the AC voltage transformer 143 detected by the AC output detector 144. The AC_PWM signal controls an output value of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal. The AC_PWM signal controls an output level of the AC voltage. Based on the duty ratio of the input AC_PWM signal and the output value of the AC voltage transformer 143, the AC output controller 141 controls the AC voltage transformer 143 via the AC drive device 142 to adjust the output value of the AC voltage transformer 143 to an output value instructed by the AC_PWM signal.

An AC_CLK signal to control the output frequency of the AC voltage is input to the AC drive device 142. The AC driving device 142 drives the AC voltage transformer 143 in accordance with the instruction from the AC output controller 141 and the AC_CLK signal. As the AC drive device 142 drives the AC voltage transformer 143 in accordance with the AC_CLK signal, the output waveform generated by the AC voltage transformer 143 is adjusted to a desired frequency instructed by the AC_CLK signal.

The AC drive device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer first roller 33 are electrically connected by the harness 301, the AC voltage transformer 143 outputs (applies) the thus-obtained superimposed voltage to the secondary-transfer first roller 33 via the harness 301. In a case in which the AC voltage transformer 143 does not generate the AC voltage, the AC voltage transformer 143 outputs (applies) the DC high voltage output from the DC voltage transformer 113 to the secondary-transfer first roller 33 via the harness 301. Subsequently, the voltage (the superimposed voltage or the DC voltage) output to the secondary-transfer first roller 33 returns to the DC power source 110 via the secondary-transfer second roller 36.

The AC output detector 144 detects and outputs an output value of the AC voltage from the AC voltage transformer 143 to the AC output controller 141. The AC output detector 144 outputs the detected output value as a FB_AC signal (feedback signal) to the controller 200 to control the duty of the AC_PWM signal in the controller 200 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC power source 140) may be a sine wave, a square wave, or another type of waveform. In the present embodiment, the waveform of the AC voltage is a short-pulse square wave. The AC voltage having a short-pulse square wave enhances image quality.

Note that the secondary-transfer power source 39 outputs the DC voltage under the constant current control to adjust the output voltage value so that the output current value coincides with a predetermined target current value. Further, the secondary-transfer power source 39 outputs the AC voltage under the constant voltage control to adjust the amplitude of the AC voltage so that the peak-to-peak value Vpp of the AC component of the secondary-transfer bias coincides with a predetermined target value.

A device is known that applies a superimposed voltage as the secondary-transfer bias to the secondary-transfer nip N to form the alternating electrical field, which allows for a successful secondary transfer of toner onto recesses on the surface of the recording sheet having uneven surface. The entire disclosure of US2014079418A1 is hereby incorporated by reference herein. The principle is as follows: In the secondary transfer nip, the secondary-transfer bias including only the DC bias merely transfers a small amount of toner particles of toner forming a toner image from the surface of the intermediate transfer belt onto the recesses of the surface of the recording sheet. Similarly, the secondary-transfer bias including the superimposed voltage merely transfers a small amount of toner particles onto the recesses of the surface of the recording sheet during a time period from a time when a toner image enters the secondary-transfer nip to a time when an initial cycle of the alternating current (AC) component of the secondary-transfer bias ends. However, when another cycle (second cycle) following the initial cycle of the alternating current component ends, the amount of toner particles that transfers from the surface of the secondary transfer belt onto the recesses of the surface of the recording sheet increases.

More specifically, in the first half of another cycle following the initial cycle, the toner particles moving from the recesses back to the surface of the secondary transfer belt collide with toner particle remaining on the surface of the secondary transfer belt, thereby reducing the adhesive force between the toner particles remaining on the surface and the other toner particles or the surface of the secondary transfer belt. In the second half of the cycle following the initial cycle, the toner particles having reduced the adhesive force as described above is caused to transfer from the surface of the secondary transfer belt onto the recesses of the surface of the recording sheet together with the toner particles having returned to the surface of the secondary transfer belt.

In still another cycle following the second cycle of the alternating current component as well, the similar phenomenon occurs, thereby further increasing the amount of toner particles to be transferred onto the recesses of the surface of the recording sheet. With repetitive reciprocation of the toner particles between the surface of the secondary transfer belt and the recesses of the surface of the recording sheet in the secondary-transfer nip, the amount of toner particles to be transferred onto the recesses of the surface of the recording sheet gradually increases. When the trail end of the toner image exits the secondary-transfer nip, a sufficient amount of toner particles has been transferred into the recesses of the surface of the recording sheet.

The controller 200 controls the driving operations of various drive devices in the image forming apparatus 1000, receives the detection results of each sensor, and performs calculation. The controller 200 also controls the toner image forming units 1Y, 1M, 1C, and 1K, the optical writing unit 80, and and the drive motor M of the intermediate transfer belt 31.

Next, a description is provided of a characteristic configuration of the image forming apparatus 1000 according to the present embodiment.

Figure 3:
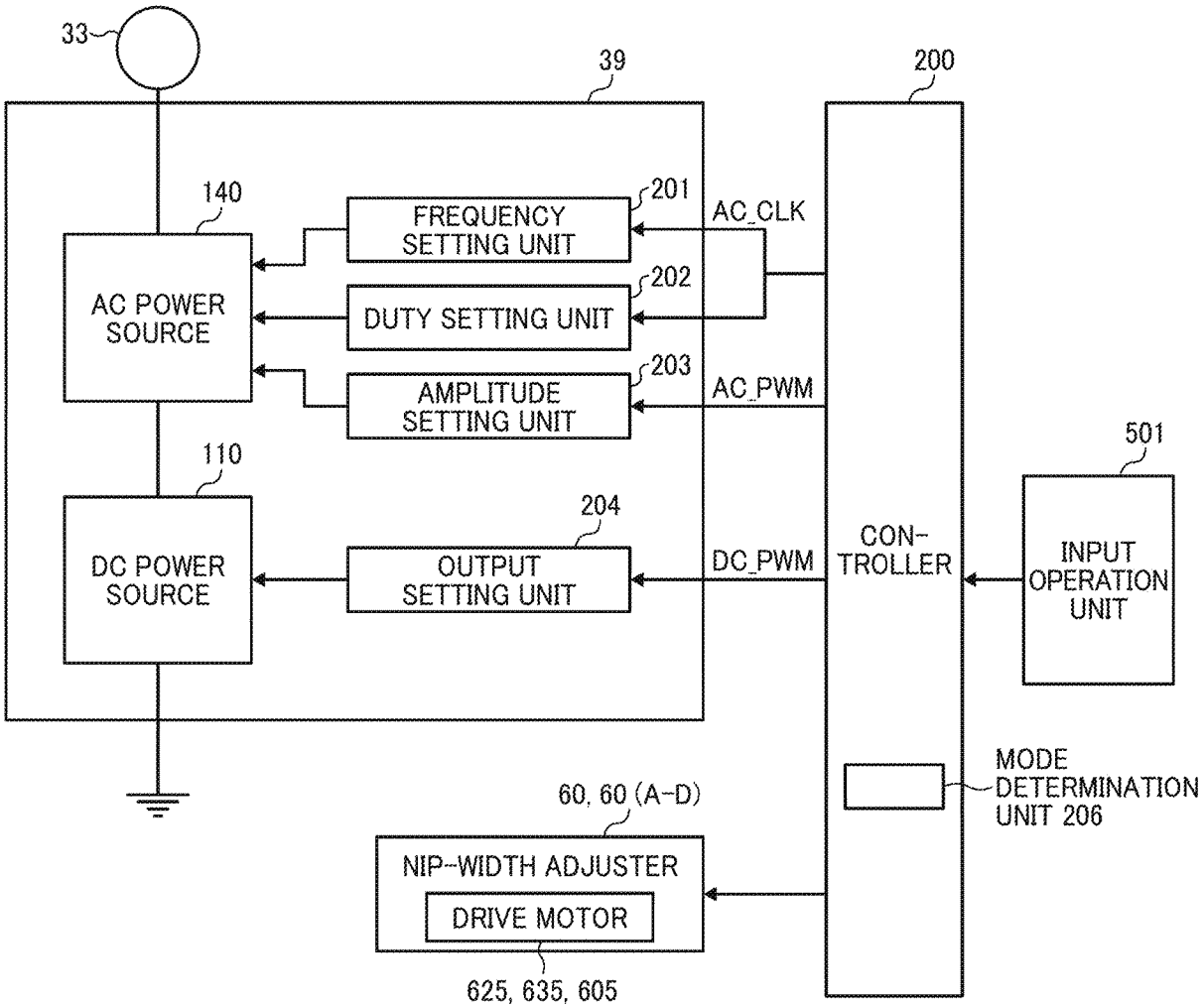
FIG. 3 is a block diagram of a schematic configuration of controller in the image forming apparatus of FIG. 1.

FIG. 3 is a functional block diagram of a schematic configuration of a controller in the image forming apparatus 1000 including the secondary-transfer power source 39 of FIG. 2.

The image forming apparatus 1000 includes a controller 200. The controller 200 outputs, based on information input to the controller 200, signals to control the operation of the units connected to the output of the controller 200. In the present embodiment, the controller 200 is connected with the secondary-transfer power source 39 via a signal line to control the output of the secondary-transfer power source 39. The controller 200 is connected with the nip width changing device 60 to control the operation of the nip width changing device 60.

The secondary-transfer power source 39 applies voltage, in which the AC voltage is superimposed on the DC voltage, to the secondary-transfer nip N to secondarily transfer a toner image from the intermediate transfer belt 31 onto a recording sheet P in the secondary-transfer nip N. The secondary-transfer power source 39 outputs a secondary-transfer bias, in which the AC voltage generated by the AC power source 140 is superimposed on the DC voltage generated by the DC power source 110, to the secondary-transfer first roller 33.

The controller 200 is connected with the DC power source 110 via a signal line, and is also connected with the AC power source via a signal line. The image forming apparatus 1000 includes a frequency setting unit 201, a duty setting unit 202, an amplitude setting unit 203, and an output setting unit 204. The frequency setting unit 201, the duty setting unit 202, and the amplitude setting unit 203 are connected with the AC power source 140 via signal lines. The output setting unit 204 is connected with the DC power source 110 via a signal line.

The frequency setting unit 201 changes the frequency of the AC component output from the AC power source 140. The duty setting unit 202 changes duty of the voltage (transfer-directional voltage) in the direction to transfer toner onto a recording sheet P within a range of 0 through 100%. The controller 200 controls the frequency setting unit 201 and the duty setting unit 202 in accordance with the AC_CLK signal of FIG. 2.

The amplitude setting unit 203 determines the maximum voltage difference (peak-to-peak value Vpp) of the AC voltage output from the AC power source 140. The controller 200 controls the amplitude setting unit 203 in accordance with the AC_PWM.

The output setting unit 204 determines a constant voltage of the DC voltage generated by the DC power source 110 according to the type (smooth sheet or uneven sheet) of the recording sheet P or the image density. The controller 200 controls the output setting unit 204 in accordance with the DC_PWM signal of FIG. 2.

The frequency setting unit 201, the duty setting unit 202, the amplitude setting unit 203, and the output setting unit 204 may be included in the secondary-transfer power source 39. Alternatively, the controller 200 may include the frequency setting unit 201, the duty setting unit 202, the amplitude setting unit 203, and the output setting unit 204, which are disposed separately from the secondary-transfer power source 39. A description is provided of the detailed control operation of the controller 200 below.

A typical intermediate transfer belt includes only a belt base made of hard material, such as a polyimide belt. For example, an image forming apparatus described in US2014077981 drives such an intermediate transfer belt to travel at a linear velocity of 280 [mm/s] to form an image at a speed of image formation for general users. The entire enclosure of which is incorporated by reference. To achieve image formation at an ultra-high speed for business users, the present inventors have performed the following tests in the configuration with the intermediate transfer belt including only the belt base made of hard material in combination with the secondary-transfer bias including the superimposed voltage. That is, in the tests, a test image is secondarily transferred on to an uneven-surface sheet ("LEATHAC 66" (registered trademark) manufactured by TOKUSHU TOKAI PAPER CO., LTD.) while the intermediate transfer belt 31 endlessly moves at an extremely-high linear velocity of 630 mm/s. As a result, toner fails to be secondarily transferred onto the recesses of the surface of the recording sheet having an uneven surface, thus causing uneven image density due to the surface unevenness of the sheet even though the secondary-transfer bias including the superimposed voltage is adopted. Thus, in an attempt to form an image at an ultra-high speed for business users using the intermediate transfer belt including only the belt base made of the hard material, transfer failure of toner occurs in the recesses of the uneven surface of the recording sheet even when the secondary-transfer bias including the superimposed voltage is applied to form an alternating electrical field in the secondary-transfer nip.

For this reason, the present inventors has performed the tests to secondarily transfer an image onto the sheet having an uneven-surface sheet ("LEATHAC 66") at an ultra-high speed (process linear speed of 630 mm/s) for business users, using the printer test machine including an elastic belt as the intermediate transfer belt. This allows toner to be secondarily transferred onto the recesses of the uneven surface sheet, thereby reducing the occurrence of the unevenness in image density depending on the surface unevenness of the sheet. This is considered to be because the elastic layer of the intermediate transfer belt 31 that is the elastic belt is easily deformed within the secondary-transfer nip N, thereby reducing the distance between the surface of the intermediate transfer belt 31 and the recesses of the sheet having an uneven surface.

That is, an elastic belt is more preferably used as the intermediate transfer belt 31. In the present embodiment, the image forming apparatus 1000 includes an elastic belt.

Figure 4:
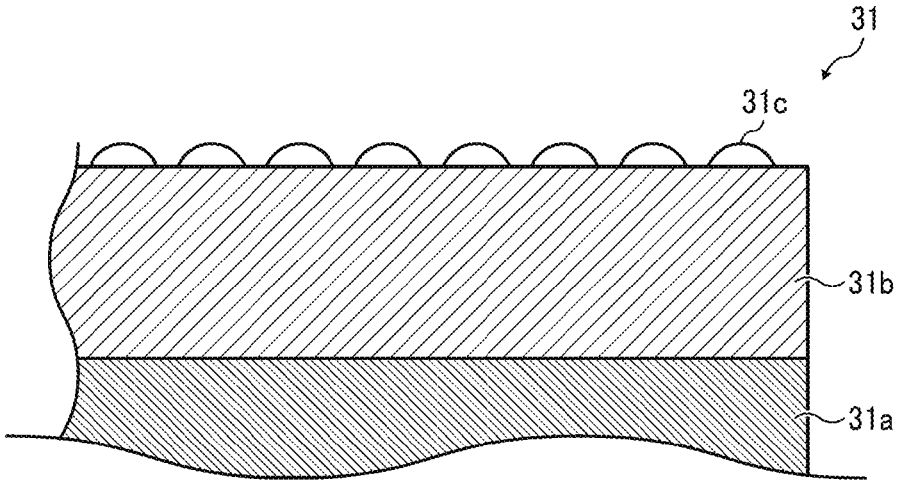
FIG. 4 is a cross-sectional view of a portion of an intermediate transfer belt as an image bearer of the image forming apparatus of FIG. 1.

FIG. 4 is a partially enlarged cross-sectional view of a transverse plane of the intermediate transfer belt 31 made of an elastic belt mounted on the image forming apparatus according the present embodiment. The intermediate transfer belt 31 includes a base layer 31*a* (belt base layer made of hard material) and an elastic layer 31*b*. The base layer 31*a* formed into an endless looped belt is formed of a material having a high stiffness, but having some flexibility. The elastic layer 31*b* disposed on the front surface of the base layer 31*a* is formed of an elastic material with high elasticity. Particles 31*c* are dispersed in the elastic layer 31*b* that is an elastic surface layer. While a portion of the particles 31*c* projects from the elastic layer 31*b*, the particles 31*c* are arranged concentratedly in a belt surface direction as illustrated in FIG. 4. With these particles 31*c*, an uneven surface of the belt with a plurality of bumps is formed on the intermediate transfer belt 31. Thus, the intermediate transfer belt 31 includes an elastic surface layer as the elastic layer 31*b* having a plurality of fine projections made of a plurality of fine particles dispersed in a material of the elastic surface layer.

Examples of materials for the base layer 31*a* include, but are not limited to, a resin in which an electrical resistance adjusting material made of a filler or an additive is dispersed to adjust electrical resistance. Examples of the resin constituting the base layer 31*a* include, but are not limited to, fluorine-based resins such as ethylene tetrafluoroethylene copolymers (ETFE) and polyvinylidene fluoride (PVDF) in terms of flame retardancy, and polyimide resins or polyamide-imide resins. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, and alkylbenzene sulfonate. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 310, as needed. The coating solution is a liquid resin before curing in which electrical resistance adjusting materials are dispersed. An amount of the electrical resistance adjusting materials to be dispersed in the base layer 31*a* of a seamless belt, i.e., the intermediate transfer belt 31 is preferably in a range from 1×108 to 1×1013 Ω/sq in surface resistivity, and in a range from 1×106 to 1012 Ω·cm in volume resistivity.

The thickness of the base layer 31*a* is not limited to a particular thickness and can be selected as needed. The thickness of the base layer 31*a* is preferably in a range from 30 μm to 150 μm, more preferably in a range from 40 μm to 120 μm, even more preferably, in a range from 50 μm to 80 μm.

As described above, the elastic layer 31*b* of the intermediate transfer belt 31 includes a plurality of raised portions with the particles 31*c* dispersed in the elastic layer 31*b*. Examples of elastic materials for the elastic layer 31*b* include, but are not limited to, generally-used resins, elastomers, and rubbers. Preferably, elastic materials having good elasticity such as elastomer materials and rubber materials are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Alternatively, thermoplastic elastomer, such as fluorine-based copolymer thermoplastic elastomer, may be employed. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, and acrylic rubbers. Examples of rubber materials include, but are not limited to, chlorosulfonated polyethylenes, fluorocarbon rubbers, urethane rubbers, and hydrin rubbers. A material having desired characteristics can be selected from the above-described materials.

In terms of ozone resistance, softness, adhesion properties relative to the particles, application of flame retardancy, environmental stability, and so forth, acrylic rubbers are most preferable among elastic materials for forming the elastic layer 311. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents.

In order to enhance a cross-linking reaction, a crosslinking promoter may be mixed in the acrylic rubber employed for the elastic layer 31*b*. The type of crosslinking promoter is not limited particularly. However, it is preferable that the crosslinking promoter can be used with the above-described multivalent amine crosslinking agents.

Preferably, electrical resistance adjusting material is added to the acrylic rubber used for the elastic layer 31*b*. The electrical resistance adjusting material to be added is in such an amount that the surface resistivity of the elastic layer 31*b* is, preferably, in a range from 1×108 Ω/sq to 1×1013 Ω/sq, and the volume resistivity of the elastic layer 311 is, preferably, in a range from 1×106 Ω·cm to 1×1012 Ω·cm. The layer thickness of the elastic layer 31*b* is, preferably, in a range from 200 μm to 2 mm, more preferably, 400 μm to 1000 μm.

The particle 31*c* to be dispersed in the elastic material of the elastic layer 31*b* is a spherical resin particle having an average particle diameter of equal to or less than 100 μm and is insoluble in an organic solvent. Furthermore, the 3% thermal decomposition temperature of these resin particles is equal to or greater than 200° C. The resin material of the particle 31*c* is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous. In some embodiments, a belt without the particles 31*c* dispersed in the elastic layer 31*b* can be used as the intermediate transfer belt 31.

As illustrated in FIG. 5, no particles 31*c* overlapping each other are observed on the surface of the intermediate transfer belt 31. Preferably, the cross-sectional diameters of the plurality of particles 31*c* in the surface of the elastic layer 31*b* are as uniform as possible. More specifically, the distribution width thereof is preferably equal to or less than±(Average particle diameter×0.5 μm). For this reason, preferably, powder including particles with a small particle diameter distribution is used as the particles. If the particles 31*c* having a specific particle diameter can be selectively localized in the elastic layer 31*b*, power including particles with a large particle diameter distribution may be used.

The type of paper having an uneven surface, such as Japanese paper called "Washi" is used as the recording sheet P. When paper having an uneven surface, such as Japanese paper called "Washi" is used as a recording sheet P, an elastic layer 31*b* having good elasticity is used to successfully secondarily transfer toner onto recessed portions of the recording sheet P, which prevents uneven image density due to the uneven surface. However, such an elastic layer 31*b* is not practical because the elastic layer 31*b* easily elongates after being stretched out. This is because, the elastic layer 31*b* includes a base layer 31*a* having more rigidity than the elastic layer 31*b*, which suppresses the elongation of the entire belt over a long time period.

As described above, the image forming apparatus 1000 according to the present embodiment employs the intermediate transfer belt 31 that is an elastic belt including the base layer 31*a* and the elastic layer 31*b* laminated on the base layer 31*a*. This allows for a successful secondary transfer of a sufficient amount of toner into the recesses of the recording sheet having an uneven surface, thus effectively preventing the occurrence of the uneven image density due to the uneven surface of the sheet even at the ultra-high speed (process linear velocity of 630 mm/s) for business users.

Figure 6:
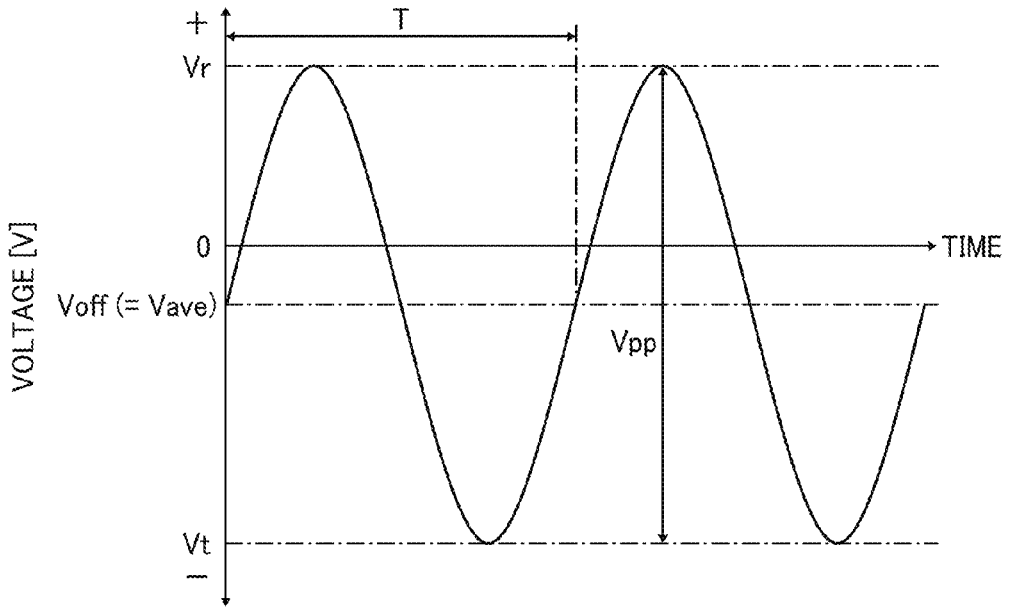
FIG. 6 is a graph of a waveform of a secondary-transfer bias including a superimposed voltage with an opposite-peak duty of 50% according to an embodiment of the present disclosure.

FIG. 6 is a waveform chart as an example of a secondary-transfer bias including the superimposed voltage output from the secondary-transfer power source 39. In FIG. 6, the waveform of the secondary-transfer bias is sinusoidal. The offset voltage Voff is a value of the DC component (DC voltage) of the secondary-transfer bias including the superimposed voltage. The offset voltage Voff is negative in polarity in FIG. 6. When the waveform of the secondary-transfer bias is sinusoidal as illustrated in FIG. 6, the offset voltage Voff is the same as the average potential (time-averaged value) Vave for one cycle (T) of the secondary-transfer bias. That is, the average value Vave of the transfer bias is also negative in polarity in FIG. 6.

As in the image forming apparatus 1000 according to the present embodiment in which the secondary-transfer bias is applied to the metal core of the secondary-transfer first roller 33 (FIG. 1), the toner electrostatically moves in the transfer direction in the secondary-transfer nip N when the polarity of the secondary-transfer bias is the same as the normal charge polarity of toner. More specifically, the toner electrostatically moves from the surface of the intermediate transfer belt 31 onto the surface of the recording sheet in the secondary-transfer nip N. When the polarity of the secondary-transfer bias becomes opposite to the normal charge polarity of toner, the toner electrostatically moves in the direction opposite to the transfer direction within the secondary-transfer nip N. More specifically, the toner electrostatically moves from the surface of the recording sheet P onto the surface of the intermediate transfer belt 31 in the secondary-transfer nip N. In the present embodiment, the time-averaged value Vave is made negative that is the same as the normal charge polarity of toner to reciprocally move toner between the surface of the intermediate transfer belt 31 and the surface of the recording sheet P within the secondary-transfer nip N. Thus, the toner relatively moves from the surface of the intermediate transfer belt 31 onto the surface of the recording sheet P. This allows for a successful secondary transfer of a toner image from the surface of the intermediate transfer belt 31 onto the surface of the recording sheet P.

In FIG. 6, the transfer peak value Vt is one of two peak values of one cycle (cycle T) of the secondary transfer bias. The secondary transfer bias with the transfer peak value Vt electrostatically moves toner from the surface of the intermediate transfer belt 31 toward the surface of the recording sheet P with a greater force. A peak value Vr is the other peak value of the two peak values. In other words, the peak value Vr is an opposite-peak value to the transfer peak value Vt. In the secondary-transfer bias of FIG. 6, the opposite-peak value Vr is an opposite polarity (positive polarity) to the polarity of the transfer peak value Vt.

The transfer-peak value Vt is on the transfer side (the negative-polarity side) relative to the time-averaged value Vave. The opposite-peak value Vr is another peak value that is different from the transfer-peak value Vt. The opposite-peak value Vr is on the opposite side (the positive-polarity side) of the transfer side relative to the time-averaged value Vave.

Figure 7:
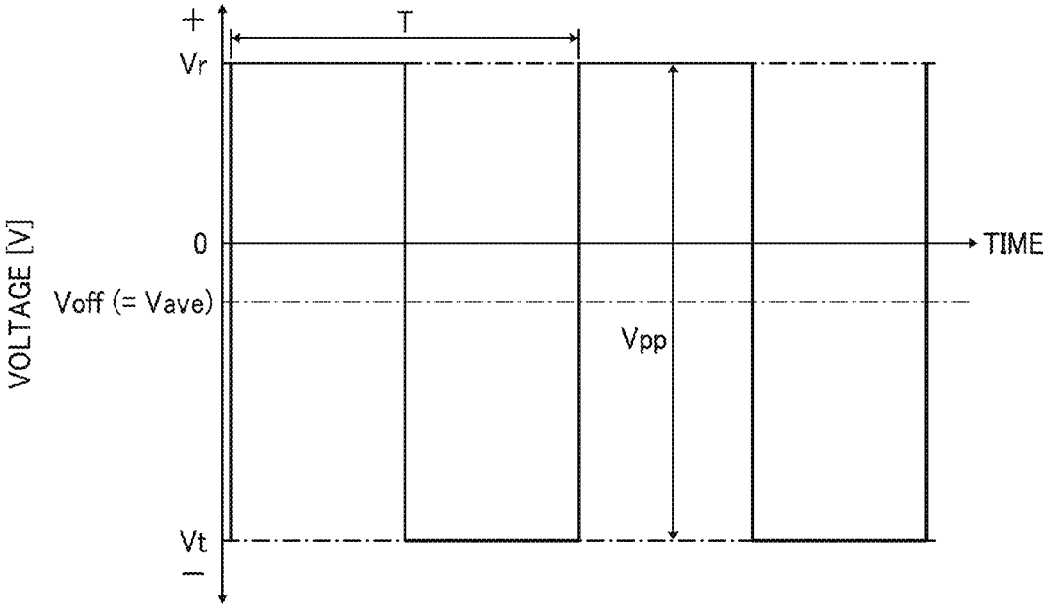
FIG. 7 is a graph of a waveform of a secondary-transfer bias including the superimposed voltage with an opposite-peak duty of 50% according to another embodiment of the present disclosure.

The waveform of the secondary-transfer bias output from the secondary-transfer power source 39 is not limited to a sinusoidal wave as illustrated in FIG. 6. Alternatively, any of a triangular wave and a rectangular wave of the secondary transfer bias is applicable. FIG. 7 is a waveform chart of the secondary-transfer bias including the superimposed voltage as a second example. In FIG. 5, the waveform of the secondary-transfer bias is rectangular. Each of the sinusoidal wave of the secondary-transfer bias in FIG. 6 and the rectangular wave of the secondary-transfer bias in FIG. 7 has a duty ratio of 50% on the opposite-peak side to be described below. Any secondary-transfer bias having the waveform with such characteristics has the time-averaged value Vave that is the same as the offset voltage Voff for one cycle (cycle T). In other words, the value of the DC component is the same as the time-averaged value Vave.

Figure 8:
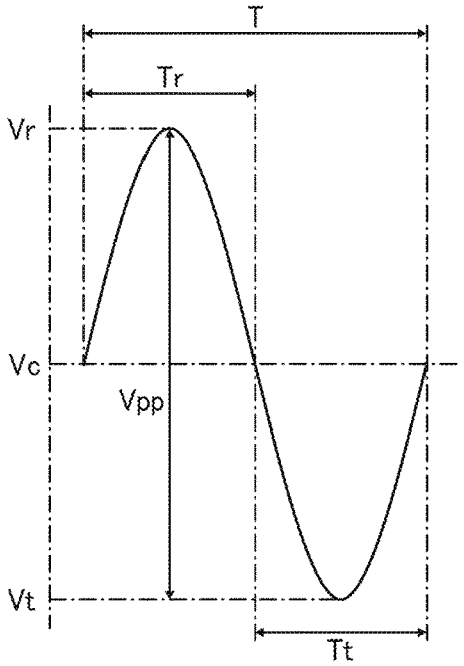
FIG. 8 is a graph for describing the opposite-peak duty of the secondary-transfer bias of FIG. 6.

FIG. 8 is a graph for describing the opposite-peak duty of the secondary-transfer bias of FIG. 6. In FIG. 8, a center potential Vc is a potential in the middle of a peak-to-peak value Vpp of the AC component (AC voltage) of the secondary-transfer bias. The peak-to-peak voltage Vpp is the sum of the opposite-peak value Vr and the transfer-peak value Vt.

In the present embodiment, a transfer-directional time period Tt is defined as a time period to electrostatically move toner from the surface of the intermediate transfer belt 31 onto the surface of the recording sheet P in the secondary-transfer nip N during one cycle of the secondary-transfer bias including the superimposed voltage. That is, the transfer-directional time period Tt is a time period in which a value of the secondary-transfer bias is on the transfer-directional side (the negative-polarity side in the present embodiment) to move a toner image from the intermediate transfer belt 31 onto the recording sheet P relative to the time-averaged value Vave (average potential) during the one cycle T. An opposite-transfer directional time period Tr is a different time period (the remaining time period in the one cycle T) from the transfer-directional time period Tt. That is, the opposite-transfer directional time period Tr is a timer period in which a value of the secondary-transfer bias is on the opposite-transfer directional side (that is, the opposite side of the transfer-directional side, i.e., the positive-polarity side in the present embodiment) relative to the time-averaged value Vave. As illustrated in FIGS. 6, 7, and 8, the opposite-transfer directional time period Tr is a time period in which a value of the secondary-transfer bias is on the side of the opposite-peak value Vr relative to the time-averaged value Vave (that is, average potential as a predetermined reference value). Duty of the secondary-transfer bias including the superimposed voltage is defined as a ratio of the opposite-transfer directional time period Tr in the one cycle. That is, duty is defined as $(T-Tt)/T\times100\%$.

In other words, the duty is $Tr/(Tr+Tr)\times100\%$ where Tr is a time period to apply a transfer bias in a transfer direction to transfer toner of a toner image to a recording sheet P and Tt is a time period to apply the transfer bias in an opposite direction of the transfer direction with respect to the time-averaged value Vave of the transfer bias. The waveform of FIGS. 6, 7, and 8 has a duty of 50%. In other words, the waveform has an opposite-peak duty of 50%.

In the present embodiment, a duty of greater than 50% is referred to as a high duty, and a duty of less than 50% is referred to as a low duty.

FIG. 8 is a graph for describing the opposite-peak duty of the secondary-transfer bias of FIG. 6. In FIG. 8, a center potential Vc is a potential in the middle of a peak-to-peak value Vpp of the AC component (AC voltage) of the secondary-transfer bias. The peak-to-peak voltage Vpp is the sum of the opposite-peak value Vr and the transfer-peak value Vt. In FIG. 8, the opposite-transfer directional time period Tr is a time period from a time when the value of the secondary-transfer bias starts rising from the center potential Vc toward the opposite-peak value Vr to a time when the value having reached the opposite-peak value Vr returns to the center potential Vc within one cycle (cycle T).

In the present embodiment, the duty is $Tr/(Tr+Tr)\times100\%$ where Tr is a time period to apply a transfer bias in a transfer direction to transfer toner of a toner image to a recording sheet P and Tt is a time period to apply the transfer bias in an opposite direction of the transfer direction with respect to the time-averaged value Vave of the transfer bias. Further, the transfer-directional time period Tt is a time period from a time when the value of the secondary-transfer bias starts rising from the center potential Vc toward the transfer-peak value Vt to a time when the value having reached the transfer-peak value Vt returns to the center potential Vc within one cycle (cycle T). The opposite-peak duty is a ratio of the opposite-transfer directional time period Tr in the one cycle. The waveform in FIG. 8 has a duty of 50%. In other words, the waveform has an opposite-peak duty of 50%.

Figure 9:
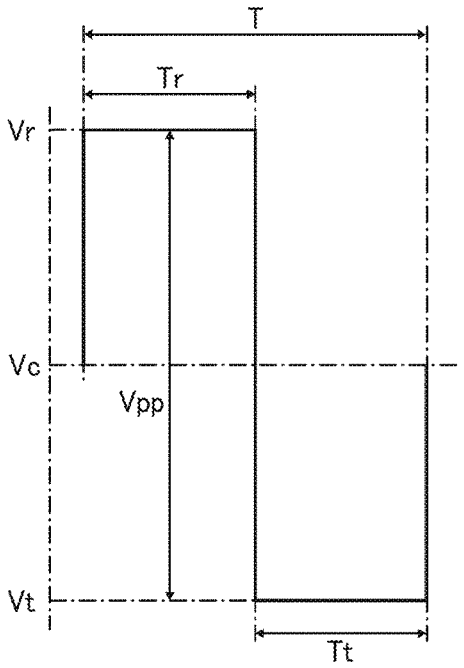
FIG. 9 is a graph for describing the opposite-peak duty of the secondary-transfer bias of FIG. 7.

FIG. 9 is a graph for describing the opposite-peak duty of the secondary-transfer bias of FIG. 7. The rectangular waveform in FIG. 9 has the opposite-peak duty of 50% that is a ratio of the opposite-transfer directional time period Tr in the one cycle T.

To electrostatically move toner from the surface of the intermediate transfer belt 31 onto the surface of the recording sheet P within the secondary-transfer nip N with the secondary-transfer bias having an opposite-peak duty of 50%, the absolute value of the transfer-peak value Vt is preferably greater than the absolute value of the opposite-peak value Vr. With an excessively increased absolute value of the transfer-peak value Vt, electric discharge occurs within the secondary-transfer nip N between the surface of the intermediate transfer belt 31 and the recording sheet P having an uneven surface. Such an electric discharge causes toner particles to be charged with the opposite polarity, thereby hampering the secondary transfer of the toner particles. As a result, many white spots occur in the image, and thus the image quality significantly degrades. Accordingly, the absolute value of the transfer-peak value Vt is preferably set to a certain value.

With an excessively reduced absolute value of the opposite-peak value Vr, a sufficient amount of toner fails to be transferred to the recesses of the recording sheet P having an uneven surface. More specifically, with an excessively reduced absolute value of the opposite-peak value Vr, the toner particles having been temporarily transferred to the recesses of the recording sheet P fail to return to the surface of the intermediate transfer belt in the secondary-transfer nip. Accordingly, the toner particles fails to return from the recesses of the sheet and collide with other toner particles adhering to the surface of the intermediate transfer belt 31, thus failing to reduce the adhesion force between the other toner particles and the surface of the intermediate transfer belt 31. Thus, the toner particles to be transferred into the recesses of the recording sheet P fail to increase in number by merely vibrating the toner particles. As a result, an insufficient amount of toner is transferred into the recesses of the sheet.

Examples of the methods for increasing the opposite-peak value Vr include increasing the peak-to-peak value Vpp of the AC component. Increasing the peak-to-peak value Vpp to prevent the insufficient opposite-peak value Vr, however, increases the transfer-peak value Vt as well, which increases the possibility of the occurrence of white spots due to the electric discharge.

Alternatively, the offset value Voff is reduced to increase the opposite-peak value Vr. Reducing the offset value Voff reduces the average potential Vave, and thereby the toner fails to electrostatically move from the surface of the intermediate transfer belt onto the surface of the sheet in the secondary-transfer nip N, resulting in the secondary transfer failure.

First Embodiment

To transfer a sufficient amount of toner onto the recesses of the uneven-surface sheet as a recording sheet P having a greater degree of unevenness (greater depth) than in the smooth sheet, the opposite-peak duty is preferably equal to or less than 50%. More preferably, the opposite-peak duty is less than 50%. With the opposite-peak duty of greater than 50%, the white spots due to the electric discharge and the secondary transfer failure occur. More specifically, with the opposite-peak duty of greater than 50%, the average potential Vave is shifted toward the opposite-peak side by the amount that exceeds the duty of 50% to reduce the absolute value of the average potential (time-averaged value) Vave, resulting in the occurrence of the secondary transfer failure. To avoid such a secondary transfer failure, if the peak-to-peak vale Vpp is increased to increase the average potential Vave, the transfer-peak value Vt increases, thereby increasing the possibility of occurrence of white spots due to the electric discharge. Thus, the opposite-peak duty is preferably less than 50%.

Figure 10:
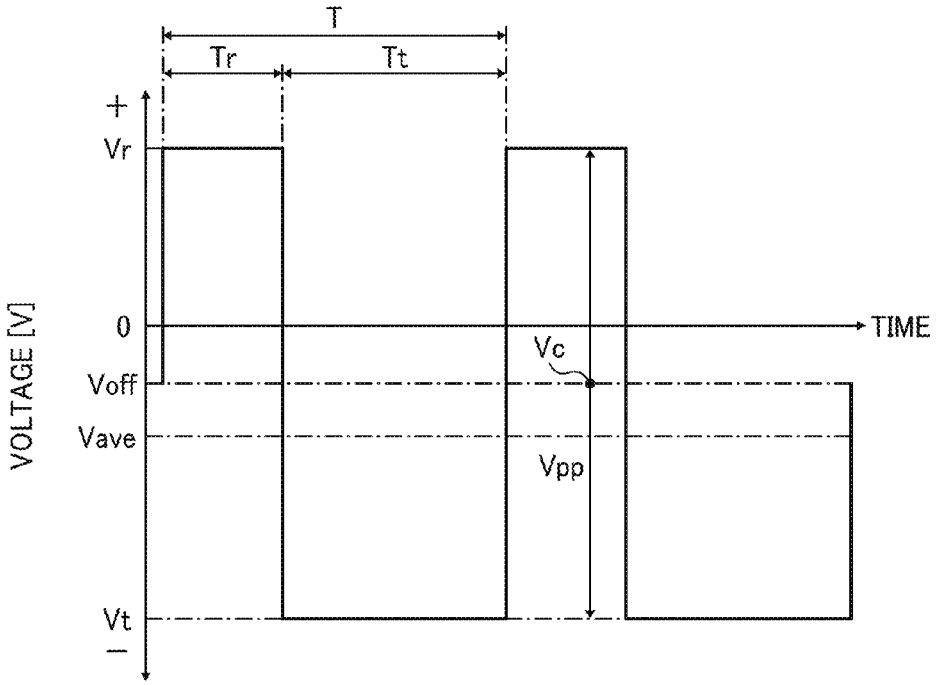
FIG. 10 is a graph of a waveform of a secondary-transfer bias having an opposite-peak duty of 35% according to an embodiment of the present disclosure.

FIG. 10 is a graph of a waveform of a secondary-transfer bias including the superimposed voltage with an opposite-peak duty of 35% that is less than 50% according to an embodiment of the present disclosure. The opposite-peak value Vr of the secondary-transfer bias in FIG. 10 is the same as the opposite-peak value Vr of the secondary-transfer bias in FIG. 7. The transfer-peak value Vt of the secondary-transfer bias in FIG. 10 is the same as the transfer-peak value Vt of the secondary-transfer bias in FIG. 7. The secondary-transfer bias in FIG. 10 differs from the secondary-transfer bias in FIG. 7 in the opposite-transfer directional time period Tr and the transfer-directional time period Tt. In the secondary-transfer bias of FIG. 7, the opposite-transfer directional time period Tr is the same as the transfer-directional time period Tt. By contrast, in the secondary-transfer bias of FIG. 10, the opposite-transfer directional time period Tr is shorter than the transfer-directional time period Tt. More specifically, in the secondary-transfer bias of FIG. 7, the length of the opposite-transfer directional time period Tr time period tr is 50% of the cycle T. By contrast, in the secondary-transfer bias of FIG. 10, the opposite-transfer directional time period Tr is 35% of the cycle T. In other words, the secondary-transfer bias in FIG. 10 has an opposite-peak duty of 35%.

The secondary-transfer bias may have any type of waveforms other than the rectangular wave in FIG. 10. In some embodiments, the secondary-transfer bias may have a trapezoidal waveform in which predetermined time periods are taken for the voltage to change from the opposite-peak value Vr to the transfer-peak value Vt and from the transfer-peak value Vt to the opposite-peak value Vr, respectively. In some embodiments, the secondary-transfer bias may have a waveform that is partially or entirely round. The secondary-transfer bias to be described later may also have any type of waveform other than the rectangular waveform.

In the secondary-transfer bias of FIG. 7 having an opposite-peak duty of 50%, the offset voltage Voff is the same as the average potential Vave as described above. In the secondary-transfer bias of FIG. 10 having an opposite-peak duty of 35%, the average potential Vave is greater than the offset voltage Voff. The peak-to-peak value Vpp is common between the secondary-transfer bias in FIG. 7 and the secondary-transfer bias in FIG. 10. That is, with the opposite-peak duty of less than 50%, the average potential Vave successfully increases without any changes in the peak-to-peak value Vpp, the transfer-peak value Vt, and the opposite-peak value Vr as compared to the case of the opposite-peak duty of 50%. Thus, with the opposite-peak duty of less than 50%, the secondary transfer failure and the occurrence of white spots are prevented or reduced as compared to the case of the opposite-peak duty of greater than or equal to 50%.

Accordingly, the image forming apparatus according to the present embodiment employs the secondary-transfer bias that reverses the polarity thereof during one cycle and has an opposite-peak duty of less than 50% when a toner image is secondarily transferred onto the recording sheet P having an uneven surface (the uneven-surface sheet). Such a configuration successfully prevents or reduces the secondary transfer failure and the occurrence of white spots due to the electrical discharge as compared to cases in which the secondary-secondary transfer bias has an opposite-peak duty of greater than or equal to 50%. Hereinafter, the opposite-peak duty of less than 50% is referred to as low duty. By contrast, the opposite-peak duty of greater than 50% is referred to as high duty.

Figure 11:
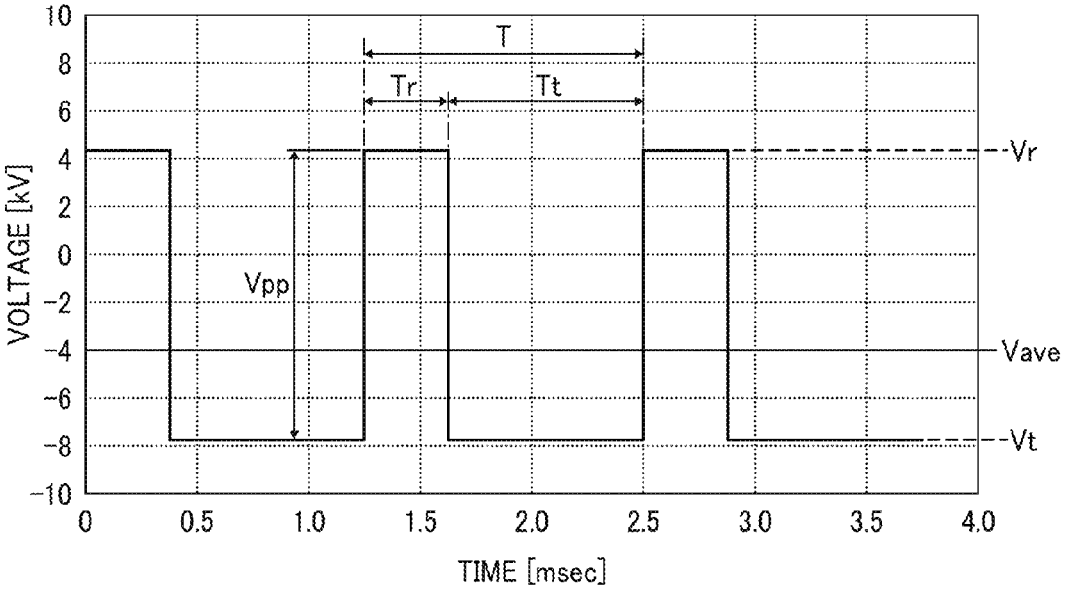
FIG. 11 is a graph of a waveform of a low-duty secondary-transfer bias having an opposite-peak duty of 30% according to an embodiment of the present disclosure.
Figure 12:
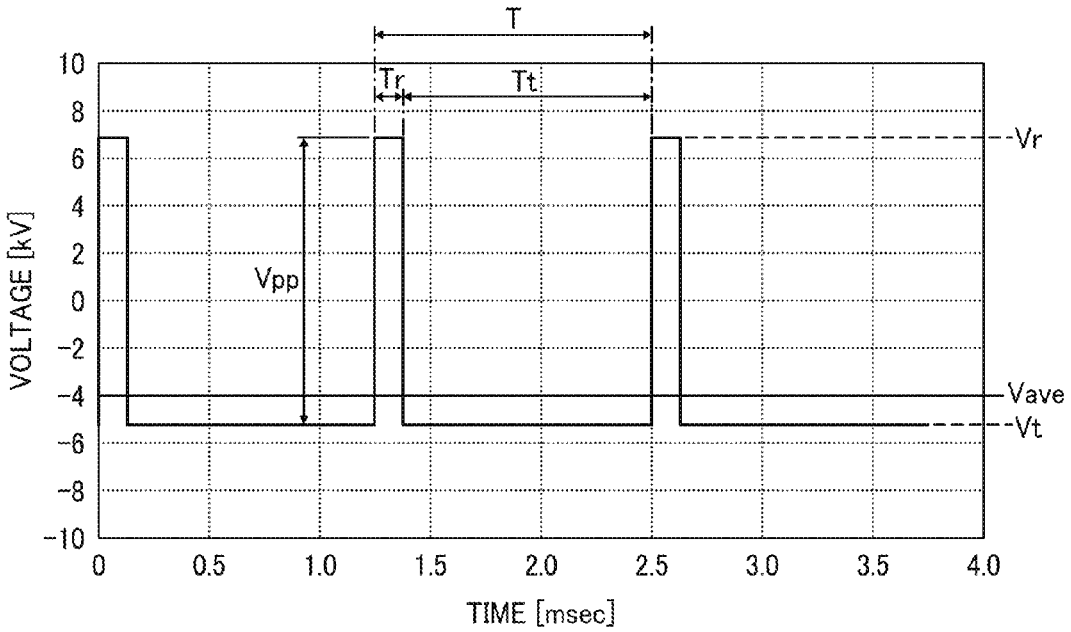
FIG. 12 is a graph of a waveform of a low-duty secondary-transfer bias having an opposite-peak duty of 10% (according to an embodiment of the present disclosure.

Note that with a significantly reduced value of the opposite-peak duty in the secondary-transfer bias having the low duty, the absolute value of the opposite-peak value Vr increases as compared to the absolute value of the transfer-peak value Vt. FIG. 11 for example is a graph of a waveform of the secondary-transfer bias having the low duty in which the opposite-peak duty is 30% according to an embodiment. FIG. 12 is a graph of a waveform of the secondary-transfer bias having the low duty in which the opposite-peak duty is 10% according to an embodiment. In each of the secondary-transfer biases of FIG. 11 and FIG. 12, the average potential Vave is −4 kV and the peak-to-peak value Vpp is 12 kV. In the secondary-transfer bias having the opposite-peak duty of 30% in FIG. 11, the absolute value (approximately 4 kV) of the opposite-peak value Vr is smaller than the absolute value (approximately 8 kV) of the transfer-peak value Vt. In the secondary-transfer bias having the opposite-peak duty of 10% in FIG. 12, the absolute value (approximately 7 kV) of the opposite-peak value Vr is greater than the absolute value (approximately 5 kV) of the transfer-peak value Vt.

With the secondary-transfer bias of FIG. 11 in which the transfer-peak value Vt is greater than the opposite-peak value Vr (in terms of absolute value), the electrical discharge occurs in the secondary-transfer nip during the transfer-directional time period Tt in which the value of the secondary-transfer bias is the transfer-peak value Vt in one cycle of the secondary-transfer bias, thus increasing the possibility of occurrence of white spots in an image. By contrast, with the secondary-transfer bias in FIG. 12, the opposite-peak value Vr is greater than the transfer-peak value Vt (in terms of absolute value). Accordingly, the electrical discharge occurs in the secondary-transfer nip during the opposite-transfer directional time period Tr in which the value of the secondary-transfer bias is the opposite-peak value Vr in one cycle of the secondary-transfer bias, thus increasing the possibility of occurrence of white spots in an image.

The absolute value (approximately 7 kV) of the opposite-peak value Vr of the secondary-transfer bias in FIG. 12 is smaller than the absolute value (approximately 8 kV) of the transfer-peak value Vt of the secondary-transfer bias in FIG. 11. The opposite-transfer directional time period Tr of the secondary-transfer bias in FIG. 12 is shorter than the transfer-directional time period Tr of the secondary-transfer bias in FIG. 11. In other words, the absolute value of a peak value (the opposite-peak value Vr) that induces the occurrence of white spots in the secondary-transfer bias in FIG. 12 is smaller than the absolute value of the peak value (the transfer-peak value Vt) in the secondary-transfer bias in FIG. 11. The duration (the opposite-peak time period tr) of the peak value of the secondary-transfer bias in FIG. 12 is shorter than the duration (the transfer-peak time period tf) of the peak value of the secondary-transfer bias in FIG. 11. Accordingly, the secondary-transfer bias in FIG. 12 is more likely to induce the occurrence of white spots due to the electrical discharge than the secondary-transfer bias in FIG. 11. Thus, when the secondary-transfer bias having the low duty is employed to secondarily transfer an image onto an uneven surface sheet, it is preferable that the value of the opposite-peak duty is significantly reduced.

According to the experiment performed by the present inventors, it has been found that the opposite-peak duty preferably ranges from 8% through 35% and more preferably ranges from 8% through 17% to prevent or reduce the occurrence of white spots. However, with a significantly reduced opposite duty, the ratio of the opposite-transfer directional time period tr in one cycle T significantly reduces. This might fail to move the toner particles in the recesses of the uneven surface of the recording sheet P back to the surface of the intermediate transfer belt 31 in the opposite-transfer directional time period Tr. Accordingly, it is preferable that the frequency of the AC component is relatively reduced and the length of one cycle T is relatively increased to obtain a sufficient length of the opposite-transfer directional time period Tr.

Next, the present inventors have performed the experiment in which a halftone image having a lower density than the density of the solid image is secondarily transferred onto a recording sheet P that is a coated sheet (smooth-surface sheet) with a good surface smoothness under the conditions that the secondary-transfer bias having the low duty is used and that the secondary-transfer bias including only the DC voltage is used. The results have indicated that an insufficient image density occurs in a halftone image due to secondary transfer failure.

With respect to such a secondary transfer failure, the present inventors have recognized the following. The entire printed area of the halftone image is not covered with toner like the solid image. The printed area includes toner-adhesion spots that constitute relatively few-dot groups and a white space to which no toner adheres. The intermediate-transfer belt 31 including the elastic layer 31*b* is used and a smooth sheet having a good surface smoothness is used as the recording sheet P. In this case, the elastic layer 31*b* flexibly deforms according to the shapes of the few-dot toner masses each of which constitutes the few-dot group in the halftone image within the secondary-transfer nip N. The elastic layer 31*b* deforms to cover the surfaces as well as the side surfaces of the few-dot toner masses. This injects charges having the opposite polarity of the normal charge polarity into the toner particles of the few-dot toner masses, thereby reducing the charge amount of toner (Q/M) or causing the toner to be charged with the opposite polarity. It has been found that this results in the secondary transfer failure of a toner image. Note that when the uneven surface sheet is used as the recording sheet P, the elastic layer 31*b* deforms into irregular shapes according to the unevenness of the uneven surface sheet, thereby leading to little possibility of covering the side surfaces of the few-dot toner masses by the elastic layer 31*b*. Thus, no secondary transfer failure occurs on the protrusions of the recording sheet P (uneven surface sheet) as well.

Figure 13:
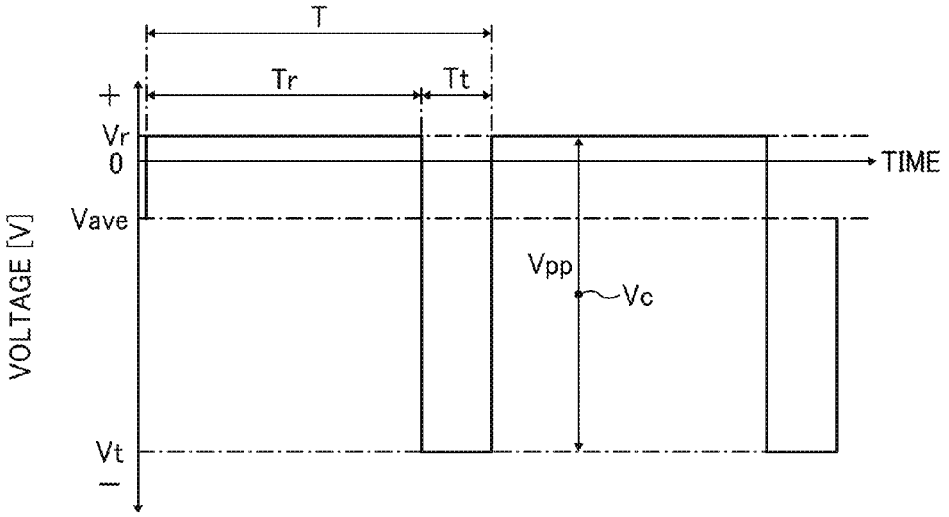
FIG. 13 is a graph of a waveform of a high-duty secondary-transfer bias having an opposite-peak duty of 80% in which the polarity is reversed during one cycle according to an embodiment of the present disclosure.

Next, the present inventors have performed the experiment in which an image is secondarily transferred onto a smooth sheet as the recording sheet P using the secondary-transfer bias having the high duty (the opposite-peak duty is 80%) in FIG. 13 is used instead of the secondary-transfer bias having the low duty and the secondary-transfer bias including only the DC voltage. As the smooth sheet, OK Top Coat (so-called coated paper, i.e., smooth sheets) from Oji paper Co., Ltd., having a weight of 128 gsm is used. In the experiment, a black halftone image (2 by 2) has been secondarily transferred onto the smooth sheet under the conditions that the temperature is 27° C., the relative humidity is 80%, and the process linear velocity is 630 mm/s. The results have indicated that the black halftone image is secondarily transferred onto the smooth sheet in a successful manner without the secondary transfer failure.

The reason why secondary transferability of the black halftone image relative to the smooth sheet was improved by using the secondary-transfer bias including the high duty is as follows. When the intermediate transfer belt 31 that endlessly moves enters the secondary-transfer nip N, the secondary-transfer bias starts charging a portion of the intermediate-transfer belt 31 that has entered the secondary-transfer nip N. When the amount of charge exceeds the threshold value, charges having the opposite polarity start to be injected into the few-dot toner masses in the halftone image. The portion of the intermediate transfer belt 31 having entered the secondary-transfer nip N is charged during the transfer time period Tt. Accordingly, with an increase in length of the transfer time period Tt, the amount of injection of the charges having the opposite polarity into the few-dot toner masses increases. The secondary-transfer bias having the high duty has a shorter transfer time period Tt than the secondary-transfer bias having the low duty. Accordingly, it is conceivable that the secondary-transfer bias having the high duty reduces the amount of injection of the charges having the opposite polarity into the few-dot toner masses, thereby preventing or reducing the occurrence of the secondary transfer failure.

Figure 14:
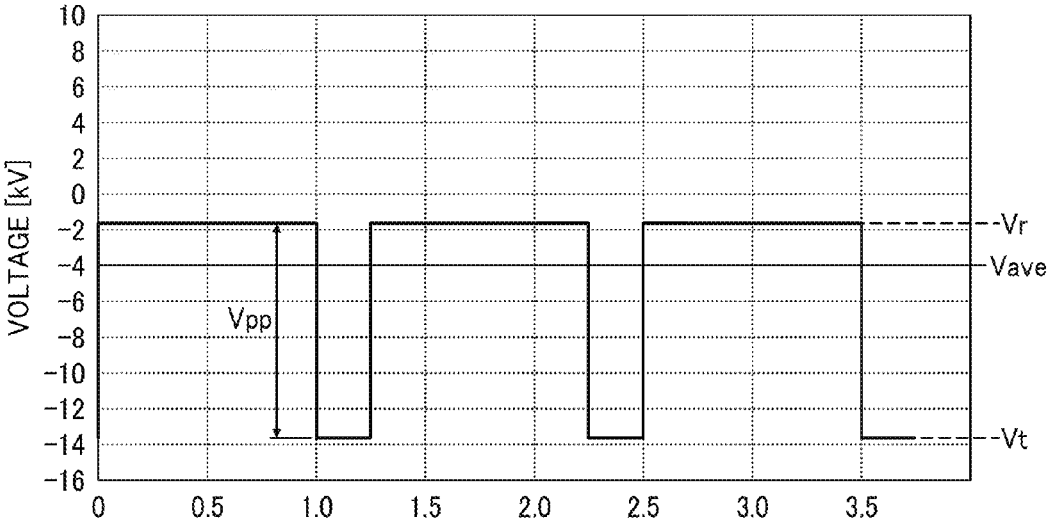
FIG. 14 is a graph of a waveform of a high-duty secondary-transfer bias having an opposite-peak duty of 80% in which the polarity is constant during the one cycle, the average potential is −4 kV and the peak-to-peak potential Vpp is 12 kV according to an embodiment of the present disclosure.
Figure 15:
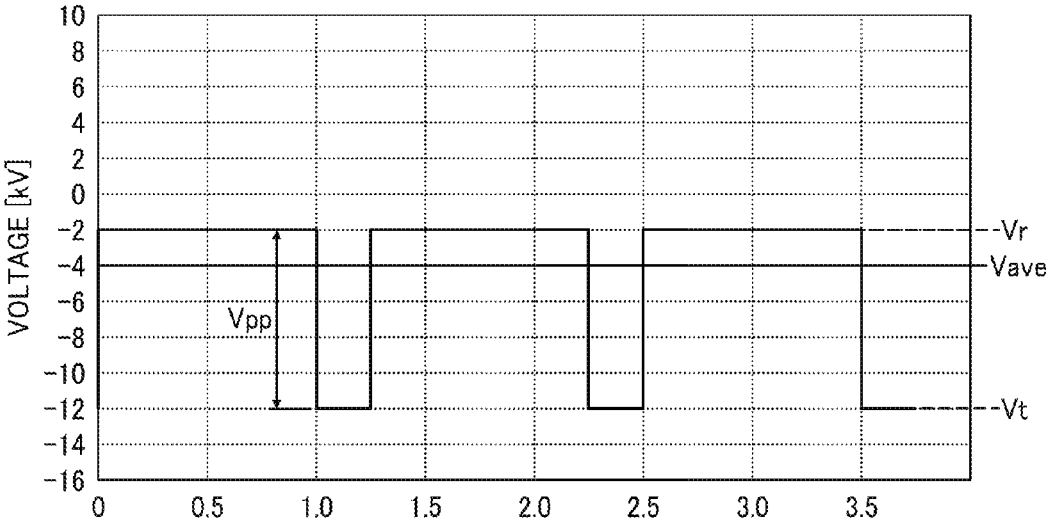
FIG. 15 is a graph of a waveform of a high-duty secondary-transfer bias having an opposite-peak duty of 80% in which the polarity is constant during the one cycle, the average potential is −4 kV and the peak-to-peak potential Vpp is 10 kV according to an embodiment of the present disclosure.
Figure 16:
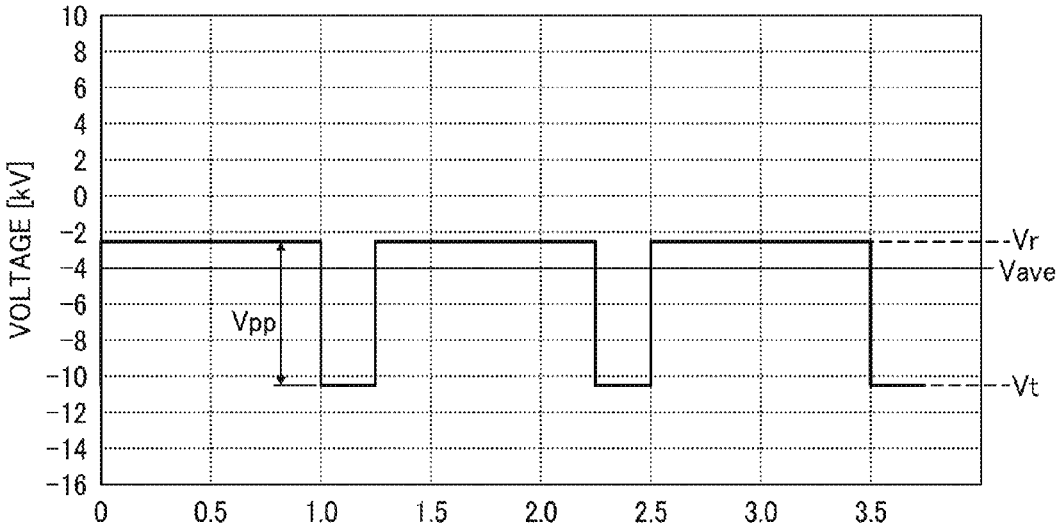
FIG. 16 is a graph of a waveform of a high-duty secondary-transfer bias having an opposite-peak duty of 80% in which the polarity is constant during the one cycle, the average potential is −4 kV and the peak-to-peak potential Vpp is 8 kV according to an embodiment of the present disclosure.
Figure 17:
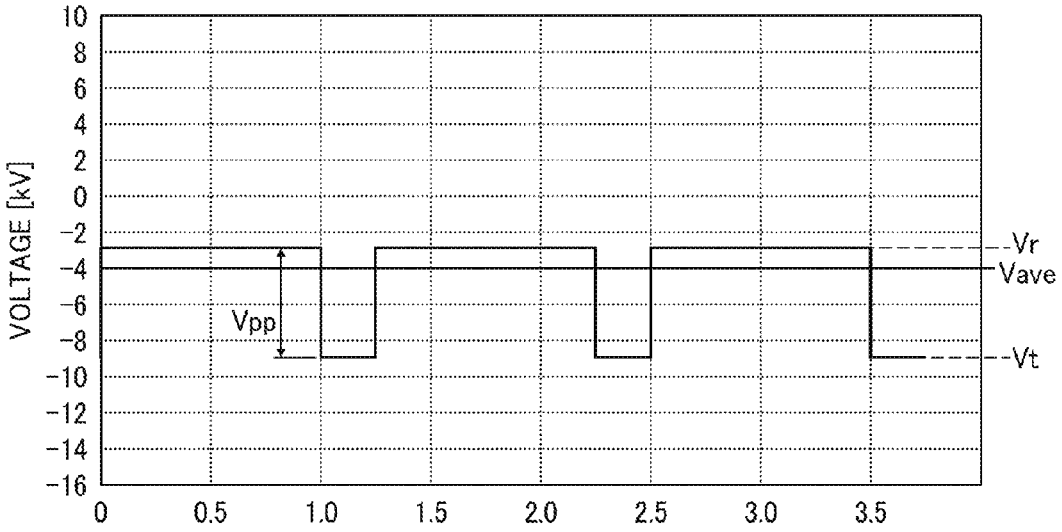
FIG. 17 is a graph of a waveform of a high-duty secondary-transfer bias having an opposite-peak duty of 80% in which the polarity is constant during the one cycle, the average potential is −4 kV and the peak-to-peak potential Vpp is 6 kV according to an embodiment of the present disclosure.

Another experiment performed by the present inventors has indicated as follows. The use of the secondary-transfer bias having the high duty in FIG. 14 though FIG. 17 that does not reverse the polarity during one cycle (T) improves the secondary transferability relative to the smooth sheet as compared to the use of the secondary-transfer bias having the high duty in FIG. 13 that reverses the polarity during one cycle.

In the secondary-transfer bias in FIG. 13, the polarity of the voltage is changed to the polarity opposite to the polarity in the transfer-directional time period Tt during the opposite-transfer directional time period Tr, to reverse the direction of the electrical field to bring toner from the surface of the sheet back to the surface of the intermediate-transfer belt 31. Each of the secondary-transfer bias in FIG. 13 and the secondary-transfer bias in FIG. 14 through FIG. 17 has the same opposite-peak duty and the same average potential (intensity integral value) (Vave) of the secondary-transfer electrical field in one cycle to obtain the similar secondary transferability. In this case, the transfer-peak value Vt of the secondary-transfer bias in FIG. 13 is preferably greater than the transfer-peak value Vt of the secondary-transfer bias in FIG. 14 through FIG. 17. Accordingly, with the secondary-transfer bias in FIG. 13, the amount of injection of charges having the opposite polarity into the few-dot toner masses in the halftone image increases as compared to the secondary-transfer bias in FIG. 14 through FIG. 17. In other words, the secondary-transfer bias in FIG. 14 through FIG. 17 allows a reduction in transfer-peak value Vt, thereby reducing the amount of injection of charges having the opposite polarity into the few-dot toner masses, thus improving the secondary transferability as compared to the secondary-transfer bias in FIG. 13.

In the secondary-transfer biases in FIG. 14 through FIG. 17, the opposite-peak duty is 80% and the average potential Vave is −4 kV. However, the peak-to-peak potential Vpp differs between the secondary-transfer biases of FIG. 14 through FIG. 17. To achieve differing peak-to-peak potentials Vpp and the common opposite-peak duty and average potential Vave between the secondary-transfer biases of FIG. 14 through FIG. 17, the secondary-transfer biases of FIG. 14 through FIG. 17 have different offset voltage Voff from each other. The peak-to-peak potentials Vpp of the secondary-transfer biases of FIG. 14, FIG. 15, FIG. 16, and FIG. 17 are 12 kV, 10 kV, 8 kV, and 6 kV, respectively. With such values of the peak-to-peak potentials Vpp, the transfer-peak value Vt of the secondary-transfer bias gradually decreases in order of FIG. 14, FIG. 15, FIG. 16, and FIG. 17. The opposite-peak value Vr of the secondary-transfer bias gradually increases in order of FIG. 14, FIG. 15, FIG. 16, and FIG. 17. In FIG. 14, FIG. 15, FIG. 16, and FIG. 17, the polarity of the opposite-transfer value Vr is the same as the polarity of the transfer-peak value Vt. Focusing attention on the polarity, charges having the opposite polarity might be injected into the few-dot toner masses in the halftone image during the opposite-transfer time period Tr as well. However, the opposite-peak value Vr is relatively low in each of FIG. 14 through FIGS. 17, and therefore there is little possibility of charges having the opposite polarity being injected into the few-dot toner masses during the opposite-transfer time period Tr. Using the secondary-transfer bias in FIG. 17 in which the transfer-peak value Vt that mainly causes the injection of the charges having the opposite polarity into the few-dot toner masses in the transfer-directional time period Tt is the greatest among FIG. 14 through FIG. 17, the secondary transferability of an image (particularly, a halftone image) relative to the smooth sheet increases the best among FIG. 14 through FIG. 17.

Note that in the secondary-transfer bias including only the DC voltage and having the average potential Vave of −4 kV that is the same as those of FIG. 14 through FIG. 17, the charges having the opposite polarity are injected into the few-dot toner masses all the time during one cycle. This is because the value of −4 kV exceeds the threshold value that starts injecting the charges having the opposite polarity from the intermediate transfer belt 31 into the few-dot toner masses. Thus, the secondary transferability might significantly occur due to continuous injection of the opposite charges to the few-dot toner masses in the one cycle T.

When an image is formed on a smooth sheet, the controller 200 controls the secondary-transfer power source 39 to output a transfer bias having the opposite-peak duty of greater than 50% that is a duty on the side of the opposite-peak value Vr. The opposite-peak value Vr, which is one of the peak values (the transfer value Vt and the opposite-peak value Vr), electrostatically moves less toner within the secondary-transfer nip N from the intermediate transfer belt 31 onto the recording sheet P as the nip forming member, than the transfer peak value Vr does. In general, printed images of a user sometimes include a photograph that often includes light-gray colored or light-colored images. In transferring such a halftone image onto the smooth sheet, using the high-duty secondary-transfer bias can prevent or reduce the occurrence of the secondary-transfer failure in output images.

In the image forming apparatus 1000, the high-smooth sheet having a higher surface smoothness than the low-smooth sheet and the low-smooth sheet are used as a recording sheet P. The controller 200 preliminarily determines and stores therein a high-smooth mode (a first mode) to a transfer a toner image onto a high-smooth sheet having a higher smoothness than a low-smooth sheet, and a low-smooth mode (a second mode) to transfer a toner image onto the low-smooth sheet. The high-smooth mode and the low-smooth mode serve as mode information. In the high-smooth mode, the controller 200 controls the transfer power source 39 to output a transfer bias having an opposite-peak duty of greater than or equal to 50% on the side of the opposite-peak value (Vr) to electrostatically move less toner from an image bearer onto the nip forming member than the transfer-peak value (Vr). In the low-smooth mode, the controller 200 controls the transfer power source 39 to output a transfer bias having the opposite-peak duty of less than or equal to 50% that is different of that of the high-smooth mode. The controller 200 controls a nip width changing device 60 to change a secondary-transfer nip width (referred to also as nip width or transfer-nip width) W between the high-smooth mode (high duty) and the low-smooth mode (low duty). The nip width changing device 60 is described later.

Specifically, the control 200 controls the secondary-transfer power source 39 to output the transfer bias with the high duty, while controlling the nip width changing device 60 to reduce the nip width W to be a small nip width that is smaller than a large nip width, in the high-smooth mode. The controller 200 controls the secondary-transfer power source 39 to output the transfer bias with the low duty, while controlling the nip width changing device 60 to increase the nip width W to be the large nip width, in the low-smooth mode. In the high-smooth mode, the controller 200 controls the secondary-transfer power source 39 to output the transfer bias having the opposite-peak duty of greater than 50% in the high-smooth mode. In the low-smooth mode, the controller 200 controls the secondary-transfer power source 39 to output the transfer bias having the opposite-peak duty of less than 50% that reverses the polarity within the one cycle T.

In the present embodiment, the controller 200 further controls the nip width changing device 60 to change the secondary-transfer nip width W according to the type of the recording sheet P, such as the smooth sheet and the uneven-surface sheet, in addition to according to changes in duty.

In the low-duty mode, the controller 200 controls the nip width changing device 60 to increase the secondary-transfer nip width W to be larger than the secondary-transfer nip W in the high-duty mode. Increasing the secondary-transfer nip width W in the low-duty mode allows the secondary-transfer bias to be applied with the intermediate transfer belt 31 in full contact with the recording sheet P, thus preventing image failure due to electric discharge. Further, increasing the secondary-transfer nip width W in the low-duty mode also allows toner to sufficiently reciprocate between the intermediate transfer belt 31 and the recording sheet P in the secondary-transfer nip N, thereby increasing the transferability of toner.

In the high-duty mode, excessively increasing the secondary-transfer nip width W might cause the toner having transferred from the intermediate transfer belt 31 onto the recording sheet P to return (be reversely transferred) to the intermediate transfer belt 31 while the recording sheet P passes through the secondary-transfer nip N, thus reducing the transferability. To handle such a circumstance, the controller 200 controls the nip width changing device 60 to reduce the secondary-transfer nip width W in the high-duty mode to be smaller than the secondary-transfer nip W in the low-duty mode. This can minimize the reduction in the transferability. Adjusting the secondary-transfer nip width W can prevent the reduction in transferability due to the reverse transfer of toner in the high-duty mode and prevent image failure due to electric discharge in the low-duty mode. As a result, image failure can be prevented in both modes.

Figure 18:
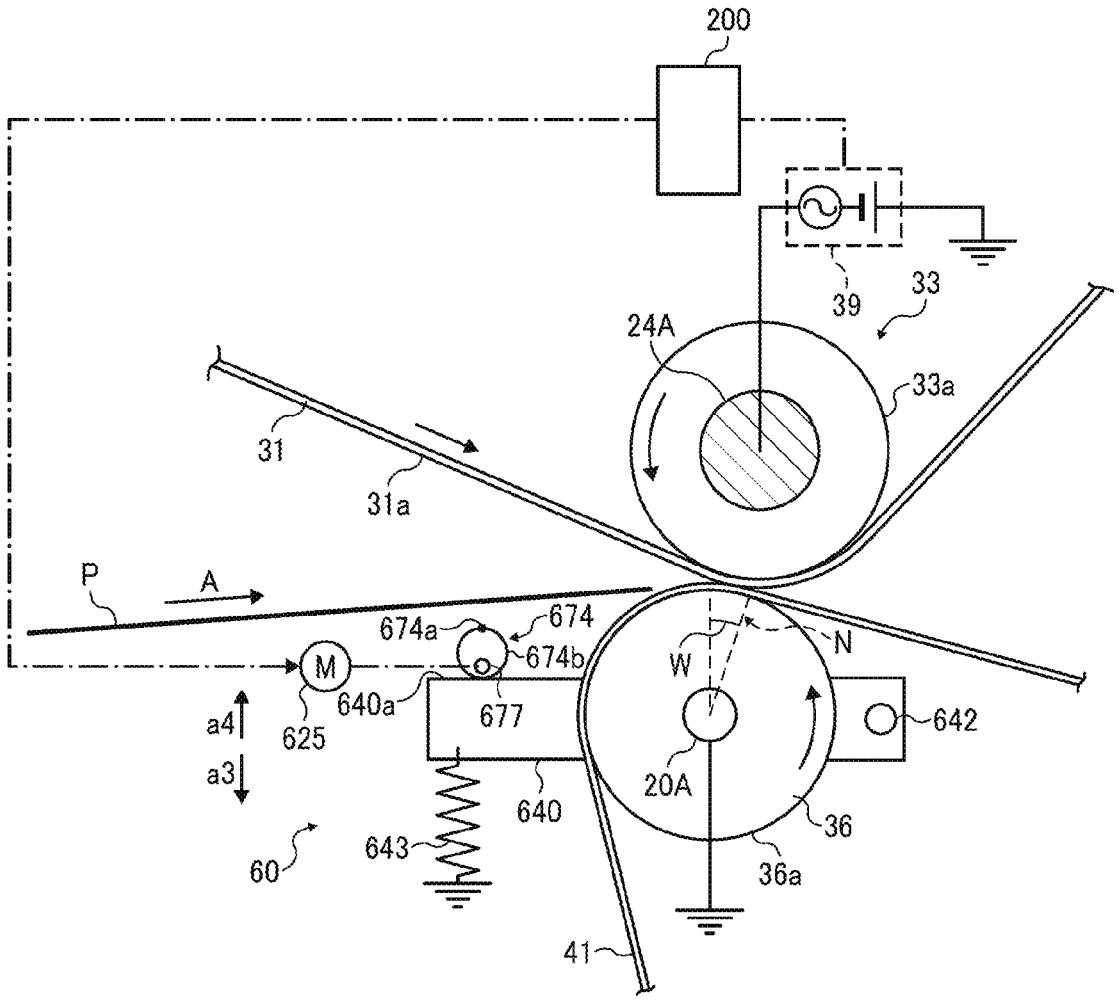
FIG. 18 is an illustration of a schematic configuration of a nip width changing device in a high-duty mode in the image forming apparatus according to an embodiment of the present disclosure.

The following describes the embodiments of the nip width changing device 60 to change a transfer-nip width (the secondary-transfer nip width) W. [First Embodiment of Nip width changing device] The nip width changing device 60 in FIG. 18 moves the secondary-transfer second roller 36 as at least one of the rollers stretching the sheet conveyance belt 41 to change the secondary-transfer nip width W. The image forming apparatus 1000 includes a roller unit holder 640 and a coil spring 643 as a pressing member to press the sheet conveyance belt 41 against the intermediate transfer belt 31 in the secondary-transfer nip N. The nip width changing device 60 changes pressing force applied to the secondary-transfer nip N using the drive motor 625 and an eccentric cam 674 to change the secondary-transfer nip width W.

The nip width changing device 60 changes the pressing force applied to the secondary-transfer nip N between the first mode (the high-smooth mode) and the second mode (the low-smooth mode). Each of the secondary-transfer first roller 33 and the secondary-transfer second roller 36 includes a core metal and an elastic layer disposed on the core metal. With an increase in force applied to the secondary-transfer nip N, an amount of deformation of the elastic layers of the secondary-transfer first roller 33 and the secondary-transfer second roller 36 increases, thereby increasing the secondary-transfer nip width W. The secondary-transfer nip width W is the length in the direction of conveyance A that is perpendicular to the width direction of the recording sheet P. The secondary-transfer nip width W correlates with the time period for the recording sheet P to pass the secondary-transfer nip N. The secondary-transfer nip width W is a width, in which the secondary-transfer first roller 33 and the secondary-transfer second roller 36 are compressed to each other in the secondary-transfer nip N, in a narrow sense. In a broad sense, the secondary-transfer nip width W is a width, in which the intermediate transfer belt 31 is in contact with the sheet conveyance belt 41, including the prenip.

The secondary-transfer second roller 36 applies a pressing force against the intermediate transfer belt 31 wound around the secondary-transfer first roller 33. The secondary-transfer second roller 36 includes a shaft 20A that is rotatably supported by the roller unit holder 640. The roller unit holder 640 has a longitudinal-directional first end pivotably supported by a support shaft 642 relative to a fixing member. The coil spring 643 is disposed between a longitudinal-directional second end and the fixing member. The roller unit holder 640 is pressed by restoring force of the coil spring 643 to rotate around the support shaft 642 in the clockwise direction as illustrated in FIG. 18. Accordingly, the secondary-transfer second roller 36 is pressed against the intermediate transfer belt 31, thereby applying the pressing force to the secondary-transfer nip N.

In such a configuration, the image forming apparatus 1000 according to the present embodiment includes the nip width changing device 60 to change the pressing force of the secondary-transfer second roller 36 applied to the secondary-transfer nip N between the low-duty mode and the high-duty mode. The nip width changing device 60 may increase the pressing force to the secondary-transfer nip N so that the pressing force in the low-duty mode is greater than the pressing force in the high-duty mode. To achieve such a configuration, the nip width changing device 60 adopts the following two methods.

Figure 19:
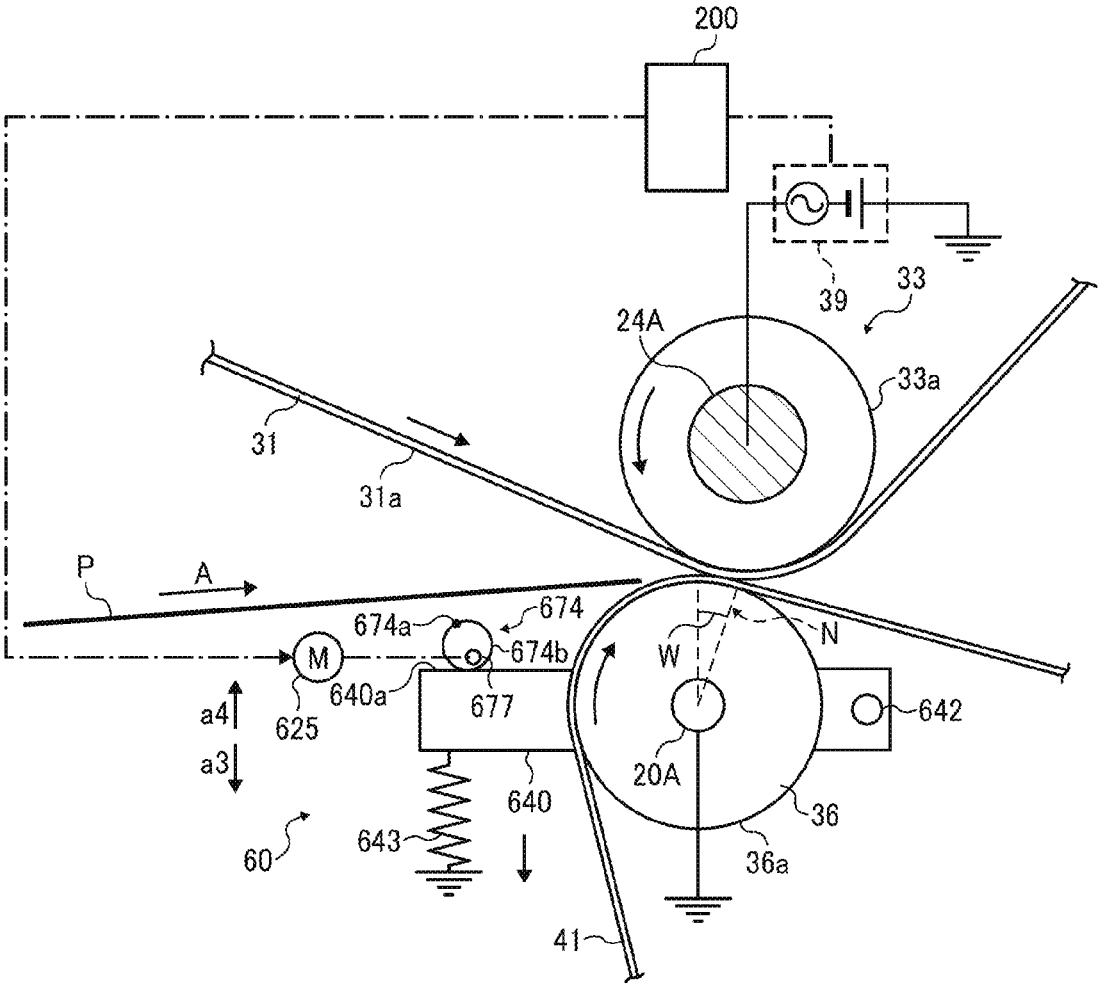
FIG. 19 is an illustration of a schematic configuration of a nip width changing device in a low-duty mode in the image forming apparatus according to the embodiment of the present disclosure.

As the first method, the nip width changing device 60 adjusts the pressing force of the coil spring 643 in a range that obtains an appropriate secondary-transfer nip width W in the low-duty mode. In the high-duty mode, the nip width changing device 60 reduces the pressing force of the coil spring 643 applied to the secondary-transfer nip N. In the first method, the nip width changing device 60 includes the eccentric cam 674 and the drive motor 625 as illustrated in FIGS. 18 and 19, thereby constituting a pressing-force adjuster. The eccentric cam 674 contacts an upper portion 640*a* of the roller unit holder 640 to shift the position of the roller unit holder 640. The drive motor 625 as a driver drives the eccentric cam 674 to rotate. The eccentric cam 674 is integrated with a drive shaft 677 to be driven by the drive motor 625 to rotate. The eccentric cam 674 has a cam surface on the outer circumferential surface 674*b*. With the cam surface, the distance from the center of rotation to the top dead center 674*a* is the maximum. The nip width changing device 60 is connected with the controller 200 in FIG. 3. The controller 200 controls the operation of the drive motor of the nip width changing device 60.

In the present embodiment, the drive motor 625 is connected with the controller 200 via a signal line to allow the controller 200 to control the operation of the drive motor 625. Specifically, the controller 200 controls the drive motor 625 to drive the eccentric cam 674 to rotate in a direction to reduce the pressing force of the coil spring 643 in the high-duty mode. In the low-duty mode, the controller 200 controls the drive motor 625 to drive the eccentric cam 674 to rotate in a direction to stop reducing the pressing force of the coil spring 643 as illustrated in FIG. 19. The ROM of the controller 200 stores the low-duty mode, in which the transfer bias of the secondary-transfer power source 39 has the low duty of less than 50%, and the high-duty mode, in which the transfer bias of the secondary-transfer power source 39 has the high duty of greater than or equal to 50%. The ROM of the controller 200 also stores the directions of rotation of the drive motor 625 and the amounts of rotation (rotating time period) of the drive motor, which are associated with the transfer mode, i.e., the low-duty mode and the high-duty mode. The ROM of the controller 200 also stores the directions of rotation of the drive motor 625 and the amounts of rotation (rotating time period) of the drive motor, which are associated with the transfer mode, i.e., the low-duty mode and the high-duty mode.

In FIGS. 18 and 19, arrow a3 represents a direction to reduce the pressing force applied to the secondary-transfer nip N, and arrow a4 represents a direction to stop reducing the pressing force applied to the secondary-transfer nip N. In other words, in FIGS. 18 and 19, the direction a3 to reduce the pressing force to the secondary-transfer nip N is a direction to press down the second end (the longitudinal-directional second end) of the roller unit holder 640. The direction a4 to stop reducing the pressing force to the secondary-transfer nip N is a direction to lift up the second end of the roller unit holder 640.

In the present embodiment, the eccentric cam 674 is positioned (lowered) to reduce the spring force of the coil spring in the high-duty mode as illustrated in FIG. 18. The position of the eccentric cam 674 in the high-duty mode is the home position. In the low-duty mode, the eccentric cam 674 is moved upward to increase the nip width as illustrated in FIG. 19.

With this configuration according the present embodiment, the controller 200 controls the drive motor 625 to drive the eccentric cam 674 to rotate in a direction to stop reducing the pressing force (pressure) of the coil spring 643 applied to the secondary-transfer nip N in the low-duty mode. This increases the pressure applied to the secondary-transfer second roller 36 in the low-duty mode to be greater than the pressure applied to the secondary-transfer second roller 36 in the high-duty mode, thus increasing the secondary-transfer nip width W in the low-duty mode. In the high-duty mode, the controller 200 controls the drive motor 625 to drive the eccentric cam 674 to rotate to press down the second end of the roller unit holder 640, thereby reducing the pressure of the secondary-transfer second roller 36 applied to the secondary-transfer nip N in the high-duty mode as compared to in the low-duty mode.

Such a configuration can increase the secondary-transfer nip width W in the low-duty mode, thereby allowing the secondary-transfer bias to be applied with the intermediate transfer belt 31 in full contact with the recording sheet P, thus preventing image failure due to electric discharge. Further, increasing the secondary-transfer nip width W in the low-duty mode also allows toner to sufficiently reciprocate between the intermediate transfer belt 31 and the recording sheet P in the secondary-transfer nip N, thereby increasing the transferability of toner.

In the high-duty mode, excessively increasing the secondary-transfer nip width W might cause the toner having transferred from the intermediate transfer belt 31 onto the recording sheet P to return (be reversely transferred) to the intermediate transfer belt 31 while the recording sheet P passes through the secondary-transfer nip N, thus reducing the transferability. In the present embodiment, the secondary-transfer nip width W is increased in the low-duty mode to prevent image failure due to electric discharge that is more likely to occur in the low-duty mode. Thus, the reduction in transferability can be minimized.

In the present embodiment, the transferability significantly decreases due to the reverse transfer of toner in the high-duty mode. In the low-duty mode, the image failure due to the electric discharge significantly occurs. To prevent image failure in each mode, the secondary-transfer nip width W is preferably adjusted.

Figure 20:
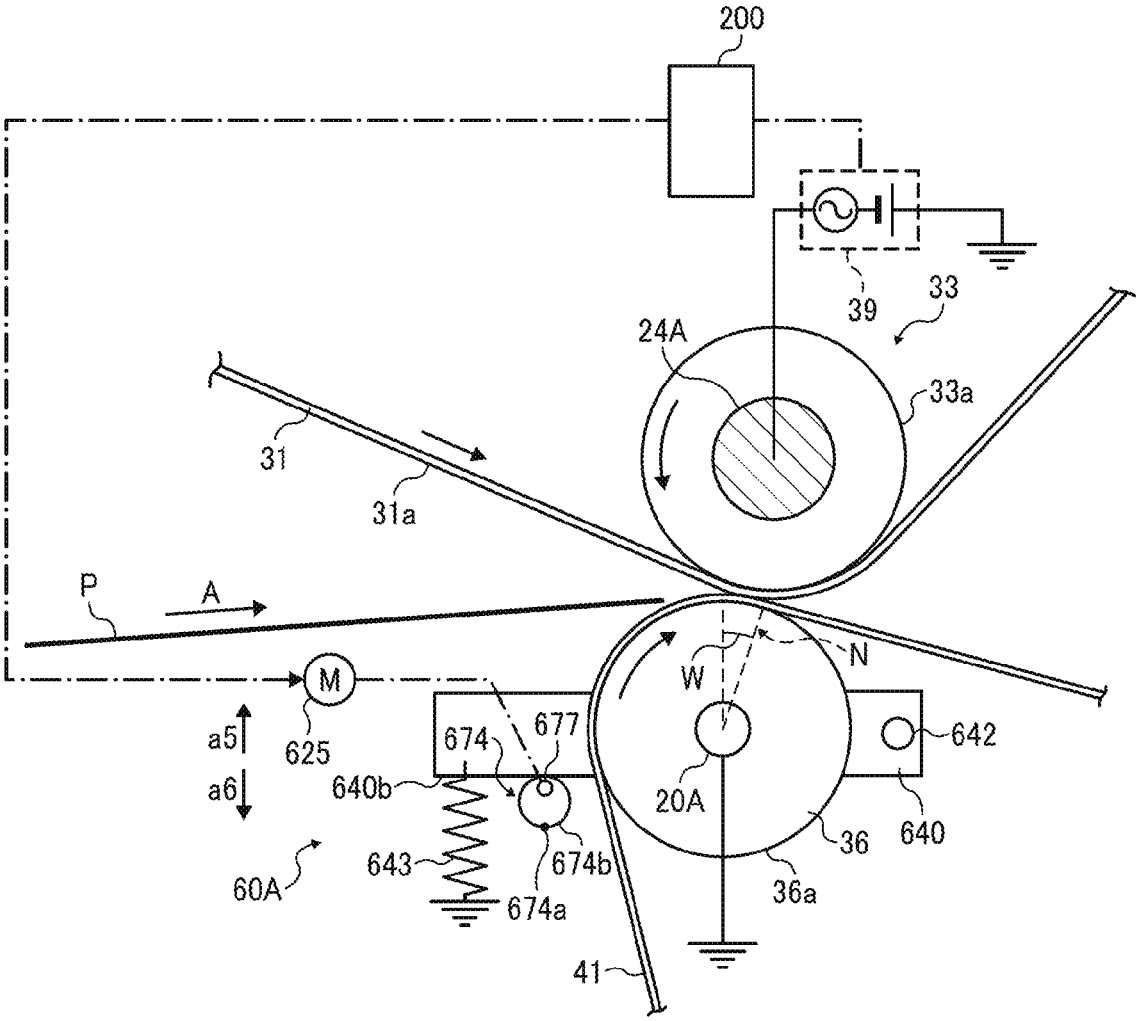
FIG. 20 is an illustration of a schematic configuration of a nip width changing device in the high-duty mode in the image forming apparatus according to a variation of the embodiment of the present disclosure.
Figure 21:
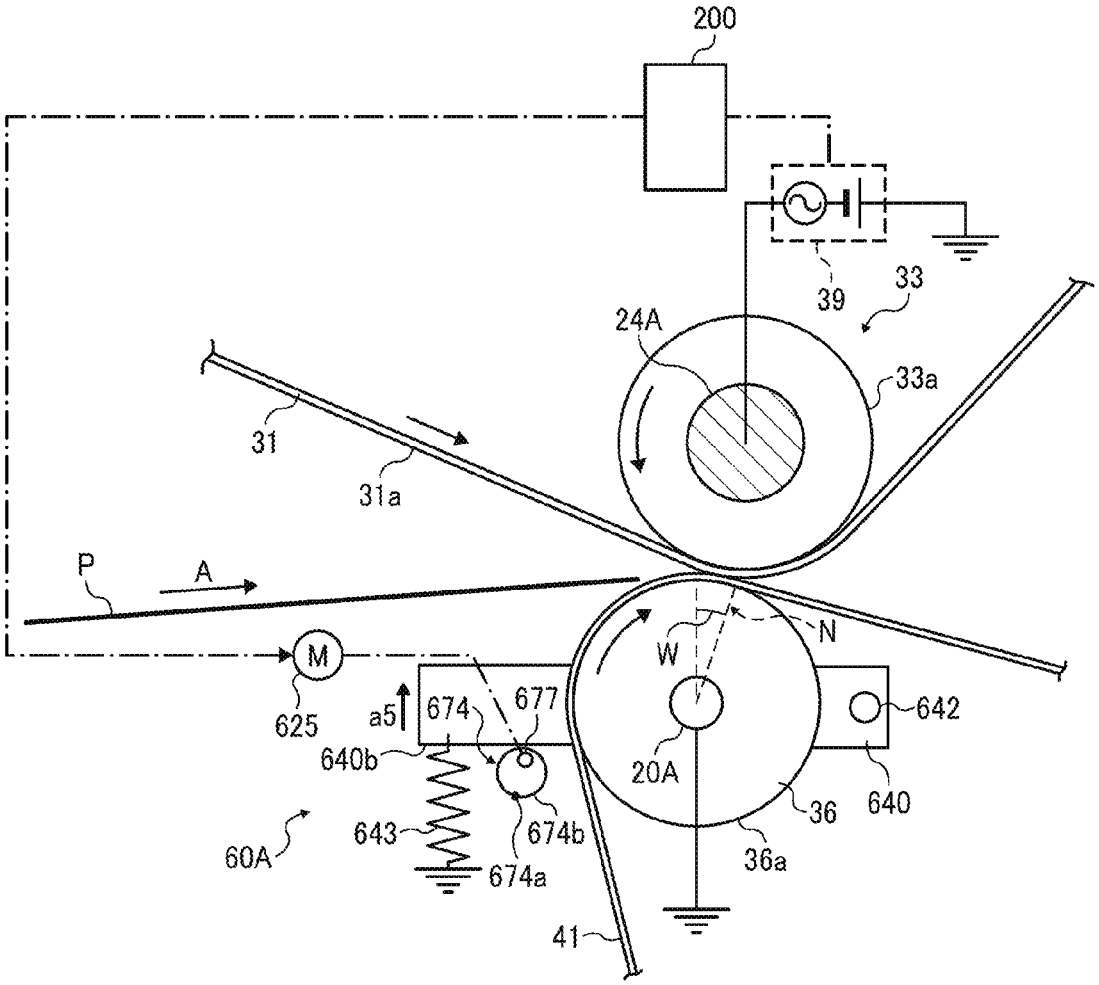
FIG. 21 is an illustration of a schematic configuration of a nip width changing device in the low-duty mode in the image forming apparatus according to the variation of the embodiment of the present disclosure.

As the second method for increasing the pressing force to the secondary-transfer nip N in the low-duty mode to be greater than the pressing force in the high-duty mode, the nip width changing device 60 adjusts the spring force (pressing force) of the coil spring 643 in a range that obtains an appropriate secondary-transfer nip width W in the high-duty mode. In the low-duty mode, the nip width changing device 60 increases the spring force applied to the secondary-transfer nip N. In the second method, the nip width changing device 60A includes the eccentric cam 674 and the drive motor 625 as illustrated in FIGS. 20 and 21. The eccentric cam 674 contacts a lower portion 640*b* of the roller unit holder 640 to shift the position of the roller unit holder 640. The drive motor 625 as a driver drives the eccentric cam 674 to rotate. In the same manner as in the first method, the eccentric cam 674 rotates with the drive shaft 677 driven by the drive motor 625. The eccentric cam 674 has a cam surface on the outer circumferential surface 674*b*. With the cam surface, the distance from the center of rotation to the top dead center 674*a* is the maximum.

In the present embodiment, the drive motor 625 is connected with the controller 200 via a signal line to allow the controller 200 to control the operation of the drive motor 625. Specifically, the controller 200 controls the drive motor 625 to drive the eccentric cam 674 to rotate in a direction to apply the pressing force of the coil spring 643 at a set value to the secondary-transfer nip N without reducing the pressing force in the high-duty mode as illustrated in FIG. 20. In the low-duty mode, the controller 200 controls the drive motor 625 to drive the eccentric cam 674 to rotate in a direction to apply additional force to the spring force of the coil spring 643 as illustrated in FIG. 21.

In FIGS. 20 and 21, arrow a5 represents a direction to increase the pressing force applied to the secondary-transfer nip N, and arrow a6 represents a direction to stop increasing the pressing force applied to the secondary-transfer nip N. In other words, in FIGS. 20 and 21, the direction a5 to increase the pressing force to the secondary-transfer nip N is a direction to allow the eccentric cam 674 to press up the second end (the longitudinal-directional second end) of the roller unit holder 640. The direction a6 to stop increasing the pressing force applied to the secondary-transfer nip N is a direction to lower the second end of the roller unit holder 640.

In the present embodiment, the eccentric cam 674 is positioned (lowered) to prevent increasing the spring force of the coil spring in the high-duty mode as illustrated in FIG. 20. The position of the eccentric cam 674 in the high-duty mode is defined as the home position. In the low-duty mode, the top dead center 674*a* is moved to the lower portion (surface) 640*b* of the roller unit holder 640 to increase the nip width as illustrated in FIG. 21.

In the present embodiment, the drive motor 625 drives the eccentric cam 674 to rotate in a direction to lift up the roller unit holder 640 and increase the pressure applied to the secondary-transfer nip N in the low-duty mode.

Such a configuration can increase the pressure of the secondary-transfer second roller 36 applied to the secondary-transfer nip N in the low-duty mode to be greater than the pressure in the high-duty mode. Thus, the secondary-transfer nip width W in the low-duty mode can be increased. This further allows toner to reciprocate between the intermediate transfer belt 31 and the recording sheet P within the secondary-transfer nip N for sufficient number of times. Thus, the transferability increases.

[Nip Width Changing Device According to Second Embodiment]

The following describes a second embodiment of the nip width changing device 60 to change a transfer-nip width (the secondary-transfer nip width) W.

Figure 22:
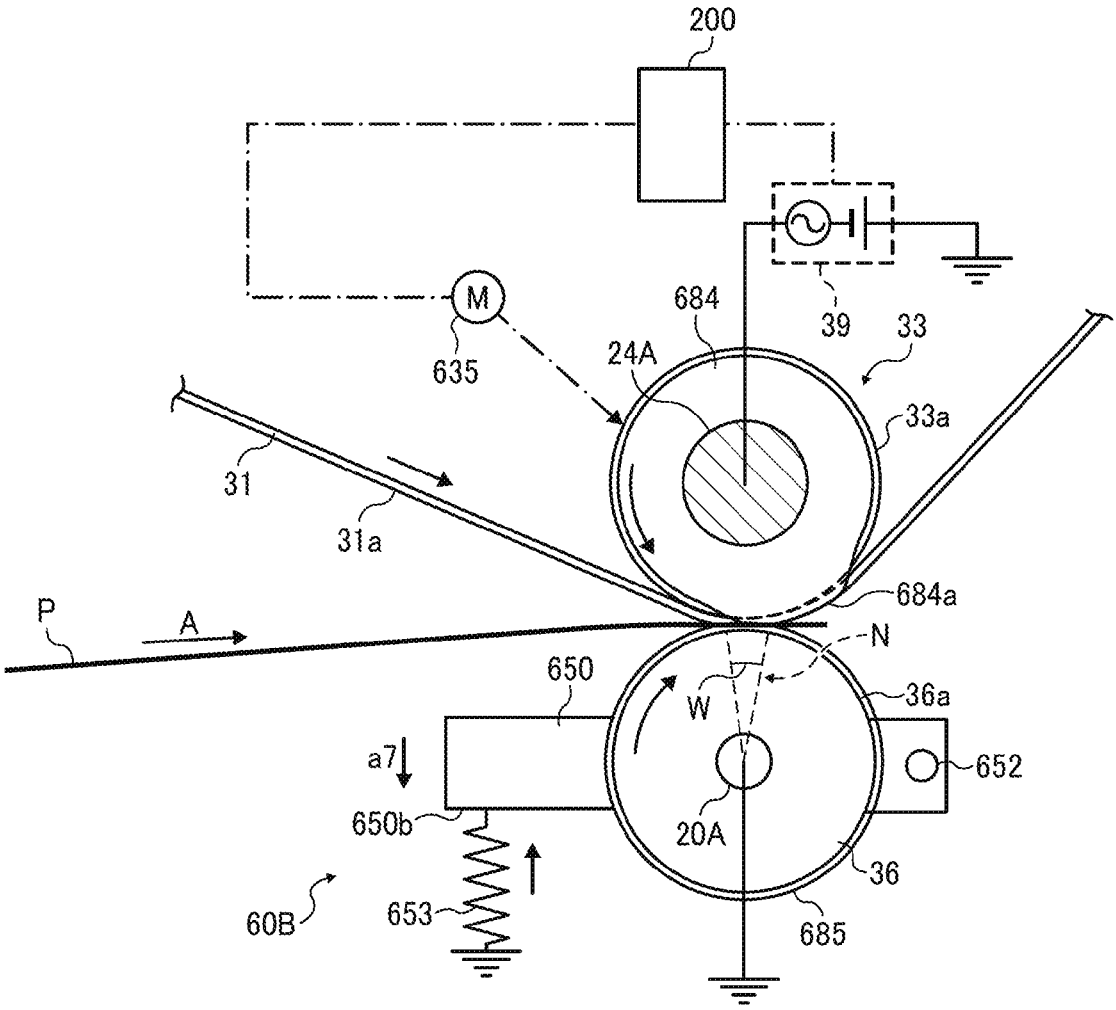
FIG. 22 is an illustration of a schematic configuration of a nip width changing device in the high-duty mode in the image forming apparatus according to another embodiment of the present disclosure.

The nip width changing device 60 according to the second embodiment as illustrated in FIG. 22 changes the pressing force applied to the secondary-transfer nip N between the first mode (the high-smooth mode) and the second mode (the low-smooth mode).

In the present embodiment, the secondary-transfer second roller 36 applies a pressing force against the intermediate transfer belt 31 wound around the secondary-transfer first roller 33 as illustrated in FIG. 22. The secondary-transfer second roller 36 includes a shaft 20A that is rotatably supported by the roller unit holder 650. The roller unit holder 650 has a longitudinal-directional one end pivotably supported by a support shaft 652 relative to a fixing member. The coil spring 653 is disposed between the lower portion 650*b* of the longitudinal-directional second end and the fixing member of the roller unit holder 650. The roller unit holding member 650 is pressed by restoring force of the coil spring 653 to rotate around the support shaft 652 in the counter-clockwise as illustrated in FIG. 22. Accordingly, the secondary-transfer second roller 36 is pressed against the intermediate transfer belt 31, thereby applying the pressing force to the secondary-transfer nip N.

In such a configuration, the image forming apparatus 1000 according to the present embodiment includes the nip width changing device 60B (nip-width variable device) to change the pressing force of the secondary-transfer second roller 36 applied to the secondary-transfer nip N between the low-duty mode and the high-duty mode.

The nip width changing device 60B includes idle rollers 685 and 685, cams 684 and 684, and the drive motor 635, thereby constituting a pressing-force adjuster. The idle rollers 685 and 685 are disposed on both ends of the shaft of the secondary-transfer second roller 36. The cams 684 and 684 are disposed on both ends of the shaft of the secondary-transfer second roller 36. The drive motor 635 as a driver drives the rotation of the each cam 684.

A part of the outer circumferential surface 684*a* of each cam 684 projects beyond the outer circumferential surface 33*a* of the secondary-transfer first roller 33 in a radially outward manner. Each cam 684 is rotatably supported by the shaft 24A to obtain the same phase. The drive motor 635 drives the cams 684 and 684 to rotate while maintaining the same phase. Each idle roller 685 has a greater diameter than the diameter of the secondary-transfer second roller 36, and is pressed against the outer circumferential surface 684*a* of each cam 684 by the pressing force of the coil spring 653.

In the present embodiment, the drive motor 635 is connected with the controller 200 via a signal line to allow the controller 200 to control the operation of the drive motor 635. Specifically, the controller 200 controls the drive motor 635 to drive the cam 684 to rotate in a direction to reduce the pressing force of the coil spring 653 in the high-duty mode as illustrated in FIG. 22. In the low-duty mode, the controller 200 controls the drive motor 635 to drive the cam 684 to rotate in a direction to stop reducing the pressing force of the coil spring 653 as illustrated in FIG. 22. More specifically, in the high-duty mode, the controller 200 controls the drive motor 635 to drive the cam 684 to rotate to a position that allows the projection 684*a* to face the idle roller 685, thereby pressing down the secondary-transfer second roller 36 to reduce the secondary-transfer nip width W as illustrated in FIG. 22. In the low-duty mode, the controller 200 controls the drive motor 635 to drive the cam 684 to rotate to a position that separates the projection 684*a* from the idle roller 685, so that the pressing force of the coil spring 653 presses up the secondary-transfer second roller 36 to increase the secondary-transfer nip width W.

Figure 23:
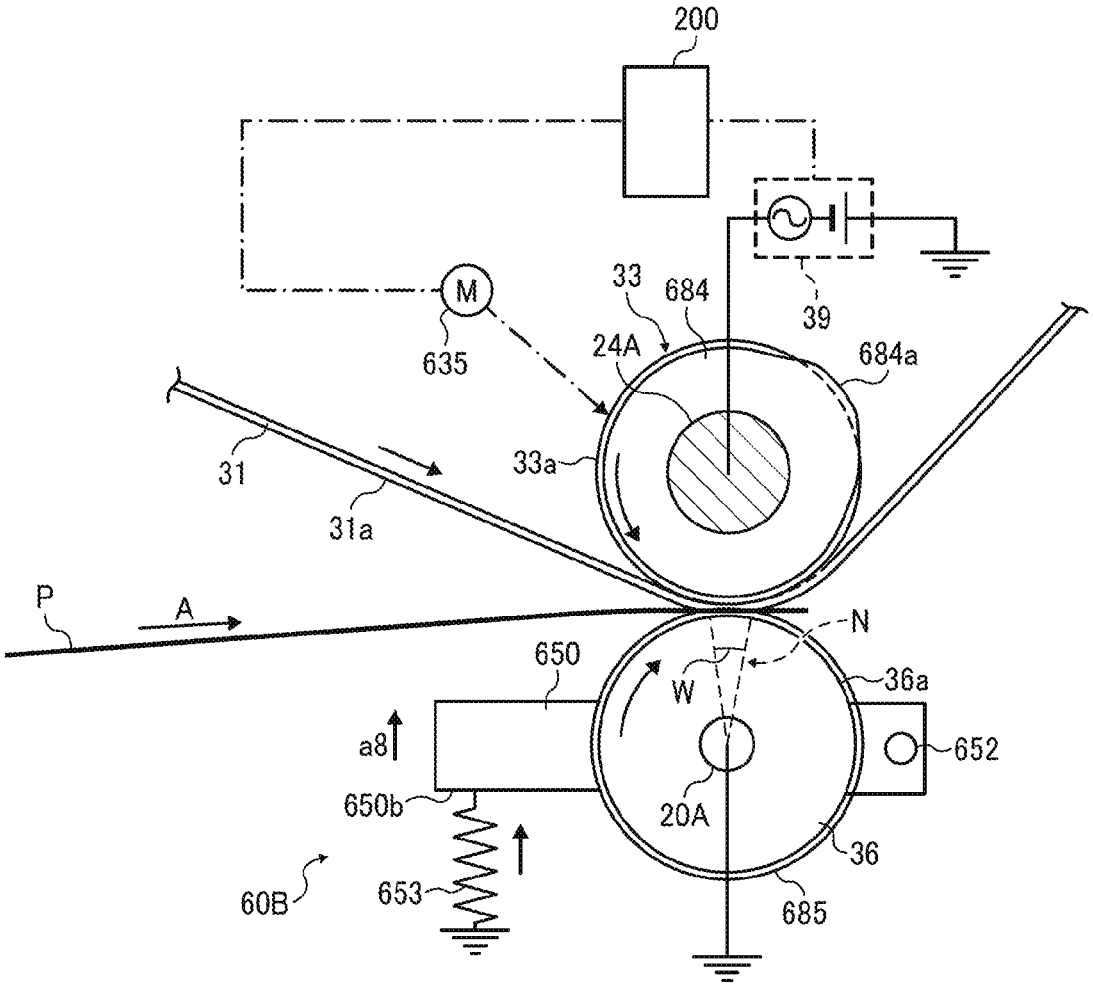
FIG. 23 is an illustration of a schematic configuration of a nip width changing device in the low-duty mode in the image forming apparatus according to another embodiment of the present disclosure.

In FIGS. 22 and 23, arrow a7 represents a direction to reduce the pressing force applied to the secondary-transfer nip N, and arrow a8 represents a direction to stop reducing the pressing force applied to the secondary-transfer nip N. In other words, in FIGS. 22 and 23, the direction a7 to reduce the pressing force to the secondary-transfer nip N is a direction to press down the second end (the longitudinal-directional second end) of the roller unit holder 650. The direction a8 to stop reducing the pressing force to the secondary-transfer nip N is a direction to lift up the second end of the roller unit holder 650.

In the present embodiment, the cam 684 is positioned (lowered) to reduce the spring force of the coil spring in the high-duty mode as illustrated in FIG. 22. The position of the cam 684 in the high-duty mode is the home position. In the low-duty mode, the eccentric cam 684 is moved upward to increase the nip width as illustrated in FIG. 23.

With this configuration according to the present embodiment, the drive motor 635 drives the cam 684 to rotate in a direction to stop reducing the pressing force of the coil spring 653 applied to the secondary-transfer nip N in the low-duty mode. Such a configuration can increase the pressure of the secondary-transfer second roller 36 applied to the secondary-transfer nip N in the low-duty mode to be greater than the pressure in the high-duty mode. Thus, the secondary-transfer nip width W in the low-duty mode can be increased. In the high-duty mode, the controller 200 controls the drive motor 635 to drive the cam 684 to rotate to press down the second end of the roller unit holder 650, thereby reducing the pressure of the secondary-transfer second roller 36 applied to the secondary-transfer nip N in the high-duty mode as compared to the pressure in the low-duty mode.

Further, increasing the secondary-transfer nip width W in the low-duty mode also allows toner to sufficiently reciprocate between the intermediate transfer belt 31 and the recording sheet P in the secondary-transfer nip N, thereby increasing the transferability of toner.

In the high-duty mode, excessively increasing the secondary-transfer nip width W might cause the toner having transferred from the intermediate transfer belt 31 onto the recording sheet P to return (be reversely transferred) to the intermediate transfer belt 31 while the recording sheet P passes through the secondary-transfer nip N, thus reducing the transferability.

In the present embodiment, the transferability significantly decreases due to the reverse transfer of toner in the high-duty mode. In the low-duty mode, the image failure due to the electric discharge significantly occurs. To prevent image failure in each mode, the secondary-transfer nip width W is preferably adjusted. In the present embodiment, the cam 684 is disposed on the side of the secondary-transfer first roller 33 and the idle roller 685 is disposed on the side of the secondary-transfer second roller 36. In some embodiments, the cam 684 may be disposed on the side of the secondary-transfer second roller 36 and the idle roller 685 may be disposed on the side of the secondary-transfer first roller 33.

[Nip Width Changing Device According to Third Embodiment]

The nip width changing device 60 (nip-width variable device) according to a third embodiment changes the hardness of the secondary-transfer second roller 36 as a transfer member to increase the secondary-transfer nip width W between the first mode (high-smooth mode) and the second mode (the low-smooth mode). The secondary-transfer nip N is an area formed by the secondary-transfer first roller 33 contacting the secondary-transfer second roller 36. The secondary-transfer nip N includes a prenip.

To change the hardness of the secondary-transfer second roller 36, for example, the secondary-transfer second roller 36 is manually exchanged for a secondary-transfer second roller 36A having a different hardness from the hardness of the secondary-transfer second roller 36, according to the duty mode, i.e., the high-duty mode or the low-duty mode. In this case, the secondary-transfer second roller 36 is detachable relative to the shaft 20A.

Figure 24:
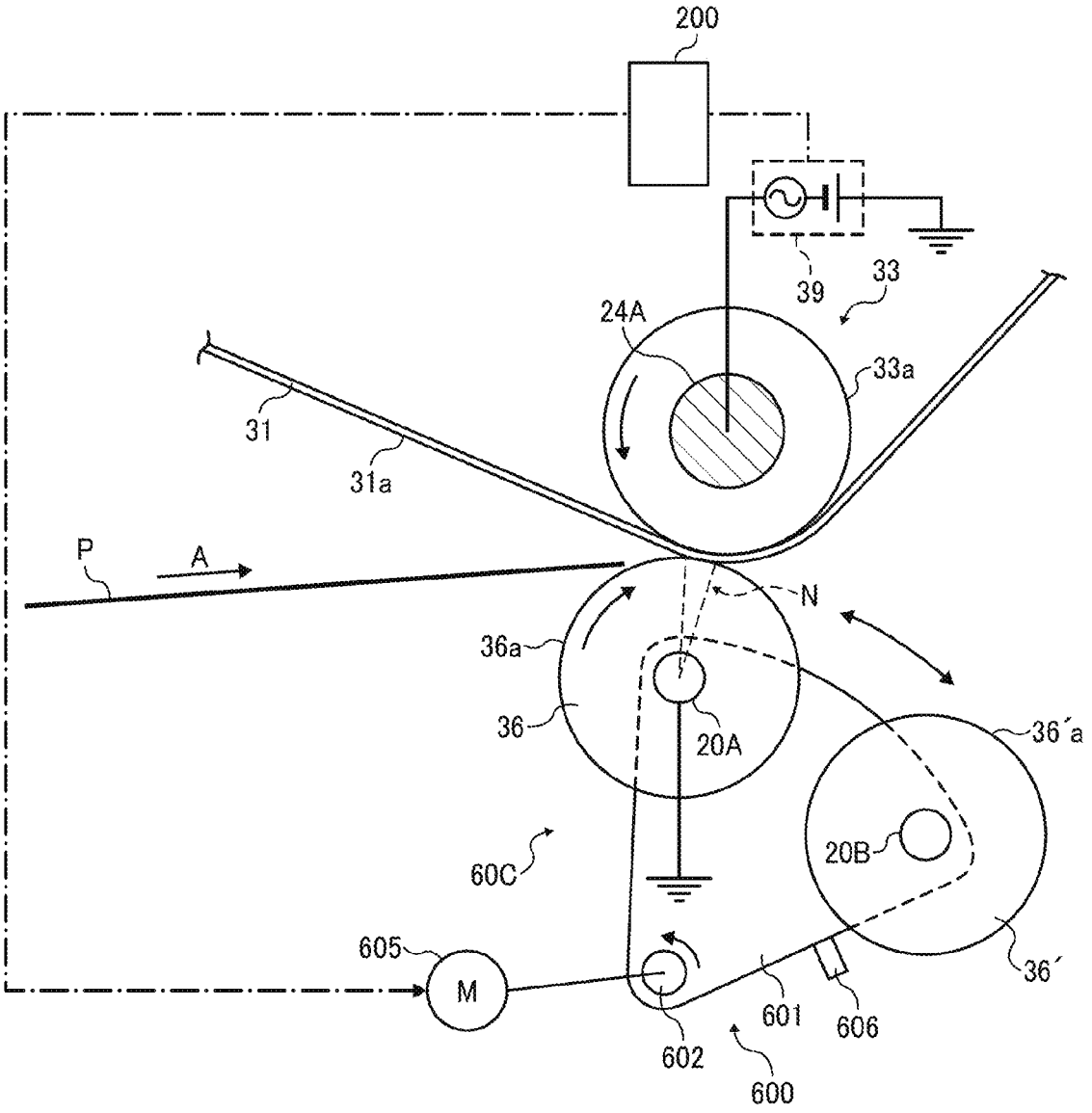
FIG. 24 is an illustration of a schematic configuration of a nip width changing device in the high-duty mode in the image forming apparatus according to even another embodiment of the present disclosure.
Figure 25:
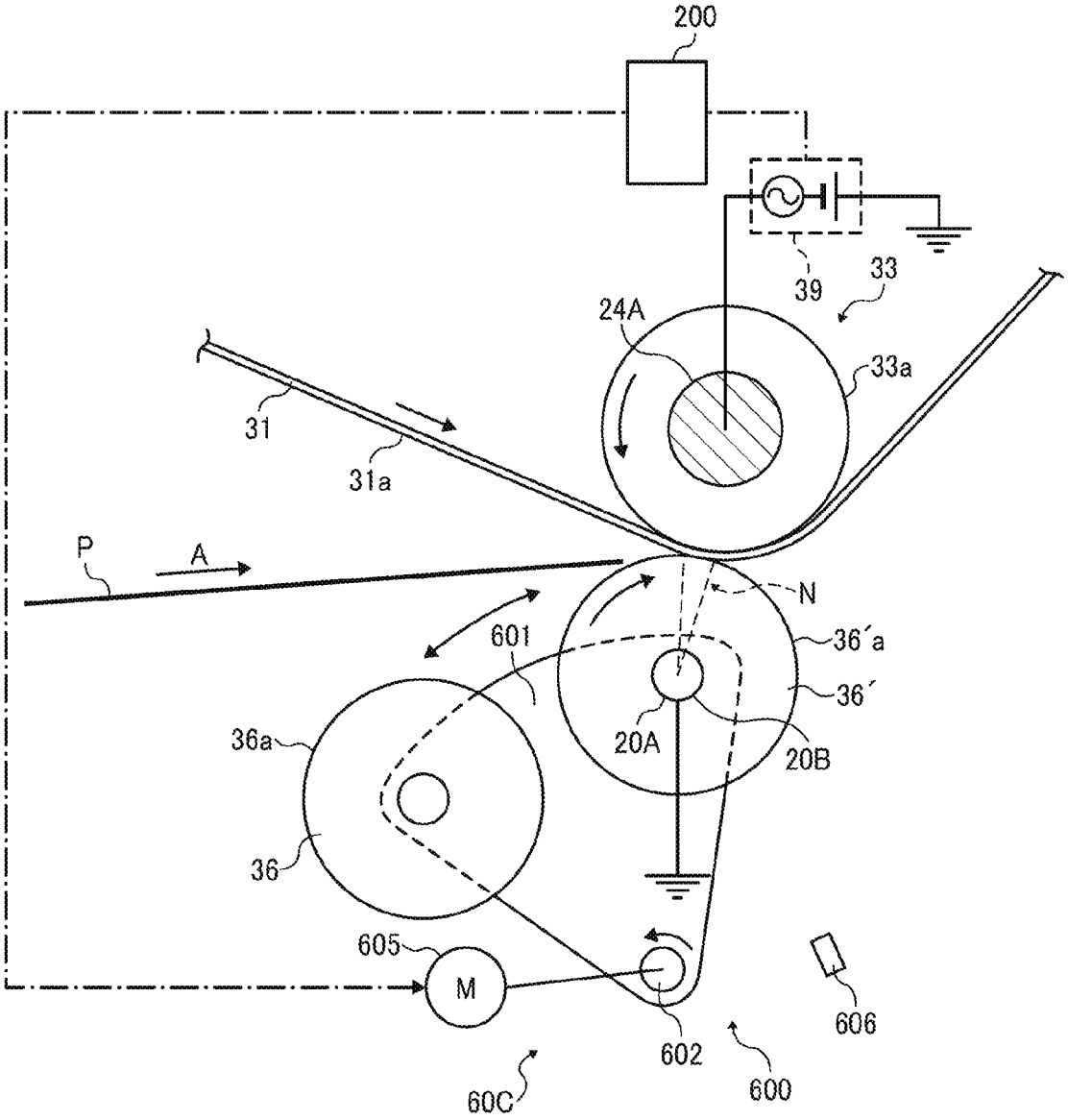
FIG. 25 is an illustration of a schematic configuration of a nip width changing device in the low-duty mode in the image forming apparatus according to still another embodiment of the present disclosure.

Alternatively, as illustrated in FIGS. 24 and 25, a shift device 600 may be employed to shift the positions of the secondary-transfer second roller 36 and the secondary-transfer second roller 36A having different hardnesses, which are disposed in the sheet conveyance unit 38, and the nip width changing device 60C changes the secondary-transfer nip width W. In the present embodiment, the secondary-transfer second roller 36A is made of material with a lower hardness than the material of the secondary-transfer second roller 36, so that the secondary-transfer second roller 36A easily deforms.

The nip width changing device 60C according to the present embodiment includes the shift device 600 that is constructed of a support frame 601 and a drive motor 605. The support frame 601 rotatably supports the secondary-transfer second roller 36 and the secondary-transfer second roller 36A with the shafts 20A and 20B. The drive motor 605 causes the support frame 601 to pivot on a support shaft 602. The shift device 600 includes a stopper 606 to regulate the position of the support frame 601 to hold the secondary-transfer second roller 36 at the position as illustrated in FIG. 24.

In the present embodiment, the drive motor 605 is connected with the controller 200 via a signal line to allow the controller 200 to control the operation of the drive motor 605. More specifically, in the high-duty mode, the controller 200 controls the drive motor 605 to move the secondary-transfer second roller 36 to a position in which the surface 36*a* of the secondary-transfer second roller 36 facing the secondary-transfer first roller 33 is pressed against the front surface 31*a* of the intermediate transfer belt 31, as illustrated in FIG. 24. In the low-duty mode, the controller 200 controls the drive motor 605 to move the secondary-transfer second roller 36A to a position as a nip forming position in which the surface 36Aa of the secondary-transfer second roller 36A facing the secondary-transfer first roller 33 is pressed against the front surface 31*a* of the intermediate transfer belt 31, as illustrated in FIG. 25. This operation is preliminarily stored in the ROM of the controller 200.

In the present embodiment, the nip forming position of the secondary-transfer second roller 36 in the high-duty mode as illustrated in FIG. 24 is the home position. In the low-duty mode, the secondary-transfer second roller 36A having less hardness (softer) than the secondary-transfer second roller 36 moves to the nip forming position as illustrated in FIG. 25.

In other words, in the low-duty mode, the nip width changing device 60C moves the secondary-transfer second roller 36A having less hardness than the secondary-transfer second roller 36 to the nip forming position, so that the secondary-transfer second roller 36 move away from the nip forming position. Thus, the secondary-transfer nip width W can be increased in the low-duty mode.

With the configuration according to the present embodiment, in which the secondary-transfer second roller 36 and the secondary-transfer second roller 36A having different hardnesses are movable, the secondary-transfer nip width W that is the length in the sheet-conveyance direction A of the secondary-transfer nip N can be adjusted. This can increase the secondary-transfer nip width W in the low-duty mode, thereby allowing toner to reciprocate between the intermediate transfer belt 31 and the recording sheet P within the secondary-transfer nip N for sufficient number of times. Thus, the transferability increases.

In the high-duty mode, excessively increasing the secondary-transfer nip width W might cause the toner having transferred from the intermediate transfer belt 31 onto the recording sheet P to return (be reversely transferred) to the intermediate transfer belt 31 while the recording sheet P passes through the secondary-transfer nip N, thus reducing the transferability. In the present embodiment, the transferability significantly decreases due to the reverse transfer of toner in the high-duty mode. In the low-duty mode, the image failure due to the electric discharge significantly occurs. To prevent image failure in each mode, the secondary-transfer nip width W is preferably adjusted.

Next, a description is given of the control of the controller 200.

Figure 26:
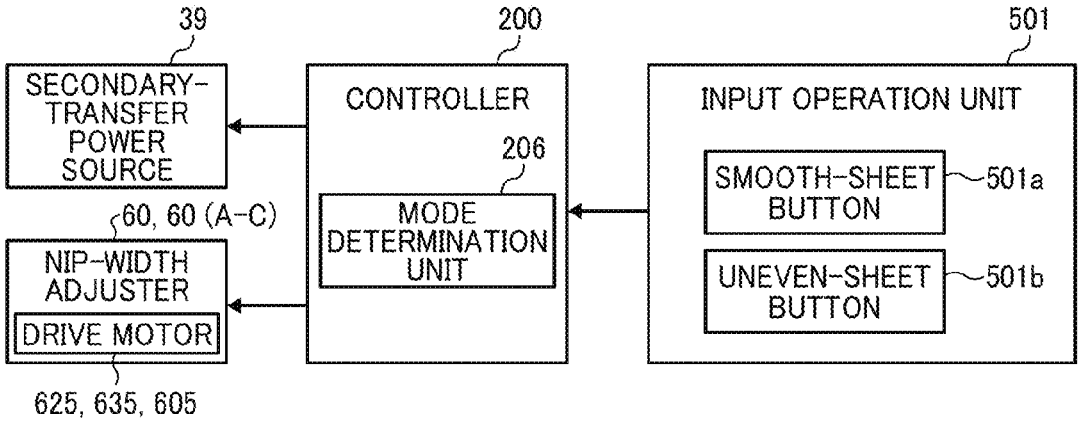
FIG. 26 is a block diagram for describing the configuration of a control system including an input operation unit that includes a recording-sheet selector.

FIG. 26 is a block diagram for describing the configuration of a control system including an input operation unit 51 that includes a recording-sheet selector. As illustrated in FIG. 26, the input operation unit 51 includes a smooth sheet button 501*a* and an uneven-surface sheet button 501*b* as the recording-sheet selector. In the image forming apparatus according to the embodiment, a description is given in the instruction manual for uses to operate as follows. That is, when a highly-smooth sheet having a good surface smoothness, such as a coated sheet, as a recording sheet P is set in the sheet tray 100 of FIG. 1, the smooth sheet button 501*a* is depressed. By contrast, when a low-smooth sheet (uneven-surface sheet) that is inferior in surface smoothness, such as a regular paper or Japanese paper, as a recording sheet P is set in the sheet tray 100, the uneven-surface sheet button 501*b* is depressed. That is, the input operation unit 501 functions as an information acquisition device that acquires the following information. Specifically, the specific information includes information capable of specifying whether a recording sheet P subjected to the secondary transfer of the toner image is a high-smooth sheet having a higher surface smoothness than a low-smooth surface or the low-smooth sheet.

The input operation unit 501 allows selecting the type of the recording sheet P between the high-smooth sheet and the low-smooth sheet, and inputting the selected type of the recording sheet P. The input operation unit 501 is connected to the input side of the controller 200 via a signal line. The input operation unit 501 includes a smooth sheet button 501*a* to select the high-smooth sheet and an uneven-surface sheet button 501*b* to select the uneven-surface sheet that is the low-smooth sheet. With the smooth sheet button 501*a* pressed, the input operation unit 501 outputs information regarding the type of sheet, i.e., the high-smooth sheet to the controller 200. With the uneven-surface sheet button 501*b*, the input operation unit 501 outputs information regarding the sheet type, i.e., the uneven-surface sheet.

The controller 200 includes a mode determination unit 206 to determine whether the mode is the high-smooth mode or the low-smooth mode according to the information regarding the type output by the input operation unit 501. The controller 200 preliminarily determines and stores therein the high-smooth mode to a transfer a toner image onto a high-smooth sheet, and the low-smooth mode to transfer a toner image onto the low-smooth sheet (uneven-surface sheet). In the present embodiment, the high-smooth mode is a mode to apply the transfer bias of the high duty, and is referred to as the high-duty mode (first mode). The low-smooth mode is a mode to apply the transfer bias of the low duty, and is referred to as the low-duty mode (second mode).

The controller 200 switches a transfer mode between a high-smooth mode to secondarily transfer a toner image onto the high-smooth sheet and a low-smooth mode to secondarily transfer a toner image onto the low-smooth sheet based on the information obtained by the input operation unit 501. More specifically, when the smooth sheet button 501*a* is depressed, the power-source controller 200 switches the transfer mode to the high-smooth mode. In the high-smooth mode, the secondary-transfer power source 39 outputs the secondary-transfer bias having the high duty to prevent or reduce the injection of the charges having the opposite polarity into the few-dot toner masses in a secondary transfer of the halftone image onto the high-smooth sheet. In the secondary-transfer bias used in the high-smooth mode, the polarity is constantly negative (is not reversed), and the opposite-peak duty ranges from 70% to 90%.

When the uneven-surface sheet button 501*b* is depressed, the controller 200 switches the transfer mode to the low-smooth mode. In the low-smooth mode, the secondary-transfer power source 39 outputs the secondary-transfer bias having the low duty to secondarily transfer a sufficient amount of toner into the recesses of the uneven surface sheet. The secondary-transfer bias has the following property. The secondary-transfer bias reverses the polarity between the negative polarity and the positive polarity during one cycle T. In the negative polarity, the polarity of the average potential Vave and the polarity of the transfer peak value Vt are negative in which the direction of the electrical field is in the transfer direction. In the positive polarity, the polarity of the opposite-peak value Vr is positive in which the direction of the electrical field is opposite to the transfer direction. In addition, the opposite-peak duty ranges from 8% to 17%.

The controller 200 changes the secondary-transfer nip width W according to information acquired by the input operation unit 501. When the uneven-surface sheet button 501*b* is pressed, the nip width changing device according to any of the above-described embodiments reduces the secondary-transfer nip width W.

In the present embodiment, the secondary-transfer nip width W is adjusted by selecting the uneven-surface sheet button 501*b*. Alternatively, the secondary-transfer nip width W may be reduced as compared to the ordinary width in response to the selection of the smooth sheet button 501*a*. Alternatively, in some embodiments, the nip width changing device according to any of the above-described embodiments may be configured to reduce the nip width Win three steps. When the smooth sheet button 501*a* is pressed, the nip-with adjuster may reduce the nip width W to be smaller than a regular nip width.

That is, the controller 200 controls the nip width changing device 60, 60A, 60B, and 60C to reduce the secondary-transfer nip width W as the duty increases, and increase the secondary-transfer nip width W as the duty decreases. In other words, the controller 200 controls the operation of the drive motors 625, 635, and 605 of the nip width changing devices 60, 60A, 60B, and 60C, respectively to reduce the secondary-transfer nip width W in the high-duty mode, and increase the secondary-transfer nip width W in the low-duty mode.

In the high-smooth mode, the controller 200 controls the transfer power source 39 to output a transfer bias having an opposite-peak duty of greater than or equal to 50% on the side of the opposite-peak value (Vr) to electrostatically move less toner from the intermediate transfer belt 31 onto the sheet conveyance belt 41 than the transfer-peak value (Vr) does. In the low-smooth mode, the controller 200 controls the transfer power source 39 to output a transfer bias having the opposite-peak duty of less than or equal to 50% that is different from that of the high-smooth mode. In the present embodiment, the controller 200 controls the nip width changing device 60, 60A, 60B, and 60C to change the secondary-transfer nip width W between the high-smooth mode (high-duty mode) and the low-smooth mode (low-duty mode).

In other words, the controller 200 controls the nip width changing device 60, 60A, 60B, and 60C to reduce the secondary-transfer nip width W in the high-smooth mode (high-duty mode) to be smaller than the secondary-transfer nip width W in the low-smooth mode (low-duty mode).

Such a configuration, in which the secondary-transfer power source 39 outputs the secondary-transfer bias having the low duty with the use of the low-smooth sheet, such as a regular paper or Japanese paper, as the recording sheet P, exhibits the following effects. The toner particles favorably reciprocate in the secondary transfer nip between the recesses of the recording sheet P and the surface of the intermediate transfer belt 31, thereby transferring a sufficient amount of toner onto the recesses of the recording sheet P, thus preventing or reducing the occurrence of unevenness in image density depending on the uneven surface. Thus, with the opposite-peak duty being low duty, the occurrence of white spots due to the electrical discharge is prevented or reduced.

When the high-smooth sheet, such as a coated paper, is used as a recording sheet, the secondary-transfer power source 39 outputs the secondary-transfer bias having the high duty. This exhibits the following advantageous effects. With the opposite-peak duty being the high duty, the injection of the charges having the opposite polarity into the few-dot toner groups of the halftone image is prevented or reduced, thereby increasing the secondary transferability of the halftone image relative to the smooth sheet. This configuration can prevent insufficient image density of a halftone image, thus preventing the secondary transfer failure in an output image.

Note that, the case in which the secondary-transfer bias having the high duty is used in the high-smooth mode and the secondary-transfer bias having the low duty is used in the low-smooth mode is described above. Alternatively, the following case is available. The secondary-transfer bias having the opposite-peak duty of 50% is used in the high-smooth mode and the secondary-transfer bias having the low duty in the low-smooth mode. Alternatively, the secondary-transfer bias having the high duty is used in the high-smooth mode and the secondary-transfer bias having the opposite-peak duty of 50% in the low-smooth mode.

[First Variation in the First Embodiment]

In the image forming apparatus 1000 according to a first variation of the first embodiment, the input operation unit 105 does not include the smooth sheet button 501*a* and the uneven-surface sheet button 501*b*. The image forming apparatus 1000 is not designed to allow a user to input information regarding the surface smoothness of the recording sheet P. Instead, the image forming apparatus 1000 according to the first variation includes a sheet-type sensor as a smoothness sensor 502 to detect the surface smoothness (unevenness) of the recording sheet P. The sheet-type sensor (a smoothness sensor 502) employs a reflective optical sensor that emits light to the recording sheet P and receives the reflectance of the light reflected by the recording sheet P to detect the sheet type (unevenness degree) of the recording sheet P.

Figure 27:
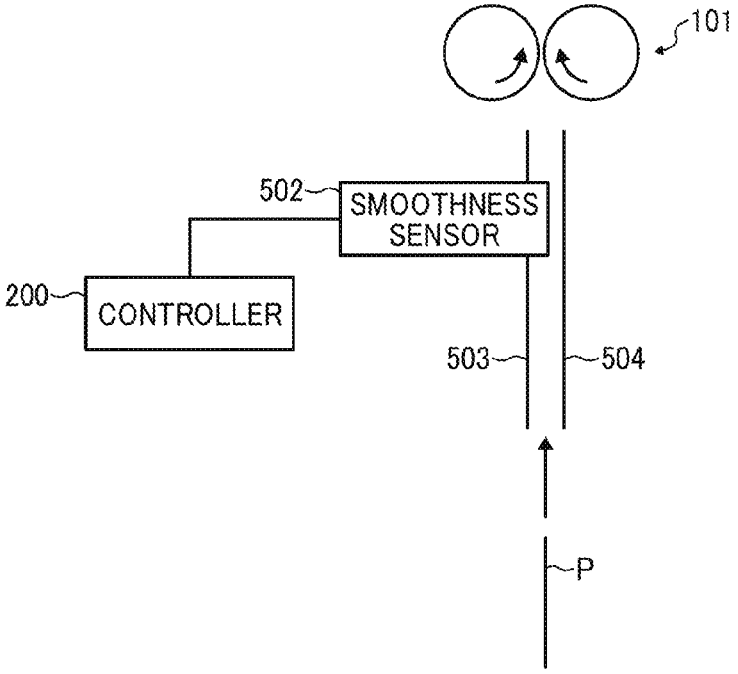
FIG. 27 is a schematic view of a feeding path of the image forming apparatus according to a variation of one embodiment of the present disclosure.

FIG. 27 is a schematic view of a feeding path F of the image forming apparatus 1000 according to the first variation. The feeding path F guides a recording sheet P interposed between a first guide plate 503 and a second guide plate 504 to a registration nip of the registration rollers 101. The first guide plate 503 includes a through hole in which a smooth sensor is disposed. The smoothness sensor 502 emits light emitted from a light emitting element toward a recording sheet P in the feeding path and receives the light totally reflected from the surface of the recording sheet P with a light receiving element. The amount of totally-reflected light that is obtained by the surface of the smooth sheet, such as a coated sheet, is greater than the amount of totally-reflected light that is obtained by the surface of the uneven surface sheet, such as Japanese paper.

The smooth sensor 502 is electrically connected with the input of the controller 200 via a signal line. The controller 200 calibrates the smoothness sensor 502 in a start up of the image forming apparatus 1000 immediately after the main power source of the image forming apparatus 1000 turned on. More specifically, the power-source controller 200 adjusts the amount of light emission (supply voltage) of the light emitting elements to obtain a predetermined amount of totally-reflected light in a state that the light emitting elements emit light and the emitted light is reflected by the surface of the second guide plate 504 that is white colored. In this case, a supply voltage value is preliminarily stored in a memory. The smoothness sensor 502 supplies a voltage with the same value as the supply voltage value preliminarily stored in the memory to the light emitting elements to detect the amount of totally-reflected light on the surface of the recording sheet P.

When a print job is started, the recording sheet P fed out from the sheet tray 100 at a predetermined timing comes in contact with the registration nip of the registration rollers 101 that is not driven, and thereby the conveyance of the sheet is stopped for skew adjustment. In such case, the recording sheet P faces the smoothness sensor 502 in the feeding path F. In this state, the power-source controller 200 causes the smoothness sensor 502 to detect the amount of totally-reflected light on the surface of the recording sheet P The smoothness sensor 502 is connected to the controller 200. When the detection result exceeds a threshold value, the determination unit 206 determines that the recording sheet P is a smooth sheet and thereby performs the above-described high-smooth mode. When the detection result fails to exceed the threshold value, the determination unit 206 determines that the recording sheet P is an uneven surface sheet and thereby performs the above-described low-smooth mode. In other words, the determination unit 206 determines the high-smooth mode (the high-duty mode) or the low-smooth mode (the low-duty mode) based on the detection results of the sheet-type sensor (a smoothness sensor) 502.

In such a configuration, the power-source controller 200 automatically obtains information regarding whether the recording sheet P to be conveyed to the secondary-transfer nip N is the smooth sheet (high-smooth sheet) or the uneven surface sheet (low-smooth sheet) without any operation of a user, thus increasing the operability of users.

[Second Variation in First Embodiment]

Figure 28:
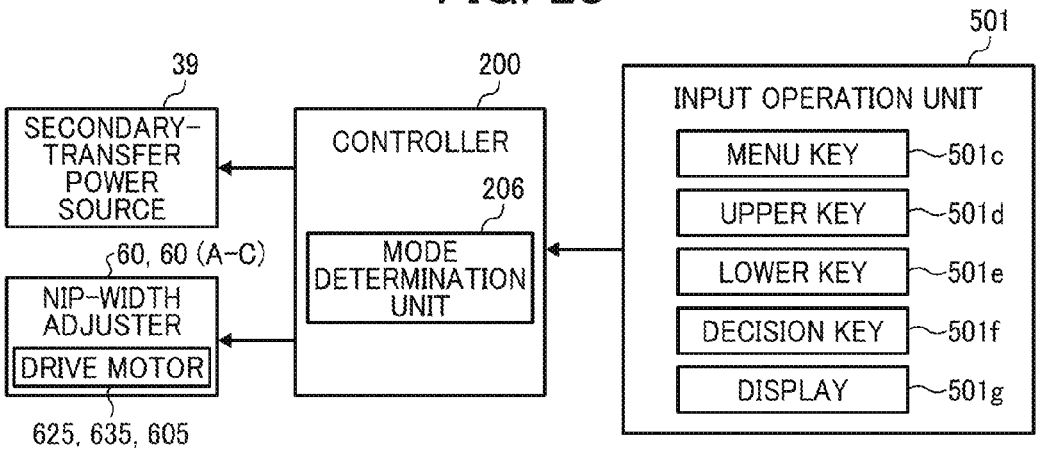
FIG. 28 is a block diagram of the configuration according to another variation of one embodiment of the present disclosure.
Figure 29:
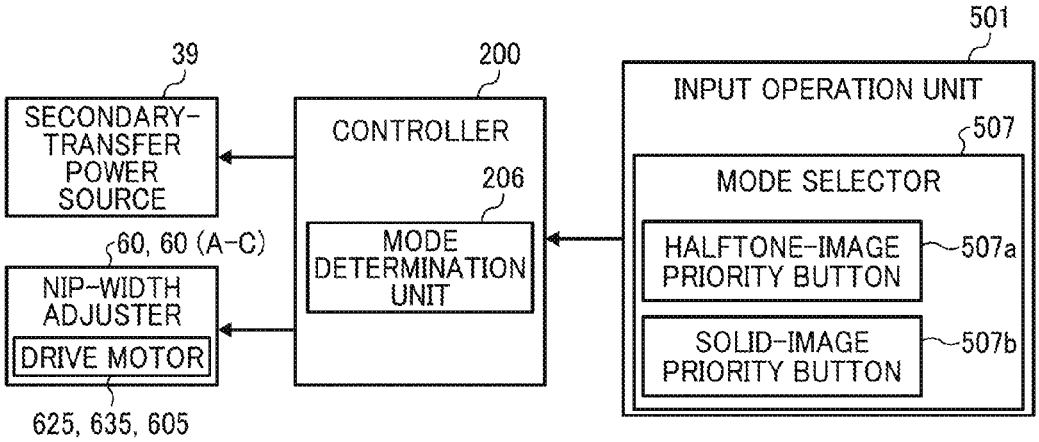
FIG. 29 is a block diagram of the configuration according to another embodiment of the present disclosure.

FIG. 28 is a block diagram of electrical circuitry of an input operation unit 501 of the image forming apparatus according to variation 2 of the present disclosure. The input operation unit 105 does not include the smooth sheet button 501*a* and the uneven-surface sheet button 501*b* unlike in the above-described embodiment. Instead, the input operation unit 105 includes a menu key 501*c*, an upper key 501*d*, a lower key 501*e*, a decision key 501*f*, and a display 501*g*.

When a user presses the menu key 501*c*, the controller 200 allows the display 501*g* to display a menu screen. The user operates the upper key 501*d* or the lower key 501*e* to align a cursor on a desired menu among a plurality of menus displayed in the menu screen and press the decision key 501*f* so as to select the menu. When the user selects the "Input Type of Sheet" menu through the operation of keys, the controller 200 allows the display 501*g* to display a list of sheet brands. The user may select, through the operation of the upper key 501*d* and the lower key 501*e*, the same brand as the brand of the recording sheet that is set in the sheet tray 100 among a plurality of brands included in the list. The brand and the surface smoothness of the recording sheet that belongs to the brand have one-to-one relation between each other. Thus, the brand serves as information that represents the surface smoothness. The menu key 501*c*, the upper key 501*d*, the lower key 501*e*, and a decision key 501*f* constitute a brand input unit.

The controller 200 stores, in a read only memory (ROM) as a data memory, a data table in which the brands and the numerical values of the opposite-peak duty are associated with each other. The numerical values of the opposite-peak duty that represent high duty are set for the brand of the smooth sheet. The numerical values of the opposite-peak duty that represent low duty are set for the brand of the uneven surface sheet. In terms of the brand of the uneven surface sheet, with an increase in degree of unevenness of the uneven surface sheet, the numerical value of the opposite-peak duty decreases.

When the user selects a brand through the operation of the menu, the controller 200 identifies, from the data table, the numerical value of the opposite-peak duty corresponding to the brand. Then, the main controller sends the result to the controller 200. The power-source controller 200 having received the numerical value of the opposite-peak duty from the main controller controls the secondary-transfer power source 39 to output the secondary-transfer bias having the same numerical value of the opposite-peak duty as the numerical value sent from the main controller. Accordingly, when the brand of the smooth sheet is selected, the power-source controller 200 performs the high-smooth mode. When the brand of the uneven surface sheet is selected, the power-source controller 200 performs the low-smooth mode.

The input end of the controller 200 is connected with the upper key 501*d* and the lower key 501*e* as the brand input unit via a signal line. The controller 200 includes controls the secondary-transfer power source 39 to reduce the opposite-peak duty of the transfer bias in the low-smooth mode with an increase in surface unevenness of recording sheet according to brand information input by the upper key 501*d* and the lower key 501*e*.

Such a configuration increases the secondary-transfer efficiency of the halftone image relative to the protrusions of the uneven surface sheet or increases the amount of toner transferred to the recesses of the uneven surface sheet in the low-smooth mode, as compared to the case in which the value of the opposite-peak duty is constant. More specifically, with uneven surface sheet, with a reduction in degree of unevenness of the uneven surface sheet, the area of protrusion increases, thereby increasing the possibility of injecting the charges having the opposite polarity into the few-dot toner masses in the halftone image in the protrusions of the uneven surface sheet. With an increase in degree of unevenness of the uneven surface sheet, the degree (size and depth) of recess in the uneven surface increases, and thereby the transfer failure of toner relative to the recesses of the uneven surface is more likely to occur. To handle such a circumstance, with an increase in degree of unevenness of the uneven surface sheet, the value of the opposite-peak duty is reduced. This allows transferring a sufficient amount of toner onto the recesses of the uneven surface sheet having a relatively high degree of unevenness of the uneven surface sheet. In addition, a halftone image is secondarily transferred onto the protrusions of the uneven surface sheet having a relatively low degree of unevenness in the uneven surface sheet in a successful manner.

Note that the maximum unevenness difference may be used as an index that represents the degree of the sheet surface unevenness. In addition, examples of a commercially available device of the measurement device that measures the degree of unevenness include "SURFCOM 1400D" (manufactured by TOKYO SEIMITSU CO., LTD.). In the measurement device, five sites in the entire region of a surface are randomly selected as a region to be inspected on the basis of an image that is obtained by photographing the surface of a recording sheet with a microscope. With respect to the respective sites, the maximum cross-sectional height (Pt) (JIS B 0601: 2001) of a cross-sectional curve is measured under conditions in which an evaluation length is set to 20 mm and a reference length is set to 20 mm. In addition, an average value of top three heights among five maximum cross-sectional heights Pt, which are obtained, is obtained. The above-described processes are performed with respect to each of the front end portion, the central portion, and the rear end portion of the recording sheet P, and an average of respective average values is obtained as the maximum unevenness difference. For example, a recording sheet P of which the maximum unevenness difference (specific information) is 50 μm or greater may be specified as an uneven surface sheet (low-smooth sheet), and a recording sheet P of which the maximum unevenness difference is less than 50 μm may be specified as a recording sheet having a smooth surface (high-smooth sheet).

As described above, the image forming apparatus 1000 according to the present embodiment includes the intermediate transfer belt 31, the secondary-transfer belt 41 to form a secondary-transfer nip N between the intermediate transfer belt 31 and the secondary-transfer belt 41, the nip width changing device 60 to change the secondary-transfer nip width W, and the secondary-transfer power source 39 to output the secondary-transfer bias including the AC component to transfer a toner image from the intermediate transfer belt 31 onto the recording sheet P. The image forming apparatus 1000 further includes the controller 200 to change between the first mode, in which the secondary-transfer bias has a first duty higher than a second duty and the secondary-transfer nip width W is a first width smaller than a second width, and the second mode, in which the secondary-transfer bias has the second duty and the secondary transfer nip width W is the second width according to the type of the recording sheet P. The controller 200 executes the first mode when the recording sheet P is a smooth sheet, and executes the second mode when the recording sheet P is an uneven-surface sheet having a greater surface unevenness than the smooth sheet does. Note that the first duty is the high duty of greater than 50%, and the second duty is the low duty of lower than 50%. The image forming apparatus 1000 according to the present embodiment can increase the transferability of toner onto the uneven-surface sheet, and prevent image failure due to the electric discharge on the smooth sheet. The image forming apparatus 1000 according to the present embodiment can also prevent the transfer failure of toner images relative to the recording sheet P, and allows transferring a sufficient amount of toner onto the recording sheet P.

Second Embodiment

The image forming apparatus 1000 according to the present embodiment includes a mode selector 507 to select between a halftone-image priority mode to give a higher priority to image quality of a halftone image than to image quality of a solid image among images of a toner image, and a solid-image priority mode to give a higher priority to image quality of a solid image than image quality of a halftone image.

The controller 200 performs the first mode (the high-duty mode) with the halftone-image priority mode selected by the mode selector 507, and performs the second mode (the low-duty mode) with the solid-image mode selected by the mode selector 507. In the same manner as in the first embodiment, the duty in the first mode is greater than the duty in the second mode, and the secondary-transfer nip width W in the first mode is greater than the secondary-transfer nip width W in the second mode. Note that the manners in which the controller 200 controls duty and the secondary-transfer nip width W are the same as in the first embodiment.

In the present embodiment, the controller 200 changes the duty and the transfer-nip width W according to either one of the halftone-image priority mode and the solid-image priority mode selected by the mode selector 507.

The prevent inventors have performed the experiment in which an image is transferred onto plain paper, e.g., Hammer Mill color copy digital. As a result, transfer failure occurred in the halftone image area because of injection of charges of the opposite polarity to toner, and transfer failure, such as surface roughness, occurred in the solid image area. The reason for the occurrence of the transfer failure in the halftone image is the same as described in the first embodiment. The "surface roughness" in the solid image refers to uneven image density that appears in conformity of a small degree of surface unevenness of a recording sheet P. The uneven image density is considered to be caused by the difference in transfer electric field between the recesses and the protrusions of the uneven surface of the recording sheet P. To prevent such a transfer failure, the image forming apparatus 1000 according to the present embodiment changes between the first mode and the second mode as follows.

The mode selector 507 is connected with the input of the controller 200. The mode selector 507 according to the present embodiment allows a user to select a priority mode between a halftone-image priority mode to give a higher priority to image quality of a halftone image than to image quality of a solid image among images of a toner image, and a solid-image priority mode to give a higher priority to image quality of a solid image than image quality of a halftone image. The mode selector 507 includes the halftone-image priority button 507*a* to give a higher priority to image quality of a halftone image than to image quality of a solid image among images of a toner image, and the solid-image priority button 507*b* to give a higher priority to image quality of a solid image than image quality of a halftone image. The mode determination unit 206 of the controller 200 determines whether the priority mode selected by user using the mode determination unit 206 is the halftone-image priority mode or the solid-image priority mode.

The ROM of the controller 200 preliminarily stores set values of the secondary-transfer bias and the secondary-transfer nip width for each of the halftone-image priority mode and the solid-image priority mode selected.

In the halftone-image priority mode, the controller 200 controls the secondary-transfer power source 39 to output the transfer bias having the high duty of greater than 50% in the high-smooth mode. In the solid-image priority mode, the controller 200 controls the secondary-transfer power source 39 to output the transfer bias having the low duty of less than 50%.

When the halftone-image priority mode is selected, the controller 200 controls the nip width changing device 60, 60A, 60B, and 60C to reduce the secondary-transfer nip width W in the halftone-image priority mode to be smaller than the secondary-transfer nip width W in the solid-image priority mode.

The controller 200 controls the mode determination unit 206 to determine the mode (either one of the halftone-image priority mode and the solid-image priority mode) selected by the mode selector 507, and further performs either one of the first mode and the second mode according to the selected mode.

In the halftone-image priority mode, the controller 200 performs the first mode to reduce the transfer-nip width W and output the secondary-transfer bias having the high duty as illustrated in FIGS. 13 through 17. This configuration prevents or reduces the injection of the charges having the opposite polarity into the few-dot toner groups of the halftone image in the transfer nip N, thereby increasing the secondary transferability of the halftone image relative to the recording sheet P. Thus, insufficient image density of a halftone image, i.e., the occurrence of the transfer failure can be prevented.

In the solid-image priority mode, the controller 200 performs the second mode to increase the transfer-nip width W and output the secondary-transfer bias having the low duty as illustrated in FIGS. 10 through 12. Using the low-duty transfer bias allows toner particles to reciprocally move between the recesses of the recording sheet P (plain paper) and the intermediate transfer belt 31, increasing the number of the toner particles to be transferred from the intermediate transfer belt 31 onto the recesses of the recording sheet P as the number of reciprocative movement of the toner particles increases. This allows a sufficient amount of toner to be transferred into the recesses of the recording sheet P, thus preventing the uneven image density (surface roughness) that appears in depending on the small surface unevenness of the recording sheet P. Further, using the low-duty transfer bias can prevent or reduce more white spots due to electric discharge than any type of transfer bias except for the low-duty transfer bias does. Increasing the transfer-nip width W to be greater than the transfer-nip width W in the first mode can increase the number of reciprocative movement of toner particles within the secondary-transfer nip N, thereby further preventing the appearance of uneven image density, i.e., surface roughness.

The configuration according to the second embodiment allows obtaining a desired image quality in a simple manner in which the mode selector 507 is used to select the mode. That is, the configuration according to the second embodiment allows obtaining a desired image quality by selecting either one of the halftone-image priority mode and the solid-image priority mode.

Note that, the case in which the secondary-transfer bias having the high duty is used in the first mode and the secondary-transfer bias having the low duty is used in the second mode is described above. Alternatively, the following case is available. The secondary-transfer bias having the opposite-peak duty of 50% is used in the first mode and the secondary-transfer bias having the low duty in the second mode. The secondary-transfer bias having the high duty is used in the first mode and the secondary-transfer bias having the opposite-peak duty of 50% is used in the second mode.

Instead of the configuration that employs the mode selector 507 to select and perform either one of the first mode and the second mode according to the selected mode, in some embodiments, the controller 200 may calculate image density of an image to be output, and perform either one of the first mode and the second mode according to the calculated image density. The controller 200 changes between the first mode and the second mode according to the density of a toner image. More specifically, the controller 200 performs the first mode when the image density (image area rate, or amount of toner included in an image) is less than a predetermined value. The controller 200 performs the second mode when the image density is greater than or equal to the predetermined value. Such a configuration can prevent the occurrence of transfer failure in a simple manner. In some embodiments, the controller 200 may calculate image density for each recording sheet P to which an image is to be transferred, and perform either one of the first mode and the second mode. This configuration facilitates controlling the secondary-transfer power source 39 and the nip width changing device 60. In some embodiments, the controller 200 may divide one recording sheet P into a plurality of regions in the direction of conveyance and calculate image density for each region, thus performing either one of the first region segmentation and the second mode relative to each region. This configuration can reliably prevent the occurrence of transfer failure.

[Experimental Results]

The following Tables 1-1 through 1-5 indicate the results of the experiment performed by the present inventors to confirm the advantageous of the first embodiment and the second embodiment, followed by the detailed description of the experimental results.

The Hammer Mill color copy digital was used as a recording sheet P.

The image forming speed (linear speed) was set 352.8 millimeter (mm)/seconds (sec).

The secondary-transfer bias having the high duty of 85% and the secondary-transfer bias having the low duty of 12% were used.

The transfer-nip width was set approximately 4.5 mm for large size and approximately 3 mm for small size in the high duty mode.

Table 1-1 represents image quality for each type of the secondary-transfer bias relative to the Hammer Mill color copy digital.

TABLE 1-1

| SHEET TYPE | HammerMill color copy digital | | | | | |
|---|---|---|---|---|---|---|
| APPLIED BIAS | DC | | High Duty | | Low Duty | |
| SECONDARY-TRANSFER NIP WIDTH [mm] | Small | Large | Small | Large | Small | Large |
| SURFACE ROUGHNESS | Grade 3.5 | Grade 3.5 | Grade 3.5 | Grade 3.5 | Grade 4 | Grade 5 |
| TRANSFERABILITY IN SMOOTH PORTION | 85% | 85% | 95% | 90% | 85% | 85% |
| MICRO-RUBBER HARDNESS OF BELT | 80 | 80 | 80 | 80 | 80 | 80 |

Although the Hammer Mill color copy digital represented in Table 1-1 is typical copying paper, the surface roughness and reduction in transferability of halftone image in a smooth-surface area are some times impermissible. Even with such a recording sheet, using the high-duty transfer bias with a reduced secondary-transfer nip width W can increase the transferability of halftone image.

The surface roughness, especially surface roughness in the solid image can be reduced by using the low-duty transfer bias, and can be further reduced or prevented by increasing the secondary-transfer nip width W.

TABLE 1-2

| EXPERIMENT CONDITIONS/ TEST NUMBER | | | 1 | 2 | 3 | 4 | 5 | |
|---|---|---|---|---|---|---|---|---|
| SHEET | UNEVEN-SURFACE SHEET | LEATHAC 66 260 kg | LOW DUTY RANK 4 | LOW DUTY RANK 5 | LOW DUTY RANK 5 | LOW DUTY RANK 5 | LOW DUTY RANK 5 | BIAS Transferability in Surface Recesses |
| | | LEATHAC 66 215 kg | LOW DUTY RANK 5 | LOW DUTY RANK 5 | LOW DUTY RANK 5 | LOW DUTY RANK 5 | LOW DUTY RANK 5 | BIAS Transferability in Surface Recesses |
| | | LEATHAC 66 175 kg | LOW DUTY RANK 5 | LOW DUTY RANK 5 | LOW DUTY RANK 5 | LOW DUTY RANK 5 | LOW DUTY RANK 5 | BIAS Transferability in Surface Recesses |
| | SMOOTH SHEET | OK Top Coat | HIGH DUTY 90% | HIGH DUTY 75% | HIGH DUTY 60% | HIGH DUTY 50% | DC ONLY 10% | BIAS Halftone Transferability |
| MICRO-RUBBER HARDNESS OF BELT | | | 80 | 60 | 50 | 40 | 40 | |
| SECONDARY-TRANSFER NIP WIDTH [mm] | | | 3 | 3 | 3 | 3 | 3 | |

In Tables 1-2 through 1-5, LEATHAC 66 (registered trademark) is an uneven surface sheet manufactured by TOKUSHU TOKAI PAPER CO., LTD., having a greater degree of recess in the uneven surface with an increase in basis weight. That is, the degree of recess in the uneven surface decreases in order of the basis weights of 260 kg, 215 kg, and 175 kg. The OK Top Coat having a weight of 128 gsm is a coated surface sheet (smooth sheet) manufactured by Oji paper Co., Ltd.

In the present experiment, a blue solid image in which magenta and cyan colors are superimposed was secondarily transferred onto an uneven surface sheet, and a black halftone image (2 by 2) was secondarily transferred onto a smooth sheet. Tables 1-3 through 1-5 represent numerical values (%) in the smooth sheet section, which indicate the transferability in halftone image.

In Tables 1-2 through 1-5, the transferability in the recesses refers to the transferability of toner relative to the recesses of the surface of the uneven surface sheet. The transferability in the recesses was evaluated based on the image quality in the recesses of the surface of the uneven surface sheet. The transferability is evaluated on 5-point scales ranging from 1 through 5 in which grade 5 is the highest. More specifically, the case in which a sufficient amount of toner is transferred onto the recesses of the surface and no difference in image quality is recognized between the recesses and the protrusions of the surface is evaluated as grade 5. Grade 4 is assigned for the case in which color-tone failure is recognized due to a slight reduction in amount of either one of magenta toner and cyan toner transferred to two through three recesses having the greatest depth among the plurality of recesses in the uneven surface, as compared to amount of the other one of magenta toner and cyan toner transferred thereto. Grade 3 is assigned for the case in which a white void is recognized in the two through three recesses having greater degrees of recess. The case in which white voids are scattered over the plurality of recesses is evaluated as grade 2 (such scattering whit voids were not found in the experiment of Tables 1-1 through 1-4). Grade 1 is assigned for the case in which white voids are recognized in almost all of the recesses (such whit voids were not found in the experiment of Tables 1-2 through 1-5).

A halftone transfer rate that is a transfer rate of the black halftone image relative to the smooth sheet was measured as follows. First, when a halftone image is primarily transferred onto the intermediate transfer belt 31, a test machine is stopped and a vacuum collects the black-color toner of the halftone image from the intermediate transfer belt 31 to measure the weight of the collected toner as the total weight. Next, the halftone image is primarily transferred onto the intermediate transfer belt 31 under the same conditions as the previous primary transfer, and the primarily-transferred halftone image is secondarily transferred onto a smooth sheet immediately thereafter. Then, the test machine is stopped immediately after the secondary transfer, and the vacuum collects the untransferred residual toner on the intermediate transfer belt 31 to measure the weight of the collected residual toner as the amount of untransferred residual toner (sometimes referred to simply as residual toner).

The transfer rate is obtained by a solution of "(the total weight−residual toner)/the total amount×100".

The micro-rubber hardness (micro hardness) is obtained by measuring the hardness of a portion cut off from the intermediate transfer belt 31 using Micro rubber hardness meter MD-1 (registered trademark) produced by KOBUNSHI KEIKI CO., LTD. Specifically, a needle is pressed (indented) toward the portion of the intermediate transfer belt 31 with a predetermined pressing force at a temperature of 23° C. and a humidity of 50%, and the hardness of the intermediate transfer belt 31 is calculated based on the depth of indentation of the needle while deforming the portion of the intermediate transfer belt 31.

In all of Experiments 1 through 5, the secondary-transfer bias including the superimposed voltage with the low duty was used to secondarily transfer a solid image onto the uneven surface sheet. In Experiments 1 through 4, the secondary-transfer bias including the superimposed voltage with the high duty in which the polarity is not reversed was used to secondarily transfer a halftone image onto the smooth sheet. In Experiment 5, the secondary-transfer bias including only the DC voltage is used to secondarily transfer the halftone image onto the smooth sheet in a manner different from the manner in the first embodiment.

As can be found from the results of Experiment 1 through 4, with an increase in elasticity of the intermediate transfer belt 31 (with a reduction in hardness), the transferability in recesses of the uneven surface sheet increases. By contrast, with an increase in elasticity of the intermediate transfer belt 31, the HT transfer rate unsuccessfully decreases. To balance the transferability with the HT transfer rate in recesses, the micro-rubber hardness of the intermediate transfer belt 31 is preferably less than 100 and more preferably ranges from 50 through 80.

Note that, as can be found from Experiment 5, when the secondary transfer bias including only the DC voltage is used to secondarily transfer a halftone image onto the smooth sheet, the HT transfer rate significantly decreases (10%). This is because the charges having the opposite polarity are injected into the few-dot toner masses in the halftone image.

Next, the following experiments were performed with changes in secondary-transfer nip width.

Tables 1-3 represents the results of Experiment 1 and Experiment 8. In Experiment 8, the secondary-transfer bias (superimposed voltage) having the same low duty as in Experiment 1 was applied to the secondary-transfer nip N, and the secondary-transfer nip width was increased. With an increase in secondary-transfer nip width, the grade of transferability increased in the uneven surface sheet and decreased in the smooth sheet.

TABLE 1-3

| EXPERIMENT CONDITIONS | | | TEST NUMBER 1 | TEST NUMBER 8 |
|---|---|---|---|---|
| SHEET | UNEVEN-SURFACE SHEET | LEATHAC 66 260 kg | LOW DUTY RANK 4 | LOW DUTY RANK 5 |
| | | LEATHAC 66 215 kg | LOW DUTY RANK 5 | LOW DUTY RANK 5 |
| | | LEATHAC 66 175 kg | LOW DUTY RANK 5 | LOW DUTY RANK 5 |
| | SMOOTH SHEET | OK Top Coat | HIGH DUTY 90% | HIGH DUTY 75% |
| MICRO-RUBBER HARDNESS OF BELT | | | 80 | 80 |
| SECONDARY-TRANSFER NIP WIDTH [mm] | | | 3 | 4.5 |

Table 1-4 represents the results of Experiment 2 and Experiments 9 and 10. In Experiments 9 and 10, the secondary-transfer bias (superimposed voltage) having the same low duty as in Experiment 1 was applied to the secondary-transfer nip N, and the secondary-transfer nip width was changed.

In Experiment 9, with a decrease in secondary-transfer nip width, the grade of transferability decreased in the uneven surface sheet and increased in the smooth sheet.

In Experiment 10, with an increase in secondary-transfer nip width, the grade of transferability increased in the uneven surface sheet and decreased in the smooth sheet.

TABLE 1-4

| EXPERIMENT CONDITIONS | | | TEST NUMBER 2 | TEST NUMBER 9 | TEST NUMBER 10 |
|---|---|---|---|---|---|
| SHEET | UNEVEN-SURFACE SHEET | LEATHAC 66 260 kg | LOW DUTY RANK 5 | LOW DUTY RANK 3.5 | LOW DUTY RANK 5 |
| | | LEATHAC 66 215 kg | LOW DUTY RANK 5 | LOW DUTY RANK 4 | LOW DUTY RANK 5 |
| | | LEATHAC 66 175 kg | LOW DUTY RANK 5 | LOW DUTY RANK 5 | LOW DUTY RANK 5 |
| | SMOOTH SHEET | OK Top Coat | HIGH DUTY 75% | HIGH DUTY 90% | HIGH DUTY 60% |
| MICRO-RUBBER HARDNESS OF BELT | | | 60 | 60 | 60 |
| SECONDARY-TRANSFER NIP WIDTH [mm] | | | 3 | 2 | 4 |

Tables 1-5 represents the results of Experiment 3 and Experiment 11. In Experiment 11, the secondary-transfer bias (superimposed voltage) having the same low duty as in Experiment 3 was applied to the secondary-transfer nip N, and the secondary-transfer nip width was changed. In Experiment 11, with a decrease in secondary-transfer nip width, the grade of transferability decreased in the uneven surface sheet and increased in the smooth sheet.

TABLE 1-5

| EXPERIMENT CONDITIONS | | | TEST NUMBER 3 | TEST NUMBER 11 |
|---|---|---|---|---|
| SHEET | UNEVEN-SURFACE SHEET | LEATHAC 66 260 kg | LOW DUTY RANK 5 | LOW DUTY RANK 4 |
| | | LEATHAC 66 215 kg | LOW DUTY RANK 5 | LOW DUTY RANK 5 |
| | | LEATHAC 66 175 kg | LOW DUTY RANK 5 | LOW DUTY RANK 5 |
| | SMOOTH SHEET | OK Top Coat | HIGH DUTY 60% | HIGH DUTY 85% |
| MICRO-RUBBER HARDNESS OF BELT | | | 50 | 50 |
| SECONDARY-TRANSFER NIP WIDTH [mm] | | | 3 | 2.5 |

Next, descriptions are given below of the image forming apparatus according to variation in which the configuration of a part of the image forming apparatus according to the first embodiment is modified into a different configuration, and of the image forming apparatuses according to examples in which the configuration of a part of the image forming apparatus according to the first embodiment includes additional distinctive feature. Furthermore, the configurations of the image forming apparatuses according to variation and examples are the same as in the first embodiment unless otherwise stated.

Third Embodiment

The following describes the third embodiment and the experimental results according to the third embodiment. The present inventors have performed another experiment of printing a test image with different frequency, peak-to-peak value Vpp, and DC voltage value (target current value under constant current control) of the secondary-transfer bias. In the low-smooth mode, a black solid image was secondarily transferred onto the uneven surface sheet (i.e., LEATHAC 66). In the high-smooth mode, a blue halftone image (2 by 2) was secondarily transferred onto the OK Top Coat (smooth sheet) having a weight of 128 gsm. The results are represented in Table 2.

TABLE 2

| EXPERIMENT CONDITIONS/ TEST NUMBER | | | 6 | 7 | 12 | 13 | |
|---|---|---|---|---|---|---|---|
| SHEET | UNEVEN-SURFACE SHEET | LEATHAC 66 260 kg | LOW DUTY RANK 3 | LOW DUTY RANK 4 | LOW DUTY RANK 4 | LOW DUTY RANK 3.5 | BIAS Transferability in Surface Recesses |
| | | LEATHAC 66 215 kg | LOW DUTY RANK 3.5 | LOW DUTY RANK 5 | LOW DUTY RANK 4.5 | LOW DUTY RANK 4.5 | BIAS Transferability in Surface Recesses |
| | | LEATHAC 66 175 kg | LOW DUTY RANK 4 | LOW DUTY RANK 5 | LOW DUTY RANK 4.5 | LOW DUTY RANK 4.5 | BIAS Transferability in Surface Recesses |
| | SMOOTH SHEET | OK Top Coat | HIGH DUTY 90% | HIGH DUTY 60% | HIGH DUTY 90% | HIGH DUTY 80% | BIAS Halftone Transferability |
| MICRO-RUBBER HARDNESS OF BELT | | | 80 | 80 | 80 | 80 | |
| SECONDARY-TRANSFER NIP WIDTH [mm] | | | 3 | 3 | 4 | 2.5 | |

As represented in Table 2, the intermediate transfer belt 31 having a micro-rubber hardness of 80 was used in both Experiment 6 and Experiment 7. As can be found from the results of Experiment 1 in Table 1, the used of such an intermediate transfer belt 31 exhibits a favorable transferability in recesses. However, the transferability in recesses might decrease depending on the properties of the secondary-transfer bias.

In Experiments 6 and 12, the peak-to-peak potential Vpp as the peak-to-peak value is 5 kV, the frequency is 1.4 kHz, and the target current value of the DC component is −80 μA. The opposite-peak duty is 13% in the low-smooth mode (the uneven surface sheet) and 80% in the high-smooth mode (the smooth sheet).

The secondary-transfer nip width in Experiment 12 is smaller than the secondary-transfer nip width in Experiment 6.

In Experiments 7 and 13, the peak-to-peak potential Vpp is 12 kV, the frequency is 0.8 kHz, and the target current value of the DC component is −100 μA. The opposite-peak duty is 13% in the low-smooth mode (the uneven surface sheet) and 80% in the high-smooth mode (the smooth sheet).

The secondary-transfer nip width in Experiment 13 is smaller than the secondary-transfer nip width in Experiment 7.

In terms of the low-smooth mode (the uneven surface sheet), the transferability in recesses is more favorable in Experiment 7 than in Experiment 6. This is because of the following two reasons. The first reason is the difference in frequency. Under the condition of the low duty, the opposite-transfer directional time period Tr is shorter than the transfer-directional time period Tt, and thereby the time period of returning the toner particles from the recesses of the uneven surface sheet to the surface of the intermediate transfer belt 31 is more likely to be insufficient. With an increase in frequency, the possibility of occurrence of such an insufficient time period of returning toner remarkably increases. The frequency in Experiment 6 is higher than in Experiment 7. Accordingly, the opposite-transfer directional time period Tr in Experiment 6 is shorter than the opposite-transfer directional time period Tr in Experiment 7 even when the opposite-peak duty of 13% in Experiment 6 is the same as in Experiment 7. With such an increase in amount of toner particles that fail to return to the surface of the intermediate transfer belt 31 from the recesses of the uneven surface sheet, the capability to reduce the adhesion force of the toner particles onto the surface of the intermediate transfer belt 31 decreases, thus degrading the transferability of toner onto the recesses of the uneven surface sheet.

The second reason is the difference in peak value Vpp. Under the condition of the low duty, the peak-to-peak value Vpp is preferably increased to some degree to prevent the insufficient amount of the opposite-peak value Vr to successfully return the toner particle to the surface of the intermediate transfer belt 31 from the recesses of the uneven surface sheet. The peak-to-peak value Vpp in Experiment 6 is smaller than the peak-to-peak value Vpp in Experiment 7. Accordingly, the opposite-peak value Vr is slightly insufficient in Experiment 6.

As can be seen from the comparison between Experiment 6 and Experiment 12 and between Experiment 7 and experiment 13, the transferability increases with an increase in secondary-transfer nip width in the low-smooth mode. Further, the transferability decreases with a decrease in secondary-transfer nip width in the low-smooth mode.

In terms of the high-smooth mode (the smooth sheet), the halftone transferability is more favorable in Experiment 6 than in Experiment 7. This is because of the following two reasons. The first reason is the differences in peak-to-peak value Vpp and target current value of the DC component. The peak-to-peak value Vpp in Experiment 6 is less than the half of the peak-to-peak value Vpp in Experiment 7. In addition, the target current value of the DC component in Experiment 6 is smaller than that of Experiment 7. As a result, the transfer-peak value Vt in Experiment 6 is smaller than the transfer-peak value in Experiment 7, and thus the injection of the charges having the opposite polarity into toner is less likely to occur in Experiment 6. In addition, unlike in Experiment 7, the polarity remains negative in Experiment 6, and thus the injection of the charges having the opposite polarity is less likely to occur.

The second reason is the difference in frequency. The charges having the opposite polarity are injected into toner during the transfer-directional time period Tt in the high-smooth mode. In the transfer-directional time period Tt, the amount of injection of charges having the opposite polarity into toner per unit time increases, and reaches a level of saturation after the certain time period passes. Accordingly, as the transfer-directional time period Tt relatively reduces, the amount of injection of charges having the opposite polarity into toner during the pass through the secondary-transfer nip decreases as compared to the case in which the transfer-directional time period Tt is relatively increased. The frequency in Experiment 6 is higher than in Experiment 7. Accordingly, the transfer-directional time period Tt in Experiment 6 is shorter than the transfer-directional time period Tt in Experiment 7 even when the opposite-peak duty is 80% in Experiment 6. For this reason, the amount of injection of the charges having the opposite polarity into toner in Experiment 6 is less than in Experiment 7.

As can be found from the above-described experimental results, the frequency in the high-smooth mode is preferably higher than the frequency in the low-smooth mode. This configuration increases the halftone transferability in the high-smooth mode, and further increases the transferability in recesses in the low-smooth mode.

Further, the peak-to-peak value Vpp in the high-smooth mode is preferably lower than the peak-to-peak value Vpp in the low-smooth mode. This configuration increases the halftone transferability in the high-smooth mode, and further increases the transferability in recesses in the low-smooth mode.

As can be seen from the comparison between Experiment 6 and Experiment 12 and between Experiment 7 and experiment 13, the transferability increases with a decrease in secondary-transfer nip width in the high-smooth mode. Further, the transferability decreases with a decrease in secondary-transfer nip width in the high-smooth mode.

With an excessively increased the transfer-peak value Vt or the opposite-peak value Vr, electric discharge occurs within the secondary-transfer nip N between the surface of the intermediate transfer belt 31 and the surface of the sheet, thereby leading to the occurrence of many white spots due to the electric discharge. However, the transfer-peak value Vt or the opposite-peak value Vr is preferably increased to some degree in the low-smooth mode (the uneven surface sheet) to reciprocate toner particle between the surface of the intermediate transfer belt and the recesses of the uneven surface sheet in the secondary transfer nip. Such a configuration increases the image quality rather than failing to obtain a favorable transferability in recesses with the occurrence of a slight amount of white spots. By contrast, in the high-smooth mode (smooth sheet), the secondary-transfer bias having the high duty, in which the polarity is not reversed, may be used because the polarity of the secondary-transfer bias does not have to be reversed to reciprocate toner. This increases the halftone transferability, and further reduces the transfer-peak value Vt (that is greater than the opposite-peak value Vr because the polarity is not reversed), thus preventing or reducing the occurrence of white spots. To reverse the polarity, the peak-to-peak value Vpp and the target current value of the DC component are respectively reduced as compared to those of the secondary-transfer bias having the low duty.

In view of above, the power-source controller 200 controls the secondary-transfer power source 39 to output the secondary-transfer bias having a greater frequency, a lower peak-to-peak value Vp, and a greater DC voltage value (target current value) in the high-smooth mode than those in the low-smooth mode.

The opposite-peak value Vr of the secondary-transfer bias of the high duty in the first mode is preferably on the transfer-directional side (negative-polarity side in the present embodiment) relative to the opposite-peak value Vr of the secondary-transfer bias of the low duty in the second mode. This configuration can prevent the occurrence of white spots in the first mode (high-smooth mode), and increase the transferability of halftone images. Increasing the opposite-peak value Vr toward the opposite side (positive-polarity side in the present embodiment) of the transfer-directional side in the second mode (the low-smooth mode) can transfer a sufficient amount of toner onto the recesses of the uneven surface sheet, thus increasing transferability of toner onto the recesses. Alternatively, occurrence of surface roughness can be prevented.

In the above-described embodiments and examples, plain paper and coated paper are used as a smooth sheet. However, no limitation is intended therein. Sheets having relatively small degree of surface unevenness may be considered a smooth sheet. The examples of such a sheet include Classic Linen-Solar White with a basis weight of 90 gsm or 118 gsm manufactured by Neenah Paper Inc., Classic Crest-Solar White with a basis weight of 90 gsm or 104 gsm manufactured by Neenah Paper Inc., and Leathac 66 with a basis weight of 118 gsm manufactured by Tokushu Tokai Paper Co., Ltd. In some embodiments, the following configurations of the image forming apparatus 1000 are available. When the recording sheet has a relatively smaller degree of surface unevenness than the uneven-surface sheet, such as the Leathac 66 having a thickness of 175 kg, the transfer nip N is the first width that is smaller than the second width and the transfer bias has the duty of greater than 50% in transferring a toner image from the image bearer to a recording sheet P. When the recording sheet is the uneven-surface sheet, such as the Leathac 66 of 175 kg, the transfer nip is the second width and the transfer bias has the duty of less than 50% in transferring a toner image from the image bearer to a recording sheet P.

Alternatively, the following configuration is applicable. When the recording sheet has a relatively smaller degree of surface unevenness than the uneven-surface sheet, such as the Leathac 66 having a thickness of 175 kg, a first pressure that is smaller than a second pressure is applied to the transfer nip N and the transfer bias has the duty of greater than 50% in transferring a toner image from the image bearer to a recording sheet P. When the recording sheet is the uneven-surface sheet, such as the Leathac 66 of 175 kg, the second pressure is applied to the transfer nip N and the transfer bias has the duty of less than 50% in transferring a toner image bearer from the image bearer to a recording sheet P.

Fourth Embodiment

Figure 30:
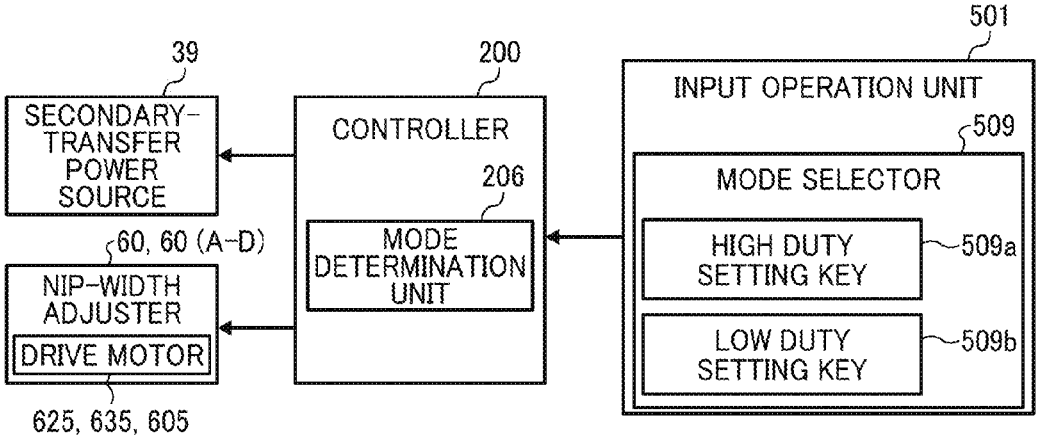
FIG. 30 is a block diagram of the configuration according to yet another embodiment of the present disclosure.

In the image forming apparatus 1000 according to a fourth embodiment, the input operation unit 501 includes a mode selector 509 to select between the high-duty mode and the low-duty mode as illustrated in FIG. 30. The input operation unit 501 is connected with the controller 200 via a signal line. The input operation unit 501 selects between the high-smooth sheet (smooth sheet) and the low-smooth sheet (uneven-surface sheet). In the present embodiment, the mode selector 509 includes a high-duty setting key 509*a* and a low-duty setting key 509*b*, which allow an operator (a user) to arbitrarily select between the high-duty mode and the low-duty mode. The controller 200 performs the first mode when the high-duty setting key 509*a* is selected by the user using the mode selector 509. The controller 200 performs the second mode when the low-duty setting key 509*b* is selected by the user using the mode selector 509. The mode determination unit 206 of the controller 200 determines either one of the high-duty mode and the low-duty mode according to mode information selected by the mode selector 509. The controller 200 controls the secondary-transfer power source 39 to output the high-duty secondary-transfer bias in the first mode. In the second mode, the controller 200 controls the secondary-transfer power source 39 to output the low-duty secondary-transfer bias. In other words, the controller 200 controls the nip width changing device 60, 60A, 60B, and 60C to reduce the secondary-transfer nip width W in the first mode to be smaller than the secondary-transfer nip width W in the second mode. The configuration according to the fourth embodiment allows a user of the image forming apparatus 1000 to select between the high-duty mode and the low-duty mode using the mode selector 509 in a relatively simple manner, to obtain a desired image quality.

As described above, the image forming apparatus 1000 according to the embodiments of the present disclosure changes duty of the transfer bias and transfer-nip width W according to the type of a recording sheet or image density of a toner image to be transferred to the recording sheet P. This configuration can increase the image quality while maintaining productivity.

The exemplary embodiments described above are one example and attain advantages below in a plurality of aspects A to F.

[Aspect O]

In Aspect O, an image forming apparatus (for example, a printer) includes an image bearer (for example, the intermediate transfer belt 31) bearing a toner image; a nip forming member (for example, the sheet conveyance belt 41) contacting the image bearer to form a transfer nip (for example, the secondary-transfer nip N); a transfer power source (the secondary-transfer power source 39) to output a transfer bias (for example, a secondary-transfer bias) including a superimposed voltage, in which a direct current (DC) voltage and an alternating current (AC) voltage are superimposed on each other, to flow a transfer current (for example, the secondary-transfer current) into the transfer nip to transfer the toner image borne on the image bearer onto a recording sheet disposed between the image bearer and the nip forming member. The transfer bias has a transfer peak value to electrostatically move toner from the image bearer to the nip forming member in a greater manner and an opposite-peak value that is an opposite side of the transfer peak value. The image forming apparatus further includes an information acquisition unit (for example, the input operation unit 501 and the smoothness sensor 502) acquires information regarding surface smoothness of the recording sheet to be subjected to transferring of the toner image and a controller (for example, the controller 200). The controller switches a transfer mode between a first mode to transfer the toner image onto a first type sheet having a higher surface smoothness and a second mode to transfer the toner image onto a second type sheet having a lower surface smoothness than the surface smoothness of the first type sheet based on the information acquired by the information acquisition unit. The controller controlling the transfer power source to output the transfer bias having an opposite-peak duty of greater than or equal to 50% that is a duty on the side of the opposite-peak value in the first mode, and the controller controlling the transfer power source to output the transfer bias having an opposite-peak duty of less than 50% that is different from the opposite-peak duty of the first mode in the second mode.

According to Aspect O, the image forming apparatus further includes an information acquisition unit (for example, the input operation unit 501 and the smoothness sensor 502) and a controller. The information acquisition unit acquires information regarding a surface smoothness of the recording sheet that is a transfer target of the toner image. The controller switches the transfer mode between the high-smooth mode to transfer the toner image onto a high-smooth sheet having a higher surface smoothness than a low-smooth sheet and the low-smooth mode to transfer the toner image onto the low-smooth sheet based on the information acquired by the information acquisition unit.

In the high-smooth mode, the controller 200 performs secondary-transfer operation with the regular nip width. In the low-smooth mode, the controller 200 moves the secondary-transfer second roller 36 upward to increase the nip width W, thereby increasing the number of vibration of alternating electrical field within the range of the nip width, thus increasing the number of reciprocative movement of toner. Thus, the transferability of toner onto the recesses of the recording sheet increases.

In such a configuration, using an image bearer having an elasticity increases the degree of contact between the surface of the image bearer and the surface of the low-smooth sheet in the transfer nip, thereby reducing the distance between the surface of the image bearer and the surface of the bottoms of the recesses of the low-smooth sheet. The reduction in such a distance allows for a successful transfer of toner relative to the recesses of the uneven surface of the low-smooth sheet even in a high-speed printing that responds to a demand for business use. However, with an excessively increased peak-to-peak value Vpp of the AC voltage of the transfer bias to achieve such a successful transfer, the electric discharge frequently occurs in the transfer nip, thereby causing the occurrence of many white spots due to the electric discharge. In contrast, with the use of a high-smooth sheet having a good surface smoothness as a recording sheet, the charges having the opposite polarity are injected into toner in the transfer nip, and thereby the transfer failure of a toner image is more likely to occur.

According to Aspect O, in the case of using the low-smooth sheet, a toner image is transferred onto the low-smooth sheet by using the transfer bias having an opposite-peak duty of less than 50% that is different from the opposite-peak duty in the case of using the high-smooth sheet. This allows transferring of a sufficient amount of toner into the recesses of the uneven surface with the transfer bias of a much smaller peak-to-peak value than that of the transfer bias having the opposite-peak duty of 50%. Such a configuration prevents the transfer failure of toner into the recesses of the uneven surface of the low-smooth sheet and the occurrence of white spots in an image. In the case of using the high-smooth sheet, the opposite-peak duty is greater than or equal to 50% that is different from the value of the opposite-peak duty in the case of using the low-smooth sheet. Thus, the charges having the opposite polarity is prevented from being injected into toner in the transfer nip, thereby preventing the occurrence of the transfer failure of a toner image relative to the high-smooth sheet as compared to the chase in which the opposite-peak duty is less than 50%.

As described above, the configuration according to Aspect O prevents the transfer failure of toner onto the recesses of the uneven surface and the occurrence of white spots in an image in the case of using the low-smooth sheet, while achieving high-speed printing. The configuration according to Aspect A further prevents the transfer failure of a toner image onto the high-smooth sheet.

—Aspect 1—

According to Aspect 1, an image forming apparatus includes an image bearer (for example, the intermediate transfer belt 31), a nip forming member (for example, the sheet conveyance belt 41) to form a transfer nip between the image bearer and the nip forming member, a nip width changing device (for example, 60 through 60C) to change a width of the transfer nip, a power source (for example, the secondary-transfer power source 39) to output a transfer bias (for example, the secondary-transfer bias) including an alternating current (AC) component to transfer a toner image from the image bearer to a recording sheet in the transfer nip, and a controller (for example, the controller 200). The controller changes between a first mode and a second mode according to a predetermined condition. The first mode is a mode in which the width of the transfer nip is a first width smaller than a second width and a duty is a first duty higher than a second duty. The second mode is a mode in which the width of the transfer nip is the second width and the duty is the second duty. The duty is $(T-Tt)/T\times100\%$ where T is a cycle of the transfer bias and Tt is a transfer-directional time period in which a value of the transfer bias is on the transfer-directional side to move the toner image from the image bearer onto the recording sheet, relative to a time-averaged value of the transfer bias during the cycle o the transfer bias.

The configuration according to Aspect 1 can prevent transfer failure of a toner image relative to the recording sheet, and allows transferring a sufficient amount of toner onto the recording sheet.

—Aspect 2—

In the image forming apparatus of Aspect 2, the first duty is greater than 50% and the second duty is less than 50%.

—Aspect 3—

In the image forming apparatus of Aspect 3 according to Aspect 1, the predetermined condition is a type of the recording sheet. The configuration according to Aspect 3 can prevent transfer failure of a toner image relative to the recording sheet, and allows transferring a sufficient amount of toner onto the recording sheet, irrespective of the type of the recording sheet.

—Aspect 4—

In the image forming apparatus of Aspect 4 according to Aspect 3, the controller performs the first mode when the recording sheet is a smooth sheet, and performs the second mode when the recording sheet is an uneven-surface sheet having a greater surface unevenness than a surface unevenness of the smooth sheet.

The configuration according to Aspect 4 can increase the transferability of toner relative to the uneven-surface sheet, and can further prevent image failure due to electric discharge in the smooth sheet.

—Aspect 5—

In the image forming apparatus of Aspect 5 according to Aspect 4, the first duty is greater than 50% and the second duty is less than 50%.

The configuration according to Aspect 5 can increase the transferability of toner relative to the uneven-surface sheet, and can further prevent image failure due to electric discharge in the smooth sheet.

—Aspect 6—

In the image forming apparatus of Aspect 6 according to any of Aspect 4 or 5, the controller controls the power source to output the transfer bias having a duty that ranges from 8% to 35%.

The configuration according to Aspect 6 can increase the transferability of toner relative to the uneven-surface sheet, and further prevent image failure due to electric discharge in the smooth sheet.

—Aspect 7—

In the image forming apparatus of Aspect 7 according to any of Aspect 4 through Aspect 6, the controller controls the power source to output the transfer bias having a duty of less than or equal to 17% when the recording sheet is the uneven-surface sheet.

The configuration according to Aspect 7 can increase the transferability of toner relative to the uneven-surface sheet.

—Aspect 8—

In the image forming apparatus of Aspect 8 according to any of Aspect 4 through Aspect 7, the controller controls the power source to output the transfer bias having a duty that ranges from 70% to 90%.

The configuration according to Aspect 8 can further prevent the transfer failure due to electric discharge in the smooth sheet.

—Aspect 9—

In the image forming apparatus of Aspect 9 according to any of Aspect 4 through Aspect 8, the controller controls the power source to output the transfer bias that alternately changes the polarity when the recording sheet is the uneven-surface sheet.

The configuration according to Aspect 9 allows toner to sufficiently reciprocate between the intermediate transfer belt 31 and the recording sheet in the secondary-transfer nip N, thereby increasing the transferability of toner.

—Aspect 10—

In the image forming apparatus of Aspect 10 according to any of Aspect 4 through Aspect 9, the controller controls the power source to output the transfer bias with a constant polarity.

The configuration according to Aspect 10 more reliably prevents the transfer failure of toner relative to the smooth sheet than the case in which the polarity is reversed during one cycle of the transfer bias.

—Aspect 11—

The image forming apparatus of Aspect 11 according to any of Aspect 4 through Aspect 10 further includes an input operation unit to input information regarding the recording sheet is the smooth sheet or the uneven-surface sheet, and a determination unit to determine whether the recording sheet is the smooth sheet or the uneven-surface sheet according to the information input by the input operation unit.

The configuration according to Aspect 11 allows easily obtaining the information regarding whether the recording sheet, onto which a toner image is to be transferred, is the smooth sheet or the uneven-surface sheet, by a simple operation of a user.

—Aspect 12—

The image forming apparatus of Aspect 12 according to any of Aspect 4 through Aspect 10 further includes a smoothness sensor to detect the smoothness of the recording sheet, and a determination unit to determine whether the recording sheet is the smooth sheet or the uneven-surface sheet according to a detection result of the smoothness sensor.

The configuration according to Aspect 12 allows automatically obtaining the information regarding whether the recording sheet, onto which a toner image is to be transferred, is the smooth sheet or the uneven-surface sheet without a user's operation. Thus, the operability of the image forming apparatus can be increased.

—Aspect 13—

The image forming apparatus of Aspect 13 according to any of Aspect 4 through Aspect 10 further includes a brans input unit to input information regarding a brand of the recording sheet, and a determination unit to determine whether the recording sheet is a smooth sheet or an uneven-surface sheet according to the information regarding the brand.

The configuration according to Aspect 13 allows easily obtaining the information regarding whether the recording sheet, onto which a toner image is to be transferred, is the smooth sheet or the uneven-surface sheet, by a simple operation of a user that merely inputs the brand of the recording sheet.

—Aspect 14—

In the image forming apparatus of Aspect 14 according to Aspect 13, the controller controls the power source to reduce the duty of the transfer bias as a degree of an unevenness of the brand input by the brand input increases when the recording sheet is the uneven-surface sheet.

The configuration according to Aspect 14 allows transferring a sufficient amount of toner onto the surface recesses of the uneven-surface sheet having a relatively high degree of surface unevenness in the second mode. The configuration according to Aspect 14 can further prevent the transfer failure due to electric discharge, relative to the uneven-surface sheet having a relatively low degree of surface unevenness.

—Aspect 15—

The image forming apparatus 1000 of Aspect 15 according to Aspect 1 includes a mode selector 507 to select between a halftone-image priority mode to give a higher priority to image quality of a halftone image than to image quality of a solid image, and a solid-image priority mode to give a higher priority to image quality of the solid image than image quality of the halftone image. The controller performs the first mode when the halftone-image priority mode is selected by the mode selector, and performs the second mode when the solid-image priority mode is selected by the mode selector. The configuration according to Aspect 15 allows obtaining a desired image quality in a simple manner in which the mode selector is used to select the mode.

—Aspect 16—

In the image forming apparatus of Aspect 16 according to Aspect 15, the first duty is greater than 50% and the second duty is less than 50%. The configuration according to Aspect 16 reduces the injection of the charges having the opposite polarity into the few-dot toner groups of the halftone image, thereby increasing the transferability of the halftone image relative to the recording sheet in the halftone-image priority mode. This can further prevent insufficient image density of the halftone image, i.e., the occurrence of the transfer failure. The configuration according to Aspect 16 can prevent or reduce the uneven image density (surface roughness) due to the small surface unevenness of the recording sheet in the solid-image priority mode. Further, using the low-duty transfer bias can prevent or reduce more white spots due to electric discharge than any type of transfer bias except for the low-duty transfer bias does. Increase the number of reciprocative movement of toner particles within the secondary-transfer nip N can prevent or reduce uneven image density, i.e., surface roughness.

—Aspect 17—

In the image forming apparatus of Aspect 17 according to Aspect 1, the controller changes between the first mode and the second mode according to the density of the toner image to be transferred onto the recording sheet.

The configuration according to Aspect 17 can reduce or prevent the occurrence of transfer failure in a simple manner.

—Aspect 18—

The image forming apparatus of Aspect 18 according to Aspect 1 or 2 further includes a mode selector to select either one of the first mode and the second mode. The controller performs either one of the first mode and the second mode according to mode information of the mode selector.

The configuration according to Aspect 18 allows obtaining a desired image quality through a relatively simple operation that merely selects the mode.

—Aspect 19—

In the image forming apparatus of Aspect 19 according to any one of Aspect 1 through 18, the frequency of the transfer bias in the first mode is higher than the frequency of the transfer bias in the second mode.

The configuration according to Aspect 19 can prevent transfer failure of a toner image relative to the recording sheet, and allows transferring a sufficient amount of toner onto the recording sheet.

—Aspect 20—

In the image forming apparatus of Aspect 20 according to any one of Aspect 1 through 19, the peak-to-peak value of the AC component of the transfer bias in the first mode is smaller than the peak-to-peak value of the AC component of the transfer bias in the second mode. The configuration according to Aspect 20 can prevent transfer failure of a toner image relative to the recording sheet, and allows transferring a sufficient amount of toner onto the recording sheet.

—Aspect 21—

In the image forming apparatus of Aspect 21 according to any one of Aspect 1 through 20, the transfer bias includes the AC component superimposed on the DC component. The absolute value of the DC component in the first mode is greater than the absolute value of the DC component in the second mode. The configuration according to Aspect 21 can prevent transfer failure of a toner image relative to the recording sheet, and allows transferring a sufficient amount of toner onto the recording sheet. Particularly, the configuration according to Aspect 21 can prevent or reduce the occurrence of white spots.

—Aspect 22—

In the image forming apparatus of Aspect 22 according to any one of Aspect 1 through 21, the transfer bias has a transfer-peak value, which is on the transfer-directional side relative to the time-averaged value, and an opposite-peak value, which is different from the transfer-peak value. The opposite-peak value in the first mode is on the transfer-directional side relative to the opposite-peak value in the second mode.

The configuration according to Aspect 22 can reliably prevent transfer failure of a toner image relative to the recording sheet, and allows reliably transferring a sufficient amount of toner onto the recording sheet.

—Aspect 23—

The image forming apparatus of Aspect 23 according to any one of Aspect 1 through Aspect 22 further a pressing member (for example, the roller unit holder 640 and the coil spring 643) in the nip width changing device to apply pressure to press the nip forming member toward the image bearer in the transfer nip. The nip width changing device changes the pressure applied by the pressing member to the transfer nip.

The configuration according to Aspect 23 can adjust the transfer-nip width in a simple manner.

—Aspect 24—

In the image forming apparatus of Aspect 24 according to any one of Aspect 1 through Aspect 23, the nip forming member is a belt member stretched between a plurality of rollers. The nip width changing device moves at least one of the plurality of rollers to change the transfer-nip width.

The configuration according to Aspect 24 allows adjusting the transfer-nip width in a simple manner when the nip forming member is a belt member.

—Aspect 25—

In the image forming apparatus of Aspect 25 according to, any one of Aspect 1 through 24, the image bearer has a multi-layer structure including a base layer (for example, the base layer 31*a*) and an elastic layer (for example, the elastic layer 31*b*) having a greater elasticity than the elasticity of the base layer on the base layer.

The configuration according to Aspect 25 can flexibly deform the elastic layer within the transfer nip, thereby increasing the transferability of toner relative to the recording sheet.

—Aspect 26—

In the image forming apparatus of Aspect 26 according to Aspect 25, the image bearer has an elastic layer having a micro-rubber hardness ranging from 50 through 80.

The configuration according to Aspect 26 can flexibly deform the elastic layer into the shape of the toner masses in the transfer nip.

—Aspect 27—

In the image forming apparatus of Aspect 27 according to Aspect 25 or Aspect 26, the image bearer includes an elastic surface layer as the elastic layer, and the elastic surface layer has a plurality of fine projections made of a plurality of fine particles dispersed in a material of the elastic surface layer.

With the configuration according to Aspect 27, the fine particles over the surface of the elastic layer can reduce the contact area of the elastic layer with the toner in the transfer nip, hence enhancing the ability of separation of the toner separating from the image bearer surface and thus enhancing the transfer efficiency.

—Aspect 28—

According to Aspect 28, a transfer method includes transferring a toner image from an image bearer onto a recording sheet in a transfer nip, to which a first pressure is applied, with a transfer bias having duty of greater than 50% when the recording sheet is a smooth sheet having a smaller surface unevenness than an uneven-surface sheet. The transfer method further includes transferring the toner image from the image bearer onto the uneven-surface sheet in the transfer nip, to which a second pressure greater than the first pressure is applied, with the transfer bias having duty of less than 50%. The duty is $(T-Tt)/T\times100\%$ where T is a cycle of the transfer bias and Tt is a transfer-directional time period in which a value of the transfer bias is on the transfer-directional side to move the toner image from the image bearer onto the recording sheet, relative to a time-averaged value of the transfer bias during the cycle of the transfer bias.

The configuration according to Aspect 28 can increase the transferability of toner relative to the uneven-surface sheet, and further prevent image failure due to electric discharge in the smooth sheet.

—Aspect 29—

According to Aspect 29, a transfer method includes transferring a toner image from an image bearer onto a smooth sheet having a smaller surface unevenness than an uneven-surface sheet as a recording sheet in a transfer nip having a first width with a transfer bias having duty of greater than 50%. The transfer method further includes transferring the toner image from the image bearer onto the uneven-surface sheet in the transfer nip having a second width larger than the first width, with the transfer bias having duty of less than 50%. The duty is $(T-Tt)/T\times100\%$ where T is a cycle of the transfer bias and Tt is a transfer-directional time period in which a value of the transfer bias is on the transfer-directional side to move the toner image from the image bearer onto the recording sheet, relative to a time-averaged value of the transfer bias during the cycle of the transfer bias.

The configuration according to Aspect 29 can increase the transferability of toner relative to the uneven-surface sheet, and further prevent image failure due to electric discharge in the smooth sheet.

The image forming apparatus 1000 for super-high speed printing includes the intermediate transfer belt 31, which is an elastic belt, as an image bearer. Such an image forming apparatus 1000 might cause the following difficulties, depending on the degree of surface unevenness and image density (image pattern).

1. Transfer Failure Due to Image Density of Halftone Image

Significantly insufficient image density results from applying the low-duty AC transfer bias and the DC transfer bias as the secondary-transfer bias to transfer a halftone image from the intermediate transfer belt 31 having the elastic layer to a recording sheet. Particularly, using the high-smooth sheet having greater surface smoothness than the low-smooth sheet leads to significantly insufficient image density. The duty refers to the opposite-peak duty that is a duty on the side of the peak value (opposite-peak value) opposite to the transfer-peak value to electrostatically move more toner from the image bearer to the nip forming member in the transfer nip than the opposite-peak value in the AC waveform. That is, the duty is a ratio (%) of the time period of application of the opposite-peak directional bias with respect to one cycle of the AC waveform.

In other words, the AC transfer bias having the low duty (the low-duty AC transfer bias) is the AC transfer bias for which the ratio of the time period of application of the opposite-peak directional bias with respect to the one cycle of the AC transfer bias is less than 50%. The AC transfer bias having the high duty (the high-duty AC transfer bias) is the AC transfer bias for which the ratio of the time period of application of the opposite-peak directional bias with respect to the one cycle of the AC transfer bias is greater than or equal to 50%.

2. Transfer Failure in Surface Recesses of Recording Sheet

Some of plain paper as a recording sheet have less smoothness than the smoothness of a smooth sheet. The surface recesses of a non-smooth sheet decreases in electric field intensity due to air gap between the surface recesses and a tone layer of the intermediate transfer belt, as compared to in the surface protrusions of the non-smooth sheet.

Unlike plain paper, the recording sheet having a greater degree of surface unevenness, such as the Leathac paper having an uneven pattern design, results in remarkably insufficient image density.

To reduce the above-described difficulties in the image forming apparatus 1000, the AC transfer bias and transfer-nip width are preferably adjusted as appropriate.

In a tone image of the halftone image, a printed area includes toner-adhesion spots that constitute a group of toner dots and a white space to which no toner adheres. The elastic layer of the intermediate transfer belt 31, which easily deforms, encloses the top surfaces as well as the side surfaces of the group of toner dots. This injects the charges having a polarity opposite to the normal charge polarity of toner into the toner particles of the group of toner dots, thereby reducing the charge amount of toner (Q/M).

Accordingly, the high-duty AC transfer bias is applied to the secondary-transfer nip N, the secondary-transfer bias first starts charging the intermediate-transfer belt 31 that has entered the secondary-transfer nip N. When the amount of charge exceeds the threshold value, the charges having the opposite polarity start to be injected into the group of toner dots in the halftone image.

The portion of the intermediate transfer belt 31 having entered the secondary-transfer nip N is charged during the transfer-directional time period Tt. Accordingly, with an increase in length of the transfer-directional time period Tt, the amount of injection of the charges having the opposite polarity into the group of toner dots increases.

The high-duty secondary-transfer bias has a shorter transfer-directional time period Tt than the low-duty secondary-transfer bias. Accordingly, it is conceivable that the use of the high-duty secondary-transfer bias reduces the amount of injection of the charges having the opposite polarity into the group of toner dots, thereby preventing or reducing the occurrence of the secondary transfer failure. The transfer failure of a halftone image more significantly occurs in the high-smooth sheet than in the low-smooth sheet.

In the image forming apparatus 1000 according to the above-described embodiments, reducing the transfer-nip width shortens the time period in which the recording sheet passes through the transfer nip N, thereby reducing the transfer-directional time period Tt, thus reducing the amount of the opposite charges to be injected into toner. This can further reduce the transfer failure as compared to the case in which the high-duty AC transfer bias is applied to the transfer nip N.

To secondarily transfer a toner image from the intermediate transfer belt onto the recording sheet having an uneven surface, toner is preferably caused to reciprocate between the intermediate transfer belt and the surface recesses of the recording sheet. With an increase in the number of reciprocation of toner, the amount of toner to be transferred from the intermediate transfer belt onto the surface recesses of the recording sheet increases. Accordingly, the number of reciprocation of toner is preferably greater than or equal to a certain number. In the super-high speed image forming apparatus, with a small secondary-transfer nip width, the frequency of the AC transfer bias is preferably increased to increase the number of reciprocation of toner. However, increasing the frequency of the high-peak AC transfer bias, which is used to reciprocate toner between the intermediate transfer belt and the surface recesses of the recording sheet, deforms the waveform of the AC transfer bias, thus failing to output the transfer bias having a desired peak value. To allow a transfer-power source to output the transfer bias having an appropriate waveform (which does not deform), the transfer-power source significantly increases in cost.

In the image forming apparatus 1000 according to the above-described embodiments, changing (increasing or reducing) the transfer-nip width increases the time period, in which the recording sheet passes through the transfer nip. This can maintain the number of reciprocation of toner at constant even when an uneven-surface sheet is used as a recording sheet in the super-high speed image forming apparatus.

Although the embodiments of the present disclosure have been described above, the present disclosure is not limited to the embodiments described above, but a variety of modifications can naturally be made within the scope of the present disclosure.

In the above-described embodiments, a description was given of the image forming apparatus adopting the intermediate transfer system that employs an intermediate transferor. However, no limitations is intended hereby. In some embodiments, the image forming apparatus may adopt the direct transfer method that directly transfers an image from a photoconductor onto a recording sheet P.

In the above-described embodiments, the image bearer (the intermediate transfer belt 31) includes an elastic layer. In some embodiments, the elastic layer may not be included in the intermediate transfer belt 31. Even when the elastic layer is not included in the intermediate transfer belt, the intermediate transfer belt 31 might enclose the dot toner in a halftone image due to the pressure applied to the secondary-transfer nip or the elastic deformation of a roller (the secondary-transfer first roller 33). According to the above-described embodiments, applying the high-duty secondary-transfer bias can prevent transfer failure of halftone images. Even when the intermediate transfer belt 31 without the elastic layer is used, applying the low-duty secondary-transfer bias can provide a successful secondary transferability of toner relative to the uneven-surface sheet. Alternatively, the occurrence of surface roughness of a solid image can be prevented or reduced.

Although the embodiment of the present disclosure has been described above, the present disclosure is not limited to the foregoing embodiments, but a variety of modifications can naturally be made within the scope of the present disclosure.

The following describes an electrophotographic color printer as an example of an image forming apparatus according to a fifth embodiment of the present disclosure.

In the fifth embodiment, a single-layer hard belt that includes only a belt base made of hard material, polyimide is used as the intermediate transfer belt 31. The image forming apparatus 1000 according to the fifth embodiment has the same configuration as in the first embodiment through the fourth embodiment, differing in the following configurations.

Next, a description is provided of the experiments performed by the present inventors.

The inventors have prepared a prototype image forming apparatus. The prototype image forming apparatus, which is a modification of Pro C5110 produced by Ricoh, Company, Ltd, is connected to the external power supply instead of including the regular power source as the secondary-transfer power source 39. Trek COR-A-TROL Model 610D is employed as the external power source.

Using the above-described prototype image forming apparatus, the experiments, in which single-color solid images and single-color halftone images are printed onto a recording sheet P, was performed. Hammer Mill color copy digital as plain paper was used as the recording sheet P. The process linear velocities of the photoconductor 2 and the intermediate transfer belt 31 are 352.8 mm/s and 158.8 mm/s, respectively. In the present experiment, three types of secondary-transfer bias, the secondary-transfer bias including only the DC voltage, the high-duty secondary-transfer bias including the superimposed voltage, and the low-duty secondary-transfer bias including the superimposed voltage were adopted.

Specifically, the adopted secondary-transfer bias including only the DC voltage has a value of −1 kV. With such a value of the secondary-transfer bias including only the DC voltage, a sufficient strength of secondary-transfer electric field can be formed within the secondary-transfer nip N to electrostatically move toner from the intermediate transfer belt 31 onto the recording sheet P.

Figure 31:
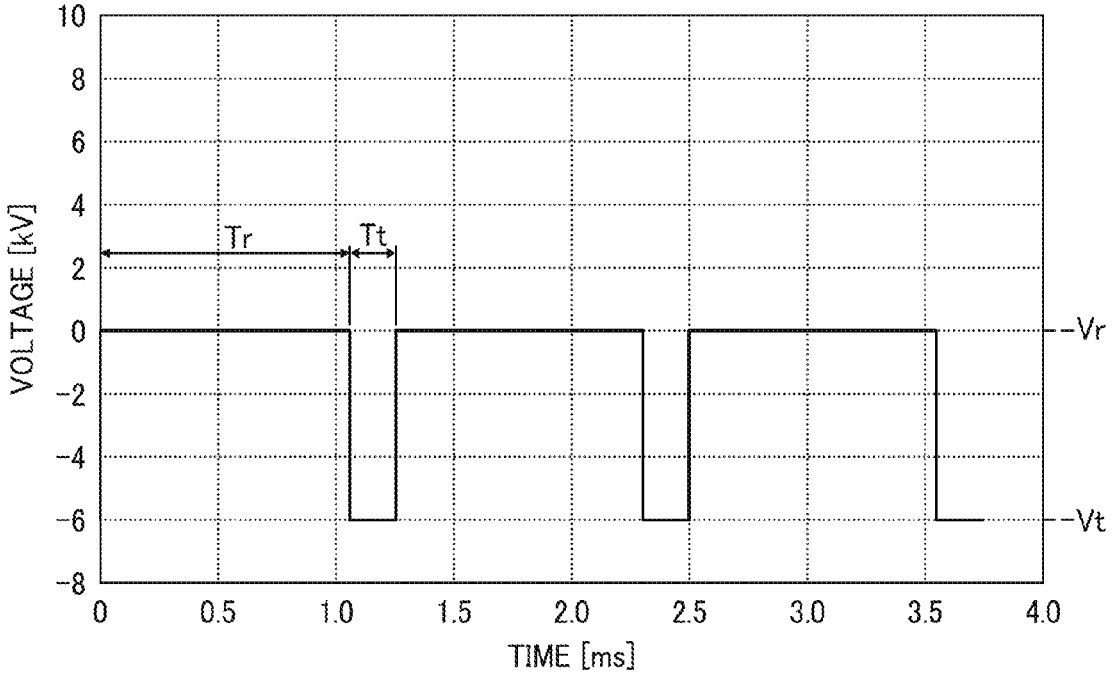
FIG. 31 is a waveform chart of the high-duty secondary-transfer bias used in the experiments.

FIG. 31 is a waveform chart of the secondary-transfer bias having high duty (the high-duty secondary-transfer bias) used in the experiments. The AC component of the high-duty secondary-transfer bias has a frequency of 0.8 kHz and one cycle T of 1.25 millisecond (ms). Further, the transfer-directional time period Tt is 0.1875 ms and the opposite-transfer directional time period Tr is 1.0625 ms in the AC component of the secondary-transfer bias. Thus, the duty of the AC component of the high-duty secondary-transfer bias is 85%. Within the one cycle T, the time period to electrostatically move toner in the transfer direction from the intermediate transfer belt 31 onto the recording sheet P is shorter than the remaining time period of the one cycle T. However, the secondary-transfer bias having the time-averaged value Vave of −1 kV can provide a sufficient level of electrostatic force to electrostatically move toner from the intermediate transfer belt 31 onto the recording sheet P within the secondary-transfer nip N same as the secondary-transfer bias including only the DC voltage does. The transfer-peak value Vt is −6 kV, the opposite-peak value Vr is 0 kV, and the peak-to-peak value Vpp is 6 kV. In this case, the polarity does not reverse within the one cycle T of the secondary-transfer bias.

In the present embodiment, the high-duty secondary-transfer bias does not reverse the polarity within one cycle of the transfer bias. However, in some embodiments, the high-duty secondary-transfer bias may reverse the polarity within one cycle of the transfer bias. When the high-duty secondary-transfer bias reverses the polarity within one cycle, the absolute value of the transfer-peak value Vt of the high-duty secondary-transfer bias is preferably greater than 6 kV in FIG. 31 to obtain the same time-averaged value Vave as the secondary-transfer bias including only the DC voltage. However, when the transfer-peak value Vt is excessively increased to be greater than the voltage that starts the electric discharge between the surface of the intermediate transfer belt 31 and the surface of the recording sheet P, the electric discharge frequently occurs within the secondary-transfer nip N, thereby generating many white spots in images due to the electric discharge. Hence, the transfer-peak value Vt is preferably increased within a certain range.

Figure 32:
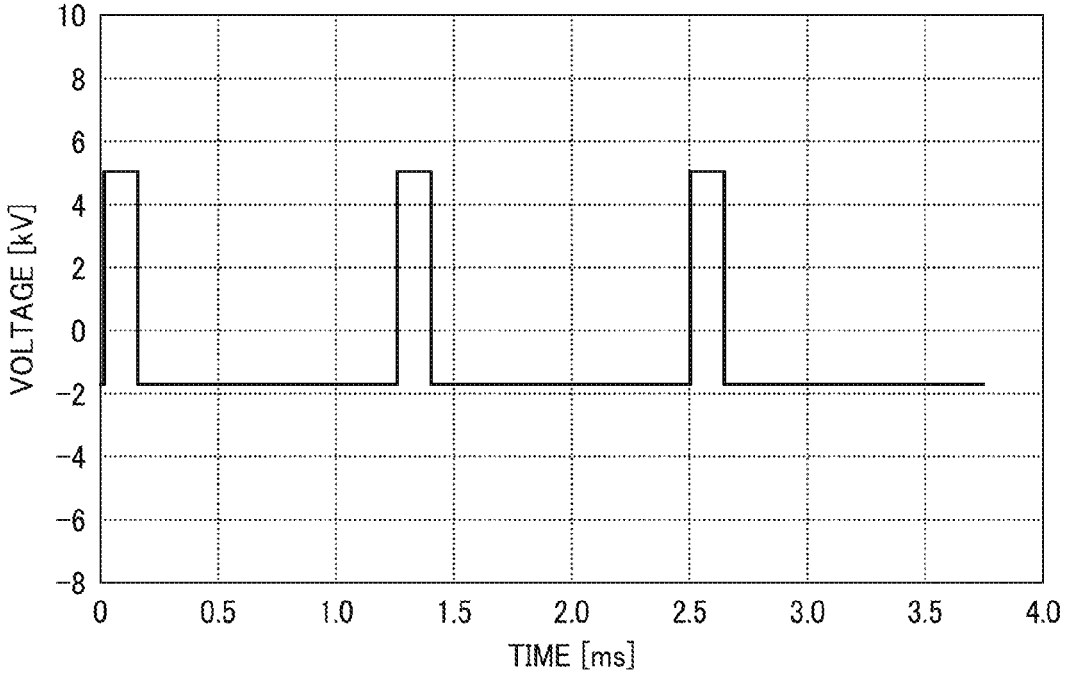
FIG. 32 is a waveform chart of the low-duty secondary-transfer bias used in the experiments.

FIG. 32 is a waveform chart of the secondary-transfer bias having low duty (the low-duty secondary-transfer bias) used in the experiments. The the AC component of the low-duty secondary-transfer bias has a frequency of 0.8 kHz and a cycle T of 1.25 ms. In the AC component of the low-duty secondary-transfer bias, transfer-directional time period Tt is 1.10 ms and the opposite-transfer directional time period Tr is 0.15 ms. Thus, the duty of the AC component of the low-duty secondary-transfer bias is 12%. Within the one cycle T, the time period to electrostatically move toner in the transfer direction from the intermediate transfer belt 31 onto the recording sheet P is longer than the remaining time period of the one cycle T. However, the secondary-transfer bias having the time-averaged value Vave of −1 kV can provide a sufficient level of electrostatic force to electrostatically move toner from the intermediate transfer belt 31 onto the recording sheet P within the secondary-transfer nip N same as the secondary-transfer bias including only the DC voltage does. The transfer-peak value Vt is −1.8 kV, the opposite-peak value Vr is 5.2 kV, and the peak-to-peak value Vpp is 7 kV. In this case, the polarity reverses within the one cycle of the transfer bias.

The evaluations of surface roughness of single-color solid images printed on plain paper were graded on a four-point scale. The "surface roughness" refers to the phenomenon in which the surface of a toner layer slightly forms a ripple due to a slight surface unevenness of a paper sheet and thus an observer perceives the presence of surface unevenness of the toner image. The grades for evaluation of surface roughness are EXCELLENT, GOOD, FAIR, and POOR. The "FAIR" indicates that surface roughness is an acceptable level depending on an image or a user, and the "POOR" indicates that surface roughness is an unacceptable level for any images or users.

The evaluations of transfer failure (transferability) of single-color halftone images printed on plain paper were graded on a four-point scale, EXCELLENT, GOOD, FAIR, and POOR. The "FAIR" indicates that transferability is an acceptable level depending on an image or a user, and the "POOR" indicates that transferability is an unacceptable level for any images or users.

Table 3 below represents the experimental results.

TABLE 3

| LINEAR | SHEET TYPE | | | |
|---|---|---|---|---|
| VELOCITY mm/s | PLAIN PAPER - HammerMill color copy digital | | | IMAGE |
| BIAS | DC | High Duty | Low Duty | QUALITY |
| 352.8 | FAIR | FAIR | FAIR | SURFACE |
| 158.8 | FAIR | FAIR | EXCELLENT | ROUGHNESS IN SOLID IMAGE |
| 352.8 | FAIR | EXCELLENT | FAIR | TRANSFER |
| 158.8 | FAIR | EXCELLENT | FAIR | FAILURE IN HALFTONE IMAGE |
| EVALUATION RESULTS FOR IMAGE QUALITY | | | | |

As represented in Table 3, when the secondary-transfer bias including only the DC voltage was employed, both of surface roughness for the single-color solid image and transferability for the single-color halftone image were evaluated as FAIR irrespective of the process linear velocity. However, when the high-duty superimposed voltage was employed, surface roughness of the single-color solid image was evaluated as FAIR irrespective of the process linear velocity. Further, transferability (insufficient image density due to transfer failure) of the single-color halftone image was evaluated as EXCELLENT irrespective of the process linear velocity. However, when the low-duty superimposed voltage was employed, surface roughness of the single-color solid image was evaluated as FAIR at high linear velocity of 352.8 mm/s whereas surface roughness of the single-color solid image was evaluated as EXCELLENT at low linear velocity of 158.8 mm/s. That is, with an increase in process linear velocity, the grade of surface roughness for the single-color solid image decreases. However, when the low-duty superimposed voltage was employed, transferability (insufficient image density due to transfer failure) of the single-color halftone image was evaluated as FAIR irrespective of the process linear velocity.

It can be found from the experimental results that the high-duty superimposed voltage (bias) is preferably applied to form halftone images in plain paper irrespective of the process linear velocity. Further, the low-duty superimposed voltage (bias) is preferably applied at a relatively reduced process linear velocity to form solid images in plain paper.

The present inventors have performed experiments using Leathac 66 (175 kg), that is an uneven-surface sheet, as a recording sheet P, same as in the experiments using plain paper. As the evaluation of image quality of a single-color solid image, transferability of toner relative to surface recesses of the uneven-surface sheet (transferability in surface recesses of an uneven-surface sheet), instead of surface roughness, was graded on a four point scale, EXCELLENT, GOOD, FAIR, and POOR. To evaluate the image quality of a single-halftone image, transferability of toner relative to surface projections of the uneven-surface sheet was graded on a four-point scale, EXCELLENT, GOOD, FAIR, and POOR. Table 4 below represents the experimental results. Note that the uneven-surface sheet is a sheet having an uneven surface, such as Japanese paper, "Washi".

TABLE 4

| LINEAR VELOCITY mm/s | SHEET TYPE: UNEVEN-SURFACE SHEET - LEATHAC 66 175 kg | | | IMAGE QUALITY |
|---|---|---|---|---|
| BIAS | DC | High Duty | Low Duty | |
| 352.8 | POOR | POOR | POOR | TRANSFERABILITY IN SURFACE RECESSES OF SOLID IMAGE |
| 158.8 | POOR | POOR | GOOD | |
| 352.8 | GOOD | EXCELLENT | FAIR | TRANSFER FAILURE OF HALFTONE IMAGE |
| 158.8 | GOOD | EXCELLENT | FAIR | |
| EVALUATION RESULTS FOR IMAGE QUALITY | | | | |

As represented in Table 4, when the secondary-transfer bias including only the DC voltage was employed, the transferability in surface recesses of the uneven-surface sheet for the single-color solid image was evaluated as POOR irrespective of the process linear velocity. Further, transferability in surface projections of the uneven-surface sheet for the single-color halftone image was evaluated as GOOD irrespective of the process linear velocity. When the high-duty superimposed bias was employed, transferability in surface recesses of the uneven-surface sheet for the single-color solid image was evaluated as POOR irrespective of the process linear velocity. Further, transferability in surface projections of the uneven-surface sheet for the single-color halftone image was evaluated as EXCELLENT irrespective of the process linear velocity. Further, when the low-duty superimposed bias was employed, the transferability in surface recesses of the uneven-surface sheet for the single-color solid image was evaluated as POOR at the high linear velocity of 352.8 mm/s, and evaluated as GOOD at the low linear velocity of 158.8 mm/s. Further, transferability in surface projections of the uneven-surface sheet for the single-color halftone image was evaluated as FAIR irrespective of the process linear velocity.

It can be found from the experimental results that the low-duty superimposed voltage is preferably employed as the secondary-transfer bias at a relatively reduced process linear velocity to form solid images in the uneven-surface sheet. Further, the high-duty superimposed voltage is preferably applied as the secondary-transfer bias irrespective of the process linear velocity to form halftone images in the uneven-surface sheet.

The present inventors have performed experiments using coated paper, POD gloss (128 gsm) as the recording sheet P, same as in the experiments using plain paper. To evaluate image quality, surface roughness of single-color solid images and transferability of single-color halftone images were graded on a four point scale, same as in the experiment using plain paper. Table 5 below represents the experimental results.

TABLE 5

| LINEAR VELOCITY mm/s | SHEET TYPE: COATED PAPER - POD Gloss 128 gsm | | | IMAGE QUALITY |
|---|---|---|---|---|
| BIAS | DC | High Duty | Low Duty | |
| 352.8 | GOOD | GOOD | GOOD | SURFACE ROUGHNESS IN SOLID IMAGE |
| 158.8 | GOOD | GOOD | EXCELLENT | |
| 352.8 | FAIR | EXCELLENT | POOR | TRANSFER FAILURE IN HALFTONE IMAGE |
| 158.8 | FAIR | EXCELLENT | POOR | |
| EVALUATION RESULTS FOR IMAGE QUALITY | | | | |

As represented in Table 5, when the secondary-transfer bias including only the DC voltage was employed, the surface roughness of the single-color solid image was evaluated as GOOD irrespective of the process linear velocity. Further, transferability of the single-color halftone image was evaluated as FAIR irrespective of the process linear velocity. When the high-duty superimposed bias was employed as the secondary-transfer bias, surface roughness of the single-color solid image was evaluated as GOOD irrespective of the process linear velocity. Further, transferability of the single-color halftone image was evaluated as EXCELLENT irrespective of the process linear velocity. Further, when the low-duty superimposed bias was employed as the secondary-transfer bias, surface roughness of the single-color solid image was evaluated as GOOD at the high linear velocity of 352.8 mm/s, and evaluated as EXCELLENT at the low linear velocity of 158.8 mm/s. Further, transferability of the single-color halftone image was evaluated as POOR irrespective of the process linear velocity.

It can be found from the experimental results that the low-duty superimposed voltage is preferably employed as the secondary-transfer bias at a relatively reduced process linear velocity to form solid images in the coated paper. Further, the high-duty superimposed voltage is preferably applied as the secondary-transfer bias irrespective of the process linear velocity to form halftone images in the coated paper.

The following can be said from the experimental results of Tables 3, 4, and 5. The low-duty superimposed voltage is preferably applied as the secondary-transfer bias at a relatively reduced process linear velocity to form solid images relative to any type of sheets, such as plain paper, uneven-surface sheet, and surface-coated paper. Further, the high-duty superimposed voltage is preferably applied as the secondary-transfer bias irrespective of the process linear velocity to form halftone images in the coated paper.

In Table 4, when the transferability in surface recesses of the solid image is evaluated as FAIR or POOR, the difference in image density between the surface recesses and the surface projections of the uneven-surface sheet significantly increases. This results in remarkable uneven density according to the surface recesses and projections of the uneven-surface sheet. As represented in Table 4, the low-duty superimposed voltage is preferably employed as the secondary-transfer bias to form solid images in the uneven-surface sheet, rather than the secondary-transfer bias including only the DC voltage or the high-duty secondary-transfer bias is employed. However, employing the low-duty superimposed voltage at a high linear velocity (352.8 mm/s) results in POOR as the evaluation for transferability in surface recesses of the solid image, same as in the cases of employing the secondary-transfer bias including only the DC voltage and employing the high-duty superimposed voltage. The reason is as follows. When the low-duty superimposed voltage is employed as the secondary-transfer voltage, the number of the toner particles to be transferred from the intermediate transfer belt 31 onto the surface recesses of the recording sheet P increases as the number of reciprocative movement of the toner particles increases. Accordingly, the toner particles are preferably caused to reciprocally move within the secondary-transfer nip N for a certain times to transfer a sufficient amount of toner particles onto the surface recesses of the recording sheet P, thus preventing insufficient image density of the surface recesses. The present inventors have found from the experiments that preferably, the toner particles reciprocally move for at least four times. With an increase in process linear velocity, a sufficient length of time to reciprocally move toner particles within the secondary-transfer nip for appropriate times is not obtained. Thus, even employing the low-duty superimposed voltage fails in reciprocal movement of a sufficient amount of toner to be transferred onto the surface recesses of the recording sheet.

Note that, as the frequency of the AC component of the superimposed voltage increases, the number of reversal of the polarity of the superimposed voltage may be increased within the time length in which toner passes through the secondary-transfer nip N. However, there is no correlation between the number of reversal of polarity of the transfer bias and the number of reciprocal movement of toner particles. Increasing the number of reversal of the polarity to a certain degree hampers the reciprocal movement of toner particles between the surface of the intermediate transfer belt 31 and the surface recesses of the recording sheet P. This is because, the reversal of the polarity occurs before the toner particles, which are electrostatically moving for the surface recesses of the recording sheet P, arrive at the surface recesses of the recording sheet P, and thereby the toner particles are caused to return to the surface of the intermediate transfer belt 31. Thus, a certain length of time is preferably provided for the toner particles to pass through the secondary-transfer nip N, thus allowing a sufficient amount of toner particles to be transferred onto the surface recesses of the recording sheet P.

From the viewpoint of image quality, transferability of a solid image relative to the surface recesses of an uneven-surface sheet is entirely different from surface roughness of a solid image in plain paper or surface-coated paper. Both of the transferability and the surface roughness, however, have the following in common. As is clear from Tables 3, 4, and 5, employing the low-duty superimposed voltage to form solid images at the low linear velocity (158.8 mm/s) can provide better results than the DC voltage or the high-duty superimposed voltage does. However, employing the low-duty superimposed voltage to form solid images at the high linear velocity (352.8 mm/s) results in failure, same as in the case of employing the DC voltage or the high-duty superimposed voltage. Hence, it is conceivable that the toner particles are preferably reciprocated within the secondary-transfer nip N for a plurality of times to successfully transfer solid images relative to plain paper or surface-coated paper without any surface roughness, same as in transferring solid images onto the surface recesses of an uneven-surface sheet.

Hereinafter, the surface roughness of solid images on plain paper or surface-coated paper and the transferability in surface recesses of an uneven-surface sheet for solid images are referred to collectively as "solid-image quality".

It can also be found from Tables 3, 4, and 5 that employing the high-duty superimposed voltage to form halftone images irrespective of the type of the recording sheet P and the process linear velocity can provide the best results. The present inventors have found the following reasons for such a matter through the experiments. The number of toner particles of a halftone image to be transferred within the secondary-transfer nip N is less than the number of toner particles of a solid image to be transferred within the secondary-transfer nip N. Accordingly, more amounts of secondary-transfer current flow to each of the toner particles of the halftone image to be transferred within the secondary-transfer nip N than the solid image does. Thus, electrical charges having a polarity opposite (opposite polarity) to the normal polarity are excessively injected to the toner particle, which results in a significant decrease in amount of charge (mass-to-charge ratio (Q/M)) of the toner having the normal polarity and also results in an oppositely charging of the toner particles. This causes transfer failure of halftone images, resulting in insufficient image density. The charges having the opposite polarity are not injected into toner particles in the secondary-transfer nip N in the opposite-transfer directional time period Tr. However, the charges having the opposite polarity are injected into toner particles in the secondary-transfer nip N in the transfer-directional time period Tt. The toner particles are not charged with the opposite polarity at the beginning of the transfer-directional time period Tt. The toner particles are charged with the opposite polarity only when the transfer-directional time period Tt is longer than a threshold value. For this reason, the transfer-directional time period Tt of the high-duty superimposed bias is relatively reduced, thereby reducing the possibility of injecting the opposite-polarity charges into toner irrespective of process linear speed.

Hereinafter, image quality regarding image density of halftone-images on plain paper, uneven-surface sheet, and coated paper is referred to as "halftone-image quality".

When the low-duty superimposed voltage is employed as the secondary-transfer bias to form halftone images irrespective of the type of the recording sheet P, the opposite-polarity charges are injected into toner particles and thereby transfer failure occurs, resulting in insufficient image density. Further, there is no need for toner particles to reciprocally move within the secondary-transfer nip for a plurality of times to form halftone images, unlike in forming solid images. However, the process linear velocity is unnecessarily reduced to reciprocally move toner particles for a plurality of times to form halftone images same as in forming solid images.

Next, a description is provided of a characteristic configuration of the image forming apparatus 1000 according to the present embodiment of the present disclosure.

Figure 33:
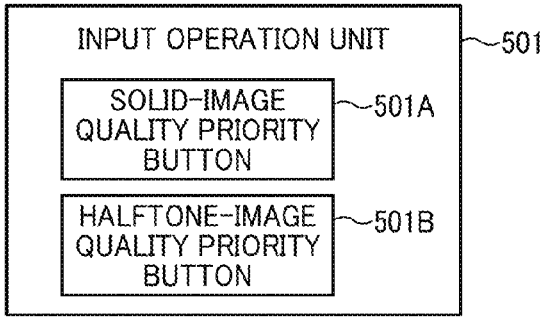
FIG. 33 is a block diagram of electrical circuitry of an input operation unit of the image forming apparatus according to an embodiment of the present disclosure.

FIG. 33 is a block diagram of electrical circuitry of an input operation unit 501 of the image forming apparatus according to the embodiment of the present disclosure. As illustrated in FIG. 33, the input operation unit 501 includes a solid-image quality priority button 501A and a halftone-image quality button 501B. In the image forming apparatus according to the embodiment, a description is given in the instruction manual for uses to operate as follows. When a higher priority is given to the solid-image quality than the halftone-image quality, a user presses the solid-image quality priority button 501A. When a higher priority is given to the halftone-image quality than the solid-image quality, the user presses the halftone-image quality priority button 501B. That is, the input operation unit 501 serves as an information acquisition device that acquires the following information. The input operation unit 501 acquires information regarding user's desired image quality, i.e., desired-quality information (whether the solid-image quality or the halftone-image quality is prioritized).

As illustrated in FIG. 3, the input operation unit 501 sends the input information to the controller 200. Hereinafter, the information that is sent from the input operation unit 501 to the controller 200 in response to a user's pressing the solid-image quality priority button 501A is referred to as a solid-image quality priority information as the desired-quality information. Further, the information that is sent from the input operation unit 501 to the controller 200 in response to a user's pressing the halftone-image quality priority button 501B is referred to as a halftone-image quality priority information as the desired-quality information.

The controller 200 preliminarily stores a storage-mode data in a flash memory. The controller 200 receives the halftone-image quality priority information and the solid-image quality priority information as the desired-quality information from the input operation unit 501. The controller 200 having received the halftone-image quality priority information sent from the input operation unit 501 stores the halftone-image quality priority information as the desired-quality information in the flash memory. The controller 200 having received the solid-image quality priority information sent from the input operation unit 501 stores the solid-image quality priority information as the desired-quality information in the flash memory.

The controller 200 controls the driving operations of various drive devices in the image forming apparatus 1000, receives the detection results of each sensor, and performs calculation. The controller 200 also controls the toner image forming units 1Y, 1M, 1C, and 1K, the optical writing unit 80, and and the drive of the intermediate transfer belt 31.

The controller 200 changes the image forming mode between the halftone-image quality priority mode as a first mode and the solid-image quality priority mode as a second mode. Table 6 below represents the conditions for the image forming modes, respectively.

TABLE 6

| | IMAGE FORMING MODE | |
|---|---|---|
| | HALFTONE-IMAGE QUALITY PRIORITY (FIRST MODE) | SOLID-IMAGE QUALITY PRIORITY ( SECOND MODE) |
| PROCESS LINEAR VELOCITY [mm/s] | 352.8 | 158.8 |
| SECONDARY-TRANSFER BIAS | HIGH DUTY | LOW DUTY |

As represented in Table 6, the process linear velocity in the halftone-image quality priority mode (the first mode) is higher than that of the solid-image quality priority mode (the second mode). Further, the duty (85%) in the halftone-image quality priority mode is greater than the duty (12%) in the solid-image quality priority mode. Increasing duty is increasing the opposite-transfer directional time period Tr.

In the halftone-image quality priority mode, the high-duty secondary-transfer mode including a superimposed voltage is employed to prevent the occurrence of insufficient image density due to transfer failure of a halftone image, irrespective of sheet type of a recording sheet P as represented in Tables 3, 4, and 5. Moreover, employing the high-duty secondary-transfer bias including a superimposed voltage in the half-tone image quality priority mode exhibits the same advantageous effect (the image quality was evaluated as EXCELLENT at any process linear velocity) irrespective of process linear velocity. Thus, the process linear velocity is set at 352.8 mm/s (high velocity). This configuration can prevent unnecessarily reducing the printing speed, and can further prevent the occurrence of insufficient image density in forming halftone images.

However, in the solid-image quality priority mode, the low-duty secondary-transfer bias including a superimposed voltage is employed and the processes linear velocity is set at 158.8 mm/s (low velocity). This configuration allows for a favorable solid image quality irrespective of the type of recording sheet P. Specifically, this configuration can prevent the occurrence of surface roughness for solid images in plain paper and coated paper as represented in Table 3 and 5, respectively (surface roughness in plain paper and coated paper were evaluated as EXCELLENT). The configuration further allows transferring a solid image relative to the surface recesses of an uneven-surface sheet (transferability of solid image in surface recesses was evaluated as GOOD).

Figure 34:
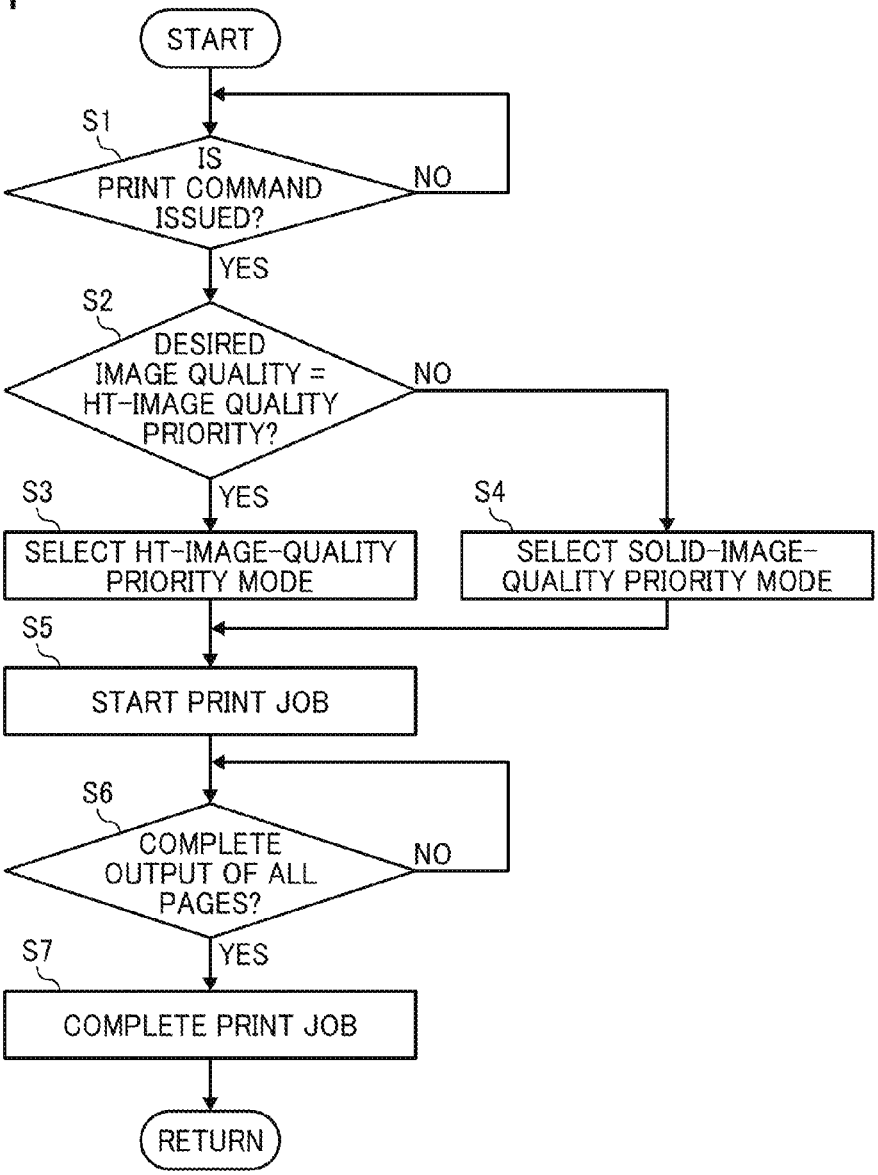
FIG. 34 is a flowchart of a print job process executed by the controller of the image forming apparatus according to the embodiment of the present disclosure.

FIG. 34 is a flowchart of a print job process performed by the controller 200 of the image forming apparatus 1000 according to the present embodiment. When the controller 200 receives a print command signal from an external personal computer (PC) or scanner (YES in step S1), the controller 200 determines whether the desired-quality information stored in the flash memory is the halftone-image quality priority information (step S2). When the desired-quality information is the halftone-image quality priority information (YES in step S2), the controller 200 selects the halftone-image quality priority mode as the image forming mode (step S3). In contrast, when the desired-quality information stored in the flash memory is not the halftone-image quality priority information (NO in step S2), the controller 200 selects the solid-image quality priority mode as the image forming mode (step S4). Subsequently, the controller 200 starts print job in the image forming mode selected in step S3 or step S4 (step S5). When outputting all pages according to the externally input image information is completed (YES in step S6), the controller 200 completes the print job (step S7) and the process returns to step S1.

In the image forming apparatus 1000 according to the present embodiment, the controller 200, which receives the halftone-image quality priority information selected by a user, performs a print job in the halftone (HT)-image quality priority mode. This configuration can prevent unnecessarily reducing the printing speed, and can further prevent the occurrence of insufficient image density in forming halftone images. In contrast, the controller 200, which receives the solid-image quality priority information selected by a user, performs a print job in the solid-image quality priority mode. This configuration allows obtaining a favorable solid image in forming solid images.

Next, descriptions are given below of examples to which a distinctive feature is added to the image forming apparatus (i.e., a printer) according to the fifth embodiment. Note that the configuration of each of the examples of the image forming apparatus is the same as the above-described embodiment unless specified.

First Example

Same as the image forming apparatus 1000 according to the embodiments, the configuration that selects the image forming mode according to only the desired-quality information of a user has the following difficulties. When the controller 200 forms a halftone image at the low-duty mode in response to the solid-image quality priority mode (low-duty mode) selected by a user, the halftone-image quality was evaluated as FAIR or POOR as represented in Tables 3, 4, and 5. When the controller 200 forms a solid image at the high-duty mode in response to the halftone (HT)-image quality priority mode (high-duty mode) selected by a user, the solid-image quality in coated paper was evaluated as GOOD. However, the solid-image quality in plain paper and an uneven-surface sheet was FAIR or POOR as represented in Tables 3 and 4.

To handle such circumstances, the controller 200 of the image forming apparatus according to the first example performs a print job according to an average area coverage modulation rate of an image for each page, instead of according to the desired-quality information. More specifically, when a printed area within a page is occupied by a solid image (solid image area), the controller 200 determines whether the average area coverage modulation rate of the page is greater than or equal to a threshold value. If so, the controller 200 selects the solid-image quality priority mode. More specifically, when a printed area within a page is occupied by a halftone (HT) image (halftone image area), the controller 200 determines whether the average area coverage modulation rate of the page is less than or equal to the threshold value. If so, the controller 200 selects the halftone-image quality priority mode.

Figure 35:
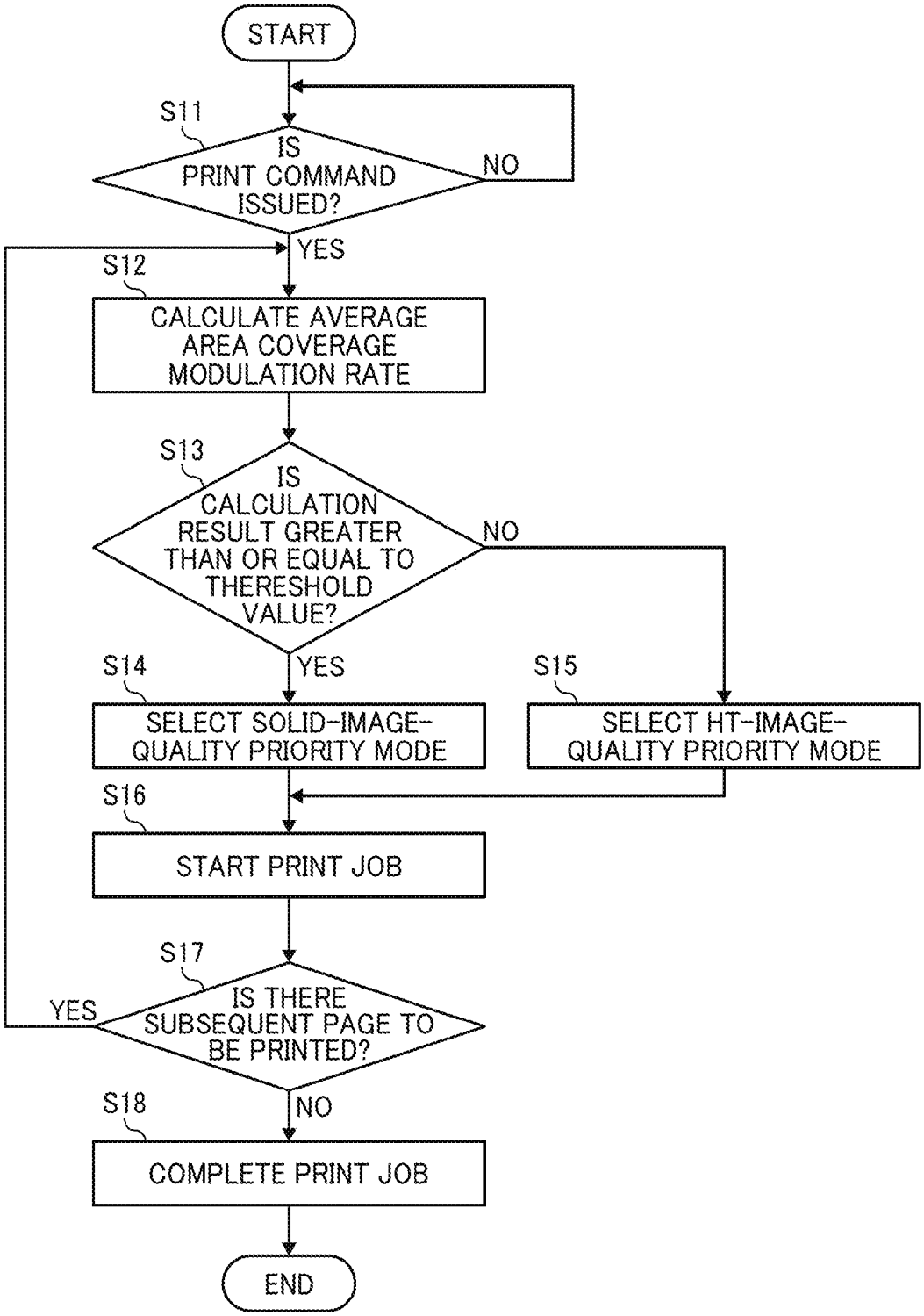
FIG. 35 is a flowchart of a print job process executed by the controller of the image forming apparatus according to an example of the present disclosure.

FIG. 35 is a flowchart of a print job process performed by the controller 200 of the image forming apparatus 1000 according to the first example. When the controller 200 receives a print command signal from an external PC or scanner (YES in step S11), the controller 200 calculates an average area coverage modulation within a page (step S12), and then determines whether the calculation result is greater than or equal to the threshold value (step S13). When the calculation result is greater than or equal to the threshold value (YES in step S13), the controller 200 selects the solid-image quality priority mode (step S14). When the calculation result is not greater than or equal to the threshold value (NO in step S13), the controller 200 selects the halftone-image quality priority mode (step S15).

The controller 200 starts a print job according to the selected image forming mode (step S16). When printing for one page is completed, the controller 200 confirms the presence of a subsequent page to be printed (step S17). When there is a subsequent page to be printed (YES in step S17), the process returns to step S12. When there is not a subsequent page to be printed (NO in step S17), the controller 200 completes the print job (step S18) to end the process.

In such a configuration, selecting the image forming mode according to the average area coverage modulation rate within a page (step S13) can prevent reducing the solid-image quality of a solid image area that occupies most of the printed area (image) in a page or reducing the halftone-image quality of a halftone image area that occupies most of the printed area (image) in a page.

The average area coverage modulation rate in a page is calculated by the following. When the entire area of a page is occupied by a printed area (image portion), the rate of an area to which toner adheres (toner-adhering area) relative to the entire area of the page (the rate of the number of pixels in the toner-adhering area relative to the total number of pixels within the page) is obtained as the average area coverage modulation rate. When a plurality of separate image portions are included in the page (for example, a plurality of textual image portions), all of the plurality of image portions are collectively defined as one image (the entire image portion) within the page. The image portions are independent from each other. There is a possibility that the average area coverage modulation rates of the image portions reproduce image density of the plurality of image portions. For this reason, the area (area in one of the image portions) or the number of pixels (the number of pixels in one of the image portions) within the outline (within the edge) of each of the plurality of image portions is calculated, and the sum of the calculated values is determined as the total image portion area or the total number of pixels in the entire image portion. Further, the area to which toner adheres or the number of pixels in the area is calculated for each of the plurality of image portions in a page, and the sum of the calculated values is determined as the total toner-adhering area or the total number of pixels in the toner-adhering area. The rate of the total toner-adhering area relative to the total image portion area or the rate of the total number of pixels in the toner-adhering area relative to the total number of pixels in the entire image portion is determined as the average area coverage modulation rate within a page. In continuously forming images of a plurality of pages, the average value of the average the average area coverage modulation rates for all of the pages is determined by dividing the sum of the average area coverage modulation rates for all of the pages by the number of pages.

Second Example

Figure 37:
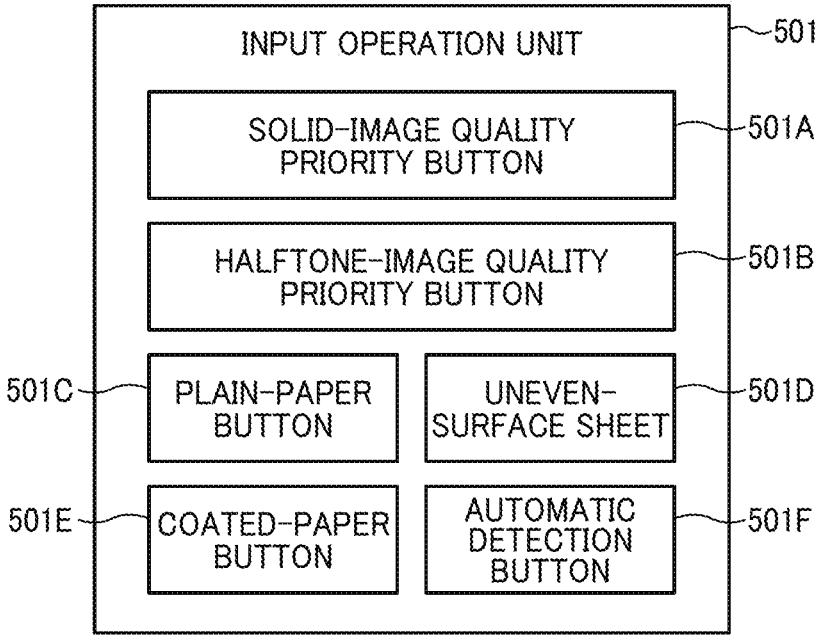
FIG. 37 is a block diagram of electrical circuitry of an input operation unit of the image forming apparatus according to still another example of the present disclosure.

FIG. 37 is a block diagram of electrical circuitry of an input operation unit 501 of the image forming apparatus according to a second example of the present disclosure. The input operation unit 501 includes a plain-paper button 501C, an uneven-surface sheet button 501D, a coated-paper button 501E, and an automatic detection button 501F. The input operation unit 501 allows a user to select the automatic detection button 501F to make the image forming apparatus 1000 automatically detect the type of the recording sheet P stored in the feed tray 100. The input operation unit 501 further allows a user to select the plain-paper button 501C, the uneven-surface sheet button 501D, and the coated-paper button 501E to make the controller 200 recognize plain paper, the uneven-surface sheet, and coated paper, respectively. The controller 200 having received a signal in response to the pressing of the plain-paper button 501C of the input operation unit 501 stores information representing plain paper as the information regarding smoothness, in the flash memory. The controller 200 having received a signal (data) in response to the pressing of the uneven-surface sheet button 501D of the input operation unit 501 stores information representing the uneven-surface sheet as the information regarding smoothness, in the flash memory. The controller 200 having received a signal (data) in response to the pressing of the coated-paper button 501E of the input operation unit 501 stores information representing the coated paper as the information regarding smoothness, in the flash memory. The controller 200 having received a signal (data) in response to the pressing of the automatic detection button 501F of the input operation unit 501 stores information representing "determination after detection" as the information regarding smoothness, in the flash memory.

The feeding path of the image forming apparatus according to the second example has the same configuration as that of FIG. 27.

The flash memory-source controller 200 causes, in response to the information representing "determination after detection" as the information regarding smoothness stored in the flash memory, the smoothness sensor 502 to detect the amount of totally-reflected light on the surface of the recording sheet P. Then, the controller 200 determines which the recording sheet P belongs to among the plain paper, the uneven-surface sheet, and the coated paper according to the detection results of the smoothness sensor 502. According to the determination results, the controller 200 changes the information regarding smoothness ("determination after detection") to information representing any of the plain paper, the uneven-surface sheet, and the coated paper.

Figure 36:
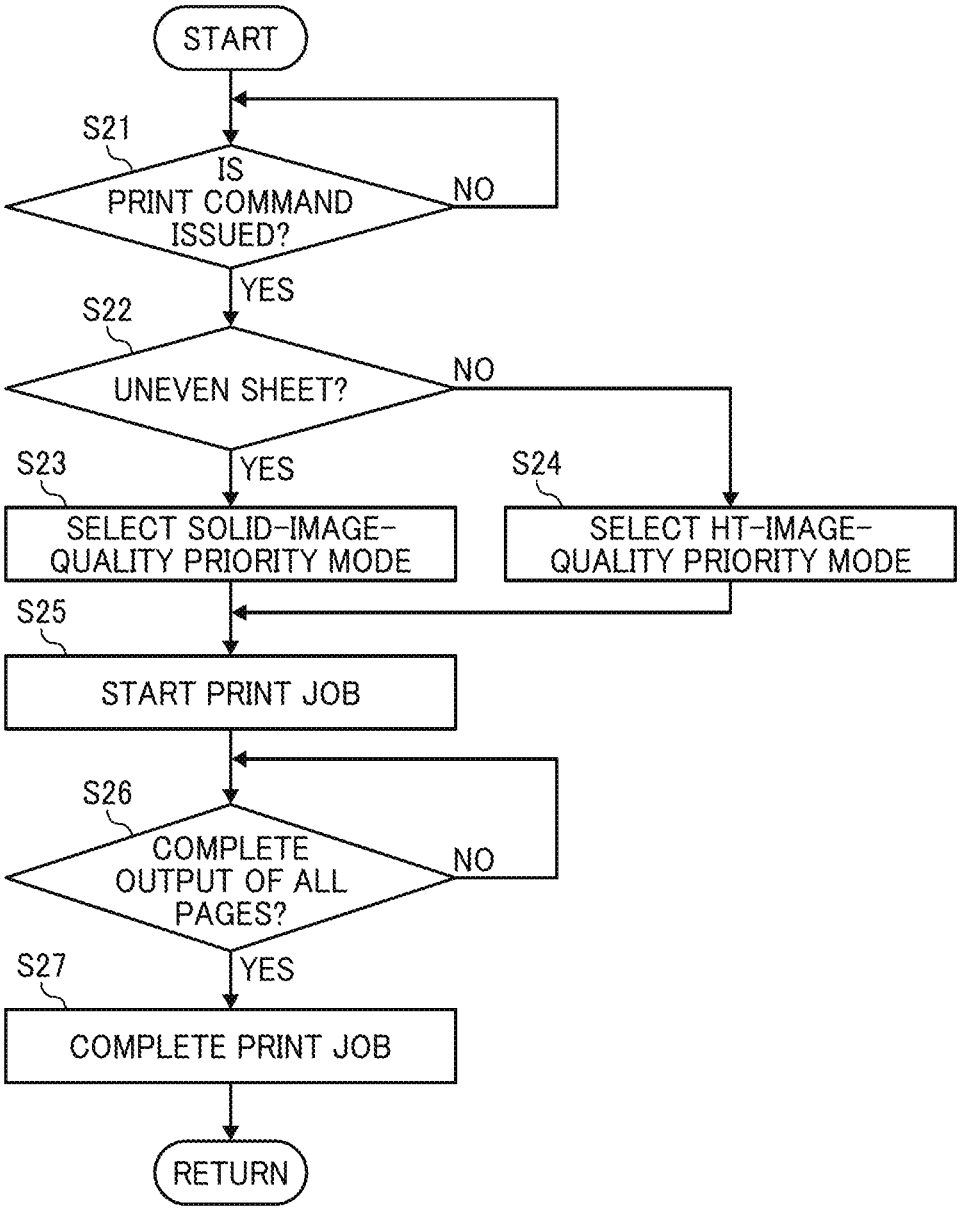
FIG. 36 is a flowchart of a print job process executed by the controller of the image forming apparatus according to another example of the present disclosure.

FIG. 36 is a flowchart of a print job process performed by the controller 200 of the image forming apparatus 1000 according to the second example. The controller 200 receives a print command signal from an external smoothness or scanner (YES in S21), and determines whether the information regarding smoothness stored in the flash memory represents the uneven-surface sheet (step S22). When the information does not represent the uneven-surface sheet (NO in step S22), the controller 200 selects the halftone (HT)-image quality priority mode as the image forming mode (step S24). When the information represents the uneven-surface sheet (YES in step S22), the controller 200 selects the solid-image quality priority mode as the image forming mode (step S23). Subsequently, the controller 200 starts print job in the image forming mode selected in step S23 or step S24 (step S25). When outputting all pages according to the externally input image information is completed (YES in step S26), the controller 200 completes the print job (step S27) and the process returns to step S21.

In the image forming apparatus according to the second example, the controller 200 performs the print job in the halftone-image quality priority mode when the recording sheet P to be used is not the uneven-surface sheet. When the recording sheet P to be used is the uneven-surface sheet, the controller 200 performs the print job in the solid-image quality priority mode. Although the transferability varies according to the sheet type (the three types) as represented in Tables 3, 4, and 5, grade "POOR" for transferability is preferably prevented. Further, for users who desire an increase in print speed, increasing the linear velocity is given a priority over increasing the evaluation results to be graded as "EXCELLENT" for transferability as far as transferability is not graded as "POOR" for transferability.

In the image forming apparatus according to the second example, the controller 200 performs the process as illustrated in FIG. 36 to satisfy the demand of the users who desire an increase print speed. More specifically, the following is performed to prevent grade "POOR" for the transferability in any of the solid image and the halftone image relative to the uneven-surface sheet (the uneven-surface sheet having a greater surface unevenness than the smooth-sheet does) as represented in Table 4. The controller 200 performs the print job in the solid-image quality priority mode in which the low duty (the second duty in the present example) and the low-linear velocity (the second linear velocity in the present example) are adopted. The controller 200 performs the print job in the halftone-image quality priority mode in which the high-duty (the first duty in the present example) and the high-linear velocity (the first linear velocity in the present example) are adopted, to prevent grade "POOR" for the transferability in the smooth sheet as the recording sheet P (other than the uneven-surface sheet) at the high-low velocity as represented in Tables A and C.

In some embodiments, the following configuration is available instead of the configuration that automatically detects the surface smoothness of the recording sheet P according to a user's desire. The configuration that acquires the information regarding smoothness in response to the pressing of the plain-paper button 501C, the uneven-surface sheet button 501D, and the coated-paper button 501E is available.

Alternatively, in some embodiments (in variation to be described below), the configuration that acquires the information regarding smoothness according to the brand (registered trademark or model) of the recording sheet P.

Third Example

As represented in Table 4, selecting the solid-image quality priority mode (the low duty and the low-linear velocity) in a use of the uneven-surface sheet can prevent "POOR" image quality for any of the solid image and the halftone image. However, selecting the halftone-image quality priority mode (the high duty and the high-linear velocity) in a use of the uneven-surface sheet results in "POOR" image quality for the solid image. Thus, the solid-image quality priority mode is preferably selected to prevent "POOR" image quality in the use of the uneven-surface sheet.

The type of the recording sheet P except for the uneven-surface sheet includes plain paper and coated paper. In using coated paper as represented in Table 5, selecting the halftone-image quality priority mode (the high duty and the high-linear velocity) can prevent POOR transferability and can also increase the printing speed.

Table 3 for the use of plain paper includes three aspects in which one of the surface roughness in the solid image and the transferability of the halftone image results in "Excellent" and the other results in "FAIR". The three aspects include the aspect of the high duty and the low-linear velocity, the aspect of the high duty and the high-linear velocity, and the aspect of the low duty and the low-linear velocity. The evaluation results in the aspect of the high duty and the low-linear velocity is the same as in the aspect of the high duty and the high-linear velocity. Accordingly, the aspect of the high-duty and a higher linear velocity is more beneficial. The aspect of the high-duty and the high-linear velocity is the halftone-image quality priority mode, and the aspect of the low duty and the low-linear velocity is the solid-image quality priority mode. In other words, setting any of the halftone-image quality priority mode and the solid-image quality priority mode does not result in "POOR". That is, one of the solid-image quality priority mode and the halftone-image quality priority mode results in "EXCELLENT" and the other results in "FAIR". Which of the halftone-image quality priority mode and the solid-image quality priority mode results in "EXCELLENT" is preferably determined according to user's desire.

FIG. 37 is a block diagram of electrical circuitry of an input operation unit 501 of the image forming apparatus according to a third example of the present disclosure. The input operation unit 501 includes a solid-image quality priority button 501A, a halftone-image quality priority button 501B, the plain-paper button 501C, the uneven-surface sheet button 501D, the coated-paper button 501E, and the automatic detection button 501F. The solid-image quality priority button 501A and the halftone-image quality button 501B serve in the same manner as in the first example. The plain-paper button 501C, the uneven-surface sheet button 501D, the coated-paper button 501E, and the automatic detection button 501F serve in the same manner as in the second example. The image forming apparatus 1000 according to the third example includes the smoothness sensor 502 in FIG. 27 to automatically detect the sheet type.

Figure 38:
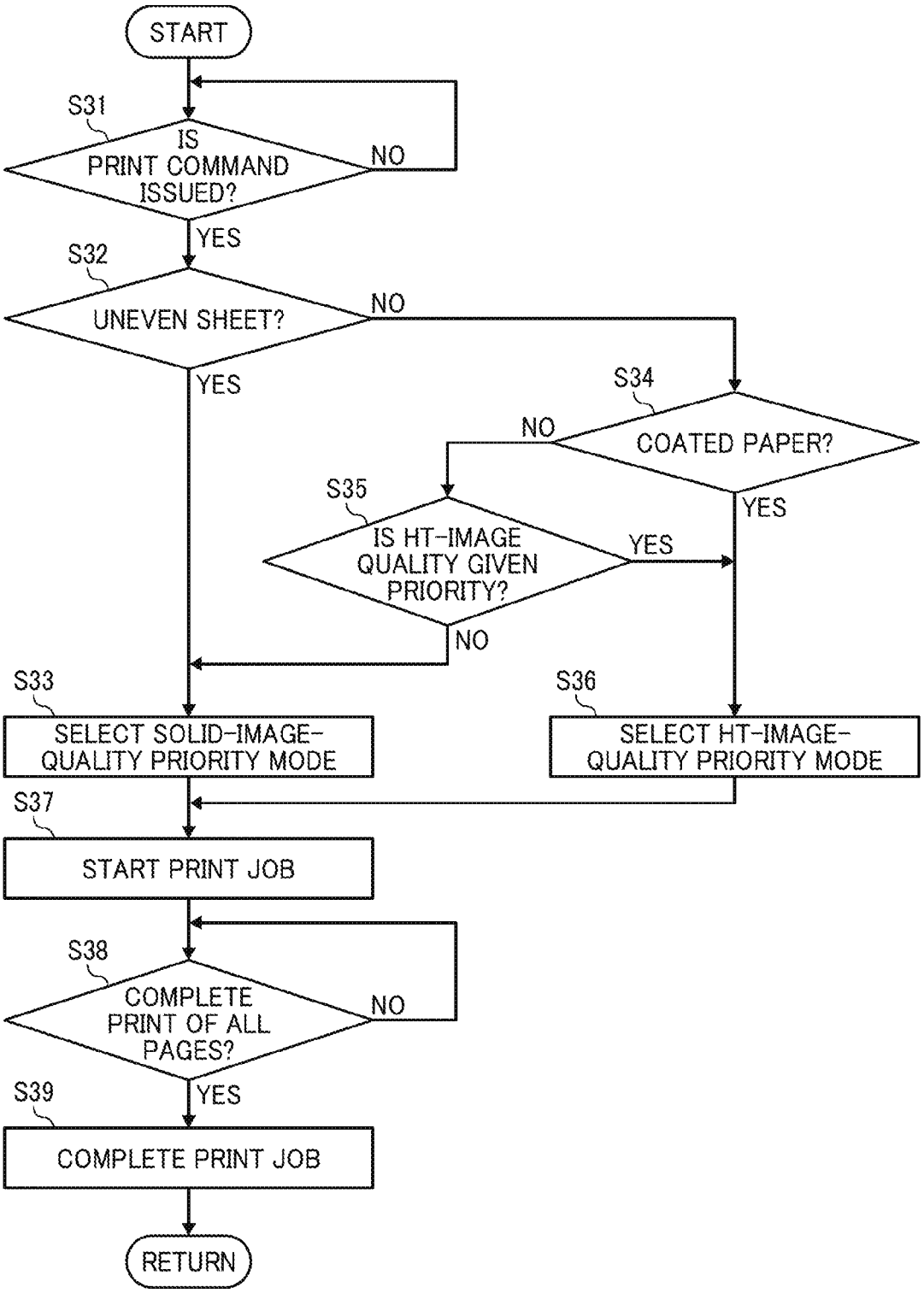
FIG. 38 is a flowchart of a print job process executed by the controller of the image forming apparatus according to still another example of the present disclosure.

FIG. 38 is a flowchart of a print job process performed by the controller 200 of the image forming apparatus 1000 according to the third Example. The controller 200 receives a print command signal from an external smoothness or scanner (YES in S31), and determines whether the information regarding smoothness stored in the flash memory represents the uneven-surface sheet (step S32). In contrast, when the information regarding smoothness represents the uneven-surface sheet (YES in step S32), the controller 200 selects the solid-image quality priority mode (step 33). When the information regarding smoothness does not represent the uneven-surface sheet (NO in step S32), the controller 200 determines whether the information regarding smoothness represents coated paper (step S34). When the information regarding smoothness represents coated paper (YES in step S34), the controller 200 selects the halftone-image quality priority mode (step S36). When the information regarding smoothness does not represent the coated paper (NO in step S34), the controller 200 selects the image forming mode according to the desired-quality information (step S35). More specifically, when the desired-quality information is the halftone-image quality priority information (YES in step S35), the controller 200 selects the halftone-image quality priority mode. When the desired-quality information is not the halftone-image quality priority information (NO in step S35), the controller 200 selects the solid-image quality priority mode.

Such a configuration can prevent "POOR" image quality for solid images and halftone images in any case using the uneven-surface sheet, coated paper, or plain paper. The configuration can further increase the grade of image quality of either one of the solid image and the halftone image according to a user's desire when plain paper is used as the recording sheet P.

[Variation]

The image forming apparatus according to Variation has a configuration in which a part of the configuration of the image forming apparatus according to the first embodiment is substituted for another configuration. The image forming apparatus 1000 according to Variation includes the input operation unit 501 of FIG. 28 as an input operation unit.

The user may select, through the operation of the input operation unit 501, the same brand as the brand of the recording sheet P that is set in the feed tray 100, among a plurality of brands included in the list. A brand corresponds to surface smoothness of a recording sheet that belongs to the brand. Thus, the brand serves as information that represents the surface smoothness.

The controller 200 preliminarily stores a data table in the flash memory. In the data table, each brand corresponds to information regarding smoothness that represents which sheet type the brand belongs to among plain paper, uneven-surface sheet, and surface coated paper. The controller 200 allows obtaining information regarding smoothness of a recording sheet P based on the brand and the data table.

Specific Example

Next, a description will be given of examples in which a more specific configuration is applied to the image forming apparatus 1000 according to the first Example, the second Example, the third Example, or Variations. Furthermore, the configuration of the image forming apparatus according to Specific Example is the same as in the first Example, the second Example, the third Example or Variation unless otherwise stated.

In the image forming apparatus according to the embodiments, each Example, and Variation, a single-layer hard belt that includes only a belt base made of hard material, polyimide is used as the intermediate transfer belt 31. In the image forming apparatus according to Specific Example, a multi-layer elastic belt is used as an intermediate transfer belt 31. The multi-layer elastic belt includes a belt base and an elastic layer covered over the front surface of the belt base. The belt base is made of hard material, and the elastic layer is made of more elastic material than at least the belt base.

The intermediate transfer belt 31 (multi-layer elastic belt) of the image forming apparatus according to Specific Example has the same configuration as those illustrated in FIGS. 4 and 5.

Table 7 below represents the results of the experiment that was performed under the same conditions as in the experiment for Table 5, except for the use of the multi-layer elastic belt as the intermediate transfer belt 31 in the experiment for Table 7.

TABLE 7

| LINEAR VELOCITY mm/s | SHEET TYPE | | | |
|---|---|---|---|---|
| | COATED PAPER - POD Gloss 128 gsm | | | IMAGE |
| BIAS | DC | High Duty | Low Duty | QUALITY |
| 352.8 | EXCELLENT | EXCELLENT | EXCELLENT | SURFACE ROUGHNESS |
| 158.8 | EXCELLENT | EXCELLENT | EXCELLENT | IN SOLID IMAGE |
| 352.8 | POOR | EXCELLENT | POOR | TRANSFER FAILURE |
| 158.8 | POOR | EXCELLENT | POOR | IN HALFTONE IMAGE |

EVALUATION RESULTS FOR IMAGE QUALITY

As represented in Table 7, image quality of solid images formed with the high-duty secondary-transfer bias including the superimposed voltage and at high velocity (process linear velocity of 352.8 mm/s) was evaluated as EXCELLENT. Such a configuration increases the image quality of the solid image when the surface coated paper is, as compared to the configuration according to each Example or Variation.

In Tables 3, 4, and 5, employing the low-duty superimposed voltage as the secondary-transfer bias to form a halftone image can obtain more favorable halftone images than employing the secondary-transfer bias including only DC voltage does. In this case, the low-duty superimposed voltage that does not reverse the polarity during one cycle as illustrated in FIG. 31 is employed as the secondary-transfer bias. The present inventors have confirmed through the experiments that, employing the low-duty superimposed voltage as the secondary-transfer bias that reverses the polarity can obtain more favorable halftone images than employing the secondary-transfer bias including only the DC voltage. For example, employing the low-duty superimposed voltage that reverses the polarity increases grade "FAIR" to grade "GOOD" in Tables 3 and 4, or increases grade "POOR" to grade "FAIR" in Table 5.

Thus, employing the low-duty superimposed voltage that reverses the polarity is advantageous from the viewpoint of enhancing the halftone-image quality. The halftone-image quality does not refer to overall image quality of a halftone image, but refers to insufficient image density in a halftone image due to the injection of the charges of the opposite polarity to toner particles. In other words, employing the low-duty superimposed voltage that reverses the polarity is advantageous from the viewpoint of preventing the occurrence of insufficient image density.

However, the secondary-transfer bias that reverses the polarity is preferably increased in transfer-peak value Vt to obtain the same time-averaged value Vave as that of the secondary-transfer bias that does not reverse the polarity. With an excessively increased absolute value of the transfer-peak value Vt, electric discharge often occurs within the secondary-transfer nip N, resulting in the occurrence of white spots in images. The possibility of occurrence of electric discharge varies with the type and specification of the image forming apparatus. Accordingly, the transfer-peak value Vt and the opposite-peak value Vr are preferably changed with the type or the specification of the image forming apparatus, to obtain an appropriate time-averaged value Vave within the range that prevents frequent occurrence of electric discharge. In some embodiments, the low-duty superimposed voltage that does not reverse the polarity is preferably employed in consideration of the possibility of occurrence of electric discharge according to the type or the specification of the image forming apparatus.

In the above-described fifth embodiment and Examples, plain paper and coated paper are used as a smooth sheet. However, no limitation is intended therein. Sheets having relatively small degree of surface unevenness may be considered a smooth sheet. The examples of such a sheet include Classic Linen-Solar White with a basis weight of 90 gsm or 118 gsm manufactured by Neenah Paper Inc., Classic Crest-Solar White with a basis weight of 90 gsm or 104 gsm manufactured by Neenah Paper Inc., and Leathac 66 with a basis weight of 118 gsm manufactured by Tokushu Tokai Paper Co., Ltd.

The image forming apparatus 1000 according to the above-described fifth embodiment and each Example may have the following configurations. When the recording sheet has a relatively smaller degree of surface unevenness than the uneven-surface sheet, a transfer bias having the duty of greater than 50% (the high-duty transfer bias) is applied to transfer a toner image from the image bearer that is driven at the first linear velocity onto the recording sheet. When the recording sheet is the uneven-surface sheet (for example, Leathac 66 of 175 kg in Table 4) having a greater surface unevenness than the above-described sheet, the transfer bias having the duty of less than 50% (the low-duty transfer bias) is applied to transfer a toner image from the image bearer, which is driven at a second linear velocity lower than the first linear velocity, onto the recording sheet.

In the fifth embodiment and each Example, a description was given of the image forming apparatus adopting the intermediate transfer system that employs an intermediate transferor, such as the intermediate transfer system 31. However, no limitations is intended hereby. In some embodiments, the image forming apparatus may adopt the direct transfer method that directly transfers an image from a photoconductor onto a recording sheet P. Further, the image bearer (the intermediate transfer belt 31) includes an elastic layer. In some embodiments, the elastic layer may not be included in the intermediate transfer belt 31. Even when the elastic layer is not included in the intermediate transfer belt, the intermediate transfer belt 31 might enclose the dot toner in a halftone image due to the pressure applied to the secondary-transfer nip or the elastic deformation of a roller (the secondary-transfer first roller 33). According to the above-described embodiment, using the high-duty secondary transfer bias can prevent transfer failure of halftone images. Even when the intermediate transfer belt 31 without the elastic layer is used, applying the low-duty secondary-transfer bias can provide a successful secondary transferability of toner relative to the uneven-surface sheet. Alternatively, the occurrence of surface roughness of a solid image can be prevented or reduced.

The exemplary embodiments described above are one example and attain advantages below in a plurality of Aspects 30 to 45.

—Aspect 30—

According to Aspect 30, an image forming apparatus includes an image bearer (for example, the intermediate transfer belt 31), a drive source (for example, the drive motor M) to drive the image bearer, a nip forming member (for example, the sheet conveyance belt 41) to form a transfer nip between the image bearer and the nip forming member, a power source (for example, the secondary-transfer power source 39) to output a transfer bias (for example, the secondary-transfer bias) including an alternating current (AC) component to transfer a toner image from the image bearer to a recording sheet in the transfer nip, and a controller (for example, the controller 200). The controller changes between a first mode and a second mode according to a predetermined condition. In the first mode, the controller controls the power source to output the transfer bias having a first duty (for example, the high duty) higher than a second duty (for example, the low duty) and moves the image bearer at a first linear velocity (for example, the high-linear velocity) higher than a second linear velocity (for example, the low-linear velocity). In the second mode, the controller controls the power source to output the transfer bias having the second duty and moves the image bearer at the second linear velocity. Each of the first duty and the second duty is obtained by formula: $(T-Tt)/T\times100\%$ where T is a cycle of the transfer bias and Tt is a transfer-directional time period in which a value of the transfer bias is on the transfer-directional side to move the toner image from the image bearer onto the recording sheet, relative to a time-averaged value (Vave) of the transfer bias during the cycle of the transfer bias. Such a configuration can successfully transfer a toner image from the image bearer onto the recesses of the uneven surface of the recording sheet, and can further prevent insufficient image density of halftone images. Further, this configuration can prevent unnecessarily reducing the printing speed, and can further prevent the occurrence of insufficient image density in forming halftone images. Thus, transfer failure can be prevented.

—Aspect 31—

In Aspect 31, the first duty is greater than 50% and the second duty is less than 50%. With this configuration, employing the high-duty transfer bias in the first mode allows obtaining a favorable halftone image quality, and employing the low-duty transfer bias in the second mode allows obtaining a favorable solid image quality.

—Aspect 32—

In Aspect 32 according to Aspect 30, the predetermined condition is a type of the recording sheet. Such a configuration can prevent transfer failure irrespective of the type of the recording sheet.

—Aspect 33—

In Aspect 33 according to Aspect 32, the controller executes the first mode when the type of the recording sheet is a smooth sheet (for example, coated paper). Further, the controller executes the second mode when the type of the recording sheet is an uneven-surface sheet (uneven-surface sheet) having a greater unevenness than the smooth sheet. Such a configuration allows successfully transferring toner from the image bearer onto the surface recesses of the recording sheet having a greater surface unevenness. The configuration can further prevent insufficient image density of halftone images in the smooth sheet. The configuration can further prevent insufficient image density of halftone images without unnecessarily reducing print speed in forming halftone images.

—Aspect 34—

In Aspect 34 according to Aspect 33, the first duty is greater than 50% and the second duty is less than 50%. In this configuration, employing the secondary-transfer bias having the duty of less than 50% achieves a successful transfer of toner from the image bearer onto the surface recesses of the recording sheet having a greater surface unevenness than the smooth sheet. In general, printed images of a user sometimes include a photo image that often includes halftone images made of light-gray colored or light-colored images. The secondary-transfer bias having duty of greater than 50% is employed to transfer a picture image onto a smooth sheet, thereby reliably preventing insufficient image density in a halftone-image portion. Thus, the secondary-transfer failure in output images can be prevented. Further, this configuration can prevent unnecessarily reducing the printing speed, and can further prevent the occurrence of insufficient image density in forming halftone images.

—Aspect 35—

In Aspect 35 according to Aspect 30 or 31, the image forming apparatus further includes an information acquisition unit and a controller. The information acquisition unit acquires information regarding a surface smoothness of the recording sheet that is a transfer target of the toner image. The controller changes between the first mode and the second mode according to the acquisition results of the information acquisition unit. This configuration can select an appropriate mode among a plurality of image forming modes, according to the smoothness of the recording sheet.

—Aspect 36—

In Aspect 36 according to Aspect 35, when the information regarding smoothness acquired by the information acquisition unit corresponds to a surface smoothness of the uneven-surface sheet, the controller executes the second mode. Such a configuration can prevent the evaluation result as "POOR" for image quality of any of the solid image and the halftone image when the uneven-surface sheet is used, as described in the second example.

—Aspect 37—

In Aspect 37 according to Aspect 36, when the information regarding smoothness acquired by the information acquisition unit does not correspond to the surface smoothness of the uneven-surface sheet, the controller executes the first mode. Such a configuration can prevent the evaluation result as "POOR" for image quality of any of the solid image and the halftone image when plain paper or coated paper is used, and can also prevent unnecessarily reducing the printing speed.

—Aspect 38—

In Aspect 38 according to Aspect 36, the information acquisition unit acquires information regarding a desired quality of a user that is quality of an image desired by a user, in addition to the information regarding smoothness. The controller selects between the first mode and the second mode according to the desired-quality information of the information acquisition unit when the information regarding smoothness of the information acquisition unit does not correspond to the surface smoothness of the uneven-surface sheet and to the surface smoothness of the coated paper. This configuration can prioritize the quality of either one of the solid image and the halftone image according to a user's desire when plain paper is used as the recording sheet.

—Aspect 39—

In Aspect 39 according to Aspect 38, the controller selects the second mode when the acquisition result of the information acquisition unit represents giving a higher priority to the image quality of a solid portion than an image quality of a halftone portion in an image. Further, the controller selects the first mode when the acquisition result of the information acquisition unit represents giving a higher priority to the image quality of the halftone portion than the image quality of the solid portion in the image. This configuration can prioritize the increase in the image quality of either one of the solid image and the halftone image according to a user's desire when plain paper is used as the recording sheet.

—Aspect 40—

In Aspect 40 according to Aspect 30 or 31, the image forming apparatus further includes an information acquisition unit to acquire information regarding a desired quality of a user. The controller selects between the first mode and the second mode according to the information regarding desired-quality acquired by the information acquisition unit. This configuration can select an appropriate mode among a plurality of image forming modes, according to a user's desire.

—Aspect 41—

In Aspect 41 according to Aspect 40, the controller selects the second mode when the desired-quality information acquired by the information acquisition unit represents giving a higher priority to the image quality of a solid portion than a halftone portion in an image. Further, the controller selects the first mode when the desired-quality information acquired by the information acquisition unit represents giving a higher priority to the image quality of the halftone portion than the solid portion in the image. This configuration can obtain favorable image quality of the solid image or the halftone image according to a user's desire.

—Aspect 42—

In Aspect 42 according to Aspect 30 or 31, the controller selects either one of the first mode and the second mode according to an average area coverage modulation rate of an image. This configuration can select an appropriate mode among a plurality of image forming modes, according to the average area coverage modulation rate of an image.

—Aspect 43—

In Aspect 43 according to aspect 42, the controller selects the second mode when the average area coverage modulation rate is greater than or equal to a threshold value. Further, the controller selects the first mode when the average coverage modulation rate is less than or equal to the threshold value. This configuration can give a higher priority to the image quality of the solid image when the frequency of outputting the solid image increases, and give a higher priority to the image quality of the halftone image when the frequency of outputting the halftone image increases.

—Aspect 44—

In Aspect 44 according to any one of Aspects 30 through 43, the image bearer is a multi-layer belt member including at least endless belt base and an elastic layer that is more elastic than the belt base on the belt base. Such a configuration can increase the image quality of the solid image when the surface coated paper is used, as compared to in the case that employs a single-layer belt member.

—Aspect 45—

According to Aspect 45, a transfer method includes transferring a toner image from an image bearer that is driven at a first linear velocity onto a recording sheet with a transfer bias having duty of greater than 50% when the recording sheet is a smooth sheet having a smaller surface unevenness than an uneven-surface sheet. The transfer method further includes transferring the toner image from the image bearer driven at a second linear velocity onto the uneven-surface sheet with the transfer bias having duty of less than 50%. The duty is $(T-Tt)/T\times100\%$ where T is a cycle of the transfer bias and Tt is a transfer-directional time period in which a value of the transfer bias is on the transfer-directional side to move the toner image from the image bearer onto the recording sheet, relative to a time-averaged value of the transfer bias during the cycle of the transfer bias.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image bearer;

a nip forming member to form a transfer nip between the image bearer and the nip forming member;

a nip width changing device to change a width of the transfer nip;

a power source to output a transfer bias including an alternating-current (AC) component to transfer a toner image from the image bearer to a recording sheet in the transfer nip; and a controller to switch between a first mode and a second mode according to a predetermined condition, a duty of the transfer bias being a first duty and a width of the transfer nip being a first width in the first mode, the duty of the transfer bias being a second duty lower than the first duty and the width of the transfer nip being a second width greater than the first width in the second mode, the duty being $(T-Tt)/T\times100\%$ where T denotes one cycle of the transfer bias, and Tt denotes a time period, in which the transfer bias is on a transfer-directional side to move the toner image from the image bearer to the recording sheet relative to a time-averaged value of the transfer bias, in the one cycle.

2. The image forming apparatus according to claim 1, wherein the first duty is greater than 50% and the second duty is less than 50%.

3. The image forming apparatus according to claim 1, wherein the predetermined condition is a type of the recording sheet.

4. The image forming apparatus according to claim 3, wherein the controller executes the first mode when the type of the recording sheet is a smooth sheet, and wherein the controller executes the second mode when the type of the recording sheet is an uneven-surface sheet having a greater surface unevenness than a surface unevenness of the smooth sheet.

5. The image forming apparatus according to claim 4, wherein the first duty is greater than 50% and the second duty is less than 50%.

6. The image forming apparatus according to claim 4, wherein the controller controls the power source to output the transfer bias having the duty of from 8% to 35% when the recording sheet is the uneven-surface sheet.

7. The image forming apparatus according to claim 6, wherein the controller controls the power source to output the transfer bias having the duty of less than or equal to 17% when the recording sheet is the uneven-surface sheet.

8. The image forming apparatus according to claim 4, wherein the controller controls the power source to output the transfer bias having the duty of from 70% to 90% when the recording sheet is the smooth sheet.

9. The image forming apparatus according to claim 4, wherein the controller controls the power source to output the transfer bias that alternately changes a polarity of the transfer bias when the recording sheet is the uneven-surface sheet.

10. The image forming apparatus according to claim 4, wherein the controller controls the power source to output the transfer bias having a constant polarity when the recording sheet is the smooth sheet.

11. The image forming apparatus according to claim 1, further comprising a mode selector that selects between a halftone-image priority mode to give a higher priority to image quality of a halftone image than to image quality of a solid image and a solid-image priority mode to give a higher priority to the image quality of the solid image than to the image quality of the halftone image, wherein the controller executes the first mode according to the halftone-image priority mode selected by the mode selector, and wherein the controller executes the second mode according to the solid-image priority mode selected by the mode selector.

12. The image forming apparatus according to claim 1, further comprising a mode selector that selects between the first mode and the second mode, wherein the controller executes one of the first mode and the second mode according to a selection result of the mode selector.

13. The image forming apparatus according to claim 1, wherein a frequency of the transfer bias in the first mode is higher than a frequency of the transfer bias in the second mode.

14. The image forming apparatus according to claim 1, wherein a peak-to-peak value of the AC component of the transfer bias in the first mode is smaller than the peak-to-peak value of the AC component of the transfer bias in the second mode.

15. The image forming apparatus according to claim 1, wherein the transfer bias has a transfer-peak value, which is on the transfer-directional side relative to the time-average value, and an opposite-peak value that is different from the transfer-peak value, and wherein the opposite-peak value in the first mode is on the transfer-directional side relative to the opposite-peak value in the second mode.

16. A transfer method comprising:

transferring a toner image from an image bearer to a recording sheet by a transfer bias having a duty of greater than 50% in the transfer nip, to which a first pressure is applied, when the recording sheet is a plain sheet, and transferring the toner image from the image bearer to the recording sheet by the transfer bias having the duty of less than 50% in the transfer nip, to which a second pressure greater than the first pressure is applied, when the recording sheet is an uneven sheet having a greater unevenness than the plain sheet, the duty being $(T-Tt)/T\times100\%$ where T denotes one cycle of the transfer bias, and Tt denotes a time period, in which the transfer bias is on a transfer-directional side to move the toner image from the image bearer to the recording sheet relative to a time-averaged value of the transfer bias, in the one cycle.

17. An image forming apparatus comprising:

an image bearer;

a drive source to drive the image bearer;

a nip forming member to form a transfer nip between the image bearer and the nip forming member;

a power source to output a transfer bias including an alternating-current (AC) component to transfer a toner image from the image bearer to a recording sheet in the transfer nip; and a controller to switch a mode between a first mode and a second mode according to a predetermined condition, a duty of the transfer bias being a first duty and a linear velocity of the image bearer being a first linear velocity in the first mode, the duty of the transfer bias being a second duty lower than the first duty and the linear velocity of the image bearer being a second linear velocity lower than the first linear velocity in the second mode, the duty being $(T-Tt)/T\times100\%$ where T denotes one cycle of the transfer bias, and Tt denotes a time period, in which the transfer bias is on a transfer-directional side to move the toner image from the image bearer to the recording sheet relative to a time-averaged value of the transfer bias, in the one cycle.

18. The image forming apparatus according to claim 17, wherein the predetermined condition is a type of the recording sheet.

19. The image forming apparatus according to claim 18, wherein the controller executes the first mode when the type of the recording sheet is a smooth sheet, and wherein the controller executes the second mode when the type of the recording sheet is an uneven-surface sheet having a greater surface unevenness than a surface unevenness of the smooth sheet.

20. The image forming apparatus according to claim 19, wherein the first duty is greater than 50% and the second duty is less than 50%.

* * * * *